US011393482B2

(12) United States Patent
Li et al.

(10) Patent No.: US 11,393,482 B2
(45) Date of Patent: Jul. 19, 2022

(54) AUDIO ENCODING AND DECODING METHOD AND RELATED PRODUCT

(71) Applicant: Huawei Technologies Co., Ltd., Shenzhen (CN)

(72) Inventors: Haiting Li, Beijing (CN); Bin Wang, Beijing (CN); Lei Miao, Beijing (CN)

(73) Assignee: HUAWEI TECHNOLGOIES CO., LTD., Shenzhen (CN)

( * ) Notice: Subject to any disclaimer, the term of this patent is extended or adjusted under 35 U.S.C. 154(b) by 0 days.

(21) Appl. No.: 16/887,878

(22) Filed: May 29, 2020

(65) Prior Publication Data

US 2020/0294513 A1 Sep. 17, 2020

Related U.S. Application Data

(63) Continuation of application No. PCT/CN2018/118301, filed on Nov. 29, 2018.

(30) Foreign Application Priority Data

Nov. 30, 2017 (CN) ..... 201711244330.5

(51) Int. Cl.

| | |
|---|---|
| ***G10L 19/008*** | (2013.01) |
| ***G10L 19/22*** | (2013.01) |
| ***H04S 1/00*** | (2006.01) |
| ***H04S 3/00*** | (2006.01) |

(52) U.S. Cl.

CPC ..... *G10L 19/008* (2013.01); *H04S 1/007* (2013.01)

(58) Field of Classification Search

CPC ..... G10L 19/008; G10L 19/00; G10L 19/02; G10L 19/022; G10L 19/025; G10L 19/06; G10L 19/10; G10L 19/18; G10L 19/20; G10L 19/22; G10L 19/24; G10L 25/03; H04R 5/00; H04S 3/00; H04S 3/008; H04S 5/00; H04S 7/00; H04S 1/007; H04S 2400/03

USPC ..... 704/220, 275, 500, 501, 502, 503, 504; 381/1–23; 700/94

See application file for complete search history.

(56) References Cited

U.S. PATENT DOCUMENTS

| | | | | |
|---|---|---|---|---|
| 2006/0140412 | A1* | 6/2006 | Villemoes | G10L 19/008 381/12 |
| 2007/0009032 | A1 | 1/2007 | Liebchen | |
| 2008/0279388 | A1 | 11/2008 | Oh et al. | |
| 2009/0313028 | A1 | 12/2009 | Tammi et al. | |

(Continued)

FOREIGN PATENT DOCUMENTS

| | | | |
|---|---|---|---|
| CN | 101218628 | A | 7/2008 |
| CN | 101630509 | A | 1/2010 |

(Continued)

*Primary Examiner* — Leshui Zhang
(74) *Attorney, Agent, or Firm* — Conley Rose, P.C.

(57) ABSTRACT

An audio encoding and decoding method includes obtaining a channel combination scheme for a current frame, obtaining an encoding mode of the current frame based on a downmix mode of a previous frame and the channel combination scheme for the current frame, performing time-domain downmix processing on left and right channel signals of the current frame based on the encoding mode of the current frame to obtain primary and secondary channel signals of the current frame, and encoding the primary and secondary channel signals of the current frame.

13 Claims, 12 Drawing Sheets

(56) References Cited

U.S. PATENT DOCUMENTS

| | | | |
|---|---|---|---|
| 2010/0079185 | A1 | 4/2010 | Lee et al. |
| 2010/0241436 | A1 | 9/2010 | Kim et al. |
| 2012/0221343 | A1 | 8/2012 | Kim et al. |
| 2015/0332684 | A1 | 11/2015 | Oh |
| 2017/0270934 | A1 | 9/2017 | Atti et al. |
| 2018/0286415 | A1* | 10/2018 | Vaillancourt ..... G10L 19/002 |

FOREIGN PATENT DOCUMENTS

| | | | |
|---|---|---|---|
| CN | 102089809 | A | 6/2011 |
| CN | 102428513 | A | 4/2012 |
| CN | 104240712 | A | 12/2014 |
| EP | 3664088 | A1 | 6/2020 |
| TW | I342718 | B | 5/2011 |
| TW | I344638 | B | 7/2011 |
| WO | 2013120531 | A1 | 8/2013 |
| WO | 2017049396 | A1 | 3/2017 |
| WO | 2017049397 | A1 | 3/2017 |

* cited by examiner

AUDIO ENCODING AND DECODING METHOD AND RELATED PRODUCT

CROSS-REFERENCE TO RELATED APPLICATIONS

This application is a continuation of International Patent Application No. PCT/CN2018/118301 filed on Nov. 29, 2018, which claims priority to Chinese Patent Application No. 201711244330.5 filed on Nov. 30, 2017. The disclosures of the aforementioned applications are hereby incorporated by reference in their entireties.

TECHNICAL FIELD

This application relates to the field of audio encoding and decoding technologies, and in particular, to an audio encoding and decoding method and a related product.

BACKGROUND

As life quality improves, people have increasing requirements on high-quality audio. In comparison with mono audio, stereo audio has a sense of direction and a sense of distribution of various acoustic sources, can improve clarity, intelligibility, and a sense of immediacy of information, and therefore is popular with people.

A parametric stereo encoding/decoding technology is a common stereo encoding/decoding technology in which a stereo signal is converted into a mono signal and a spatial awareness parameter, and multi-channel signals are compressed. However, in the parametric stereo encoding/decoding technology, a spatial awareness parameter usually needs to be extracted in frequency domain, and time-frequency transformation needs to be performed, thereby leading to a relatively large delay of an entire codec. Therefore, when a delay requirement is relatively strict, a time-domain stereo encoding technology is a better choice.

In a conventional time-domain stereo encoding technology, signals are downmixed into two mono signals in time domain. For example, in a Mid-Side (MS) encoding technology, left and right channel signals are first downmixed into a mid channel signal and a side channel signal. For example, L represents the left channel signal, and R represents the right channel signal. In this case, the mid channel signal is $0.5\times(L+R)$, and the mid channel signal represents information about a correlation between left and right channels, the side channel signal is $0.5\times(L-R)$, and the side channel signal represents information about a difference between the left and right channels. Then, the mid channel signal and the side channel signal are separately encoded using a mono encoding method, the mid channel signal is usually encoded using more bits, and the side channel signal is usually encoded using fewer bits.

It is found in studies and practices that when the conventional time-domain stereo encoding technology is used, energy of a primary signal is sometimes very small or even absent. This degrades final encoding quality.

SUMMARY

Embodiments of this application provide an audio encoding and decoding method and a related product.

According to a first aspect, an embodiment of this application provides an audio encoding method, including determining a channel combination scheme for a current frame, determining an encoding mode of the current frame based on a downmix mode of a previous frame and the channel combination scheme for the current frame, performing time-domain downmix processing on left and right channel signals of the current frame based on the encoding mode of the current frame, to obtain primary and secondary channel signals of the current frame, and encoding the obtained primary and secondary channel signals of the current frame.

A stereo signal of the current frame includes, for example, the left and right channel signals of the current frame.

The channel combination scheme for the current frame is one of a plurality of channel combination schemes. For example, the plurality of channel combination schemes include an anticorrelated signal channel combination scheme and a correlated signal channel combination scheme. The correlated signal channel combination scheme is a channel combination scheme corresponding to a near in phase signal. The anticorrelated signal channel combination scheme is a channel combination scheme corresponding to a near out of phase signal.

It can be understood that the channel combination scheme corresponding to a near in phase signal is applicable to a near in phase signal, and the channel combination scheme corresponding to a near out of phase signal is applicable to a near out of phase signal.

A downmix mode of an audio frame (for example, the previous frame or the current frame) is one of a plurality of downmix modes. The plurality of downmix modes include a downmix mode A, a downmix mode B, a downmix mode C, and a downmix mode D. The downmix mode A and the downmix mode D are correlated signal downmix modes. The downmix mode B and the downmix mode C are anticorrelated signal downmix modes. The downmix mode A of the audio frame, the downmix mode B of the audio frame, the downmix mode C of the audio frame, and the downmix mode D of the audio frame correspond to different downmix matrices.

It can be understood that because a downmix matrix corresponds to an upmix matrix, the downmix mode A of the audio frame, the downmix mode B of the audio frame, the downmix mode C of the audio frame, and the downmix mode D of the audio frame also correspond to different upmix matrices.

It can be understood that in the foregoing encoding solution, the encoding mode of the current frame needs to be determined based on the downmix mode of the previous frame and the channel combination scheme for the current frame. This indicates that there are a plurality of possible encoding modes of the current frame. Therefore, in comparison with a conventional solution in which there is only one encoding mode, this helps achieve better compatibility and matching between a plurality of possible encoding modes and downmix modes and a plurality of possible scenarios.

In addition, according to a second aspect, an embodiment of this application provides a method for determining an audio encoding mode. The method may include determining a channel combination scheme for a current frame, and determining an encoding mode of the current frame based on a downmix mode of a previous frame and the channel combination scheme for the current frame.

The encoding mode of the current frame is one of a plurality of encoding modes. For example, the plurality of encoding modes may include downmix mode switching encoding modes, downmix mode non-switching encoding modes, and the like.

Further, the downmix mode non-switching encoding modes may include a downmix mode A-to-downmix mode A encoding mode, a downmix mode B-to-downmix mode B encoding mode, a downmix mode C-to-downmix mode C encoding mode, and a downmix mode D-to-downmix mode D encoding mode.

Further, the downmix mode switching encoding modes may include a downmix mode A-to-downmix mode B encoding mode, a downmix mode A-to-downmix mode C encoding mode, a downmix mode B-to-downmix mode A encoding mode, a downmix mode B-to-downmix mode D encoding mode, a downmix mode C-to-downmix mode A encoding mode, a downmix mode C-to-downmix mode D encoding mode, a downmix mode D-to-downmix mode B encoding mode, and a downmix mode D-to-downmix mode C encoding mode.

Determining an encoding mode of the current frame based on a downmix mode of a previous frame and the channel combination scheme for the current frame may be implemented in various manners.

For example, in some possible implementations, determining an encoding mode of the current frame based on a downmix mode of a previous frame and the channel combination scheme for the current frame may include if the downmix mode of the previous frame is the downmix mode A, and the channel combination scheme for the current frame is the correlated signal channel combination scheme, determining that a downmix mode of the current frame is the downmix mode A, and determining that the encoding mode of the current frame is the downmix mode A-to-downmix mode A encoding mode, if the downmix mode of the previous frame is the downmix mode B, and the channel combination scheme for the current frame is the anticorrelated signal channel combination scheme, determining that a downmix mode of the current frame is the downmix mode B, and determining that the encoding mode of the current frame is the downmix mode B-to-downmix mode B encoding mode, if the downmix mode of the previous frame is the downmix mode C, and the channel combination scheme for the current frame is the anticorrelated signal channel combination scheme, determining that a downmix mode of the current frame is the downmix mode C, and determining that the encoding mode of the current frame is the downmix mode C-to-downmix mode C encoding mode, or if the downmix mode of the previous frame is the downmix mode D, and the channel combination scheme for the current frame is the correlated signal channel combination scheme, determining that a downmix mode of the current frame is the downmix mode D, and determining that the encoding mode of the current frame is the downmix mode D-to-downmix mode D encoding mode.

For another example, in some possible implementations, determining an encoding mode of the current frame based on a downmix mode of a previous frame and the channel combination scheme for the current frame may include determining the encoding mode of the current frame based on the downmix mode of the previous frame, a downmix mode switching cost value of the current frame, and the channel combination scheme for the current frame.

The downmix mode switching cost value of the current frame may be, for example, a calculation result calculated based on a downmix mode switching cost function of the current frame (for example, a greater result indicates a greater switching cost). The downmix mode switching cost function is constructed based on at least one of the following parameters at least one time-domain stereo parameter of the current frame, at least one time-domain stereo parameter of the previous frame, and the left and right channel signals of the current frame.

Alternatively, the downmix mode switching cost value of the current frame is a channel combination ratio factor of the current frame.

The downmix mode switching cost function is, for example, one of the following switching cost functions: a cost function for downmix mode A-to-downmix mode B switching, a cost function for downmix mode A-to-downmix mode C switching, a cost function for downmix mode D-to-downmix mode B switching, a cost function for downmix mode D-to-downmix mode C switching, a cost function for downmix mode B-to-downmix mode A switching, a cost function for downmix mode B-to-downmix mode D switching, a cost function for downmix mode C-to-downmix mode A switching, a cost function for downmix mode C-to-downmix mode D switching, and the like.

In some possible implementations, determining the encoding mode of the current frame based on the downmix mode of the previous frame, a downmix mode switching cost value of the current frame, and the channel combination scheme for the current frame may include if the downmix mode of the previous frame is the downmix mode A, the channel combination scheme for the current frame is an anticorrelated signal channel combination scheme, and the downmix mode switching cost value of the current frame satisfies a first downmix mode switching condition, determining that a downmix mode of the current frame is the downmix mode C, and the encoding mode of the current frame is the downmix mode A-to-downmix mode C encoding mode, where the downmix mode switching cost value is a value of the downmix mode switching cost function, and the first mode switching condition is that a value of the cost function for downmix mode A-to-downmix mode B switching of the current frame is greater than or equal to a value of the cost function for downmix mode A-to-downmix mode C switching, if the downmix mode of the previous frame is the downmix mode A, the channel combination scheme for the current frame is an anticorrelated signal channel combination scheme, and the downmix mode switching cost value of the current frame satisfies a second downmix mode switching condition, determining that a downmix mode of the current frame is the downmix mode B, and the encoding mode of the current frame is the downmix mode A-to-downmix mode B encoding mode, where the downmix mode switching cost value is a value of the downmix mode switching cost function, and the second mode switching condition is that a value of the cost function for downmix mode A-to-downmix mode B switching of the current frame is less than or equal to a value of the cost function for downmix mode A-to-downmix mode C switching, if the downmix mode of the previous frame is the downmix mode B, the channel combination scheme for the current frame is the correlated signal channel combination scheme, and the downmix mode switching cost value of the current frame satisfies a third downmix mode switching condition, determining that a downmix mode of the current frame is the downmix mode A, and the encoding mode of the current frame is the downmix mode B-to-downmix mode A encoding mode, where the downmix mode switching cost value is a value of the downmix mode switching cost function, and the third mode switching condition is that a value of the cost function for downmix mode B-to-downmix mode A switching of the current frame is less than or equal to a value of the cost function for downmix mode B-to-downmix mode D switching, if the downmix mode of the previous frame is the downmix mode B, the channel combination scheme for the current frame is the correlated signal channel combination scheme, and the downmix mode switching cost value of the current frame satisfies a fourth downmix mode switching condition, determining that a downmix mode of the current frame is the downmix mode D, and the encoding mode of the current frame is the downmix mode B-to-downmix mode D encoding mode, where the downmix mode switching cost value is a value of the downmix mode switching cost function, and the fourth mode switching condition is that a value of the cost function for downmix mode B-to-downmix mode A switching of the current frame is greater than or equal to a value of the cost function for downmix mode B-to-downmix mode D switching, if the downmix mode of the previous frame is the downmix mode C, the channel combination scheme for the current frame is the correlated signal channel combination scheme, and the downmix mode switching cost value of the current frame satisfies a fifth downmix mode switching condition, determining that a downmix mode of the current frame is the downmix mode D, and the encoding mode of the current frame is the downmix mode C-to-downmix mode D encoding mode, where the downmix mode switching cost value is a value of the downmix mode switching cost function, and the fifth mode switching condition is that a value of the cost function for downmix mode C-to-downmix mode A switching of the current frame is greater than or equal to a value of the cost function for downmix mode C-to-downmix mode D switching, if the downmix mode of the previous frame is the downmix mode C, the channel combination scheme for the current frame is the correlated signal channel combination scheme, and the downmix mode switching cost value of the current frame satisfies a sixth downmix mode switching condition, determining that a downmix mode of the current frame is the downmix mode A, and the encoding mode of the current frame is the downmix mode C-to-downmix mode A encoding mode, where the downmix mode switching cost value is a value of the downmix mode switching cost function, and the sixth mode switching condition is that a value of the cost function for downmix mode C-to-downmix mode A switching of the current frame is less than or equal to a value of the cost function for downmix mode C-to-downmix mode D switching, if the downmix mode of the previous frame is the downmix mode D, the channel combination scheme for the current frame is the anticorrelated signal channel combination scheme, and the downmix mode switching cost value of the current frame satisfies a seventh downmix mode switching condition, determining that a downmix mode of the current frame is the downmix mode B, and the encoding mode of the current frame is the downmix mode D-to-downmix mode B encoding mode, where the downmix mode switching cost value is a value of the downmix mode switching cost function, and the seventh mode switching condition is that a value of the cost function for downmix mode D-to-downmix mode B switching of the current frame is less than or equal to a value of the cost function for downmix mode D-to-downmix mode C switching, or if the downmix mode of the previous frame is the downmix mode D, the channel combination scheme for the current frame is the anticorrelated signal channel combination scheme, and the downmix mode switching cost value of the current frame satisfies an eighth downmix mode switching condition, determining that a downmix mode of the current frame is the downmix mode C, and the encoding mode of the current frame is the downmix mode D-to-downmix mode C encoding mode, where the downmix mode switching cost value is a value of the downmix mode switching cost function, and the eighth mode switching condition is that a value of the cost function for downmix mode D-to-downmix mode B switching of the current frame is greater than or equal to a value of the cost function for downmix mode D-to-downmix mode C switching.

In some other possible implementations, determining the encoding mode of the current frame based on the downmix mode of the previous frame, a downmix mode switching cost value of the current frame, and the channel combination scheme for the current frame, for example, may include if the downmix mode of the previous frame is the downmix mode A, the channel combination scheme for the current frame is the anticorrelated signal channel combination scheme, and the downmix mode switching cost value of the current frame satisfies a ninth downmix mode switching condition, determining that a downmix mode of the current frame is the downmix mode C, and the encoding mode of the current frame is the downmix mode A-to-downmix mode C encoding mode, where the downmix mode switching cost value of the current frame is the channel combination ratio factor of the current frame, and the ninth mode switching condition is that the channel combination ratio factor of the current frame is less than or equal to a channel combination ratio factor threshold S1, if the downmix mode of the previous frame is the downmix mode A, the channel combination scheme for the current frame is the anticorrelated signal channel combination scheme, and the downmix mode switching cost value of the current frame satisfies a tenth downmix mode switching condition, determining that a downmix mode of the current frame is the downmix mode B, and the encoding mode of the current frame is the downmix mode A-to-downmix mode B encoding mode, where the downmix mode switching cost value of the current frame is the channel combination ratio factor of the current frame, and the tenth mode switching condition is that the channel combination ratio factor of the current frame is greater than or equal to a channel combination ratio factor threshold S1, if the downmix mode of the previous frame is the downmix mode B, the channel combination scheme for the current frame is the correlated signal channel combination scheme, and the downmix mode switching cost value of the current frame satisfies an eleventh downmix mode switching condition, determining that a downmix mode of the current frame is the downmix mode A, and the encoding mode of the current frame is the downmix mode B-to-downmix mode A encoding mode, where the downmix mode switching cost value of the current frame is the channel combination ratio factor of the current frame, and the eleventh mode switching condition is that the channel combination ratio factor of the current frame is greater than or equal to a channel combination ratio factor threshold S2, if the downmix mode of the previous frame is the downmix mode B, the channel combination scheme for the current frame is the correlated signal channel combination scheme, and the downmix mode switching cost value of the current frame satisfies a twelfth downmix mode switching condition, determining that a downmix mode of the current frame is the downmix mode D, and the encoding mode of the current frame is the downmix mode B-to-downmix mode D encoding mode, where the downmix mode switching cost value of the current frame is the channel combination ratio factor of the current frame, and the twelfth mode switching condition is that the channel combination ratio factor of the current frame is less than or equal to a channel combination ratio factor threshold S2, if the downmix mode of the previous frame is the downmix mode C, the channel combination scheme for the current frame is the correlated signal channel combination scheme, and the downmix mode switching cost value of the current frame satisfies a thirteenth downmix mode switching condition, determining that a downmix mode of the current frame is the downmix mode D, and the encoding mode of the current frame is the downmix mode C-to-downmix mode D encoding mode, where the downmix mode switching cost value of the current frame is the channel combination ratio factor of the current frame, and the thirteenth mode switching condition is that the channel combination ratio factor of the current frame is greater than or equal to a channel combination ratio factor threshold S3, if the downmix mode of the previous frame is the downmix mode C, the channel combination scheme for the current frame is the correlated signal channel combination scheme, and the downmix mode switching cost value of the current frame satisfies a fourteenth downmix mode switching condition, determining that a downmix mode of the current frame is the downmix mode A, and the encoding mode of the current frame is the downmix mode C-to-downmix mode A encoding mode, where the downmix mode switching cost value of the current frame is the channel combination ratio factor of the current frame, and the fourteenth mode switching condition is that the channel combination ratio factor of the current frame is less than or equal to a channel combination ratio factor threshold S3, if the downmix mode of the previous frame is the downmix mode D, the channel combination scheme for the current frame is the anticorrelated signal channel combination scheme, and the downmix mode switching cost value of the current frame satisfies a fifteenth downmix mode switching condition, determining that a downmix mode of the current frame is the downmix mode B, and the encoding mode of the current frame is the downmix mode D-to-downmix mode B encoding mode, where the downmix mode switching cost value of the current frame is the channel combination ratio factor of the current frame, and the fifteenth mode switching condition is that the channel combination ratio factor of the current frame is less than or equal to a channel combination ratio factor threshold S4, or if the downmix mode of the previous frame is the downmix mode D, the channel combination scheme for the current frame is the anticorrelated signal channel combination scheme, and the downmix mode switching cost value of the current frame satisfies a sixteenth downmix mode switching condition, determining that a downmix mode of the current frame is the downmix mode C, and the encoding mode of the current frame is the downmix mode D-to-downmix mode C encoding mode, where the downmix mode switching cost value of the current frame is the channel combination ratio factor of the current frame, and the sixteenth mode switching condition is that the channel combination ratio factor of the current frame is greater than or equal to a channel combination ratio factor threshold S4.

When the downmix mode of the current frame is different from the downmix mode of the previous frame, it may be determined that the encoding mode of the current frame may be, for example, a downmix mode switching encoding mode. In this case, segmented time-domain downmix processing may be performed on the left and right channel signals of the current frame based on the downmix mode of the current frame and the downmix mode of the previous frame.

A mechanism of performing segmented time-domain downmix processing on the left and right channel signals of the current frame is introduced when the channel combination scheme for the current frame is different from a channel combination scheme for the previous frame. The segmented time-domain downmix processing mechanism helps implement smooth transition of a channel combination scheme, thereby helping improve encoding quality.

In some possible implementations, the determining a channel combination scheme for a current frame may include determining a near in/out of phase signal type of a stereo signal of the current frame using the left and right channel signals of the current frame, and determining the channel combination scheme for the current frame based on the near in/out of phase signal type of the stereo signal of the current frame and the channel combination scheme for the previous frame. The near in/out of phase signal type of the stereo signal of the current frame may be a near in phase signal or a near out of phase signal. The near in/out of phase signal type of the stereo signal of the current frame may be indicated using a near in/out of phase signal type identifier of the current frame. Further, for example, when a value of the near in/out of phase signal type identifier of the current frame is "1", the near in/out of phase signal type of the stereo signal of the current frame is a near in phase signal, or when a value of the near in/out of phase signal type identifier of the current frame is "0", the near in/out of phase signal type of the stereo signal of the current frame is a near out of phase signal, and vice versa.

A channel combination scheme for an audio frame (for example, the previous frame or the current frame) may be indicated using a channel combination scheme identifier of the audio frame. Further, for example, when a value of the channel combination scheme identifier of the audio frame is "0", the channel combination scheme for the audio frame is a correlated signal channel combination scheme, or when a value of the channel combination scheme identifier of the audio frame is "1", the channel combination scheme for the audio frame is an anticorrelated signal channel combination scheme, and vice versa.

Determining a near in/out of phase signal type of a stereo signal of the current frame using the left and right channel signals of the current frame may include calculating a value xorr of a correlation between the left and right channel signals of the current frame, and when xorr is less than or equal to a first threshold, determining that the near in/out of phase signal type of the stereo signal of the current frame is a near in phase signal, or when xorr is greater than a first threshold, determining that the near in/out of phase signal type of the stereo signal of the current frame is a near out of phase signal. Further, if the near in/out of phase signal type identifier of the current frame is used to indicate the near in/out of phase signal type of the stereo signal of the current frame, when the near in/out of phase signal type of the stereo signal of the current frame is a near in phase signal, the value of the near in/out of phase signal type identifier of the current frame may be set to indicate that the near in/out of phase signal type of the stereo signal of the current frame is a near in phase signal, or when the near in/out of phase signal type of the current frame is a near out of phase signal, the value of the near in/out of phase signal type identifier of the current frame may be set to indicate that the near in/out of phase signal type of the stereo signal of the current frame is a near out of phase signal.

Further, for example, when a value of a near in/out of phase signal type identifier of the audio frame (for example, the previous frame or the current frame) is "0", a near in/out of phase signal type of a stereo signal of the audio frame is a near in phase signal, or when a value of a near in/out of phase signal type identifier of the audio frame (for example, the previous frame or the current frame) is "1", a near in/out of phase signal type of a stereo signal of the audio frame is a near out of phase signal, and so on.

Determining the channel combination scheme for the current frame based on the near in/out of phase signal type of the stereo signal of the current frame and a channel combination scheme for the previous frame, for example, may include when the near in/out of phase signal type of the stereo signal of the current frame is the near in phase signal and the channel combination scheme for the previous frame is the correlated signal channel combination scheme, determining that the channel combination scheme for the current frame is the correlated signal channel combination scheme, or when the near in/out of phase signal type of the stereo signal of the current frame is the near out of phase signal and the channel combination scheme for the previous frame is the anticorrelated signal channel combination scheme, determining that the channel combination scheme for the current frame is the anticorrelated signal channel combination scheme, when the near in/out of phase signal type of the stereo signal of the current frame is the near in phase signal and the channel combination scheme for the previous frame is the anticorrelated signal channel combination scheme, if signal-to-noise ratios of the left and right channel signals of the current frame are both less than a second threshold, determining that the channel combination scheme for the current frame is the correlated signal channel combination scheme, or if the signal-to-noise ratio of the left channel signal and/or the signal-to-noise ratio of the right channel signal of the current frame are/is greater than or equal to the second threshold, determining that the channel combination scheme for the current frame is the anticorrelated signal channel combination scheme, or when the near in/out of phase signal type of the stereo signal of the current frame is the near out of phase signal and the channel combination scheme for the previous frame is the correlated signal channel combination scheme, if the signal-to-noise ratios of the left and right channel signals of the current frame are both less than the second threshold, determining that the channel combination scheme for the current frame is the anticorrelated signal channel combination scheme, or if the signal-to-noise ratio of the left channel signal and/or the signal-to-noise ratio of the right channel signal of the current frame are/is greater than or equal to the second threshold, determining that the channel combination scheme for the current frame is the correlated signal channel combination scheme.

According to a third aspect, an embodiment of this application further provides an audio decoding method, including performing decoding based on a bitstream to obtain decoded primary and secondary channel signals of a current frame, performing decoding based on the bitstream to determine a downmix mode of the current frame, determining an encoding mode of the current frame based on a downmix mode of a previous frame and the downmix mode of the current frame, and performing time-domain upmix processing on the decoded primary and secondary channel signals of the current frame based on the encoding mode of the current frame, to obtain reconstructed left and right channel signals of the current frame.

The channel combination scheme for the current frame is one of a plurality of channel combination schemes. For example, the plurality of channel combination schemes include an anticorrelated signal channel combination scheme and a correlated signal channel combination scheme. The correlated signal channel combination scheme is a channel combination scheme corresponding to a near in phase signal. The anticorrelated signal channel combination scheme is a channel combination scheme corresponding to a near out of phase signal. It can be understood that the channel combination scheme corresponding to a near in phase signal is applicable to a near in phase signal, and the channel combination scheme corresponding to a near out of phase signal is applicable to a near out of phase signal.

It can be understood that time-domain downmix corresponds to time-domain upmix, and encoding corresponds to decoding, therefore, time-domain upmix processing (where an upmix matrix used for time-domain upmix processing corresponds to a downmix matrix used by an encoding apparatus for time-domain downmix) may be performed on the decoded primary and secondary channel signals of the current frame based on the encoding mode of the current frame, to obtain the reconstructed left and right channel signals of the current frame.

In some possible implementations, determining an encoding mode of the current frame based on a downmix mode of a previous frame and the downmix mode of the current frame may include if the downmix mode of the previous frame is a downmix mode A, and the downmix mode of the current frame is the downmix mode A, determining that the encoding mode of the current frame is a downmix mode A-to-downmix mode A encoding mode, if the downmix mode of the previous frame is a downmix mode A, and the downmix mode of the current frame is a downmix mode B, determining that the encoding mode of the current frame is a downmix mode A-to-downmix mode B encoding mode, if the downmix mode of the previous frame is a downmix mode A, and the downmix mode of the current frame is a downmix mode C, determining that the encoding mode of the current frame is a downmix mode A-to-downmix mode C encoding mode, if the downmix mode of the previous frame is a downmix mode B, and the downmix mode of the current frame is the downmix mode B, determining that the encoding mode of the current frame is a downmix mode B-to-downmix mode B encoding mode, if the downmix mode of the previous frame is a downmix mode B, and the downmix mode of the current frame is a downmix mode A, determining that the encoding mode of the current frame is a downmix mode B-to-downmix mode A encoding mode, if the downmix mode of the previous frame is a downmix mode B, and the downmix mode of the current frame is a downmix mode D, determining that the encoding mode of the current frame is a downmix mode B-to-downmix mode D encoding mode, if the downmix mode of the previous frame is a downmix mode C, and the downmix mode of the current frame is the downmix mode C, determining that the encoding mode of the current frame is a downmix mode C-to-downmix mode C encoding mode, if the downmix mode of the previous frame is a downmix mode C, and the downmix mode of the current frame is a downmix mode A, determining that the encoding mode of the current frame is a downmix mode C-to-downmix mode A encoding mode, if the downmix mode of the previous frame is a downmix mode C, and the downmix mode of the current frame is a downmix mode D, determining that the encoding mode of the current frame is a downmix mode C-to-downmix mode D encoding mode, if the downmix mode of the previous frame is a downmix mode D, and the downmix mode of the current frame is the downmix mode D, determining that the encoding mode of the current frame is a downmix mode D-to-downmix mode D encoding mode, if the downmix mode of the previous frame is a downmix mode D, and the downmix mode of the current frame is a downmix mode C, determining that the encoding mode of the current frame is a downmix mode D-to-downmix mode C encoding mode, or if the downmix mode of the previous frame is a downmix mode D, and the downmix mode of the current frame is a downmix mode B, determining that the encoding mode of the current frame is a downmix mode D-to-downmix mode B encoding mode.

It can be understood that in the foregoing decoding solution, the encoding mode of the current frame needs to be determined based on the downmix mode of the previous frame and the downmix mode of the current frame. This indicates that there are a plurality of possible encoding modes of the current frame. In comparison with a conventional solution in which there is only one encoding mode, this helps achieve better compatibility and matching between a plurality of possible encoding modes and downmix modes and a plurality of possible scenarios.

According to a fourth aspect, an embodiment of this application further provides a method for determining an audio encoding mode, including performing decoding based on a bitstream to obtain decoded primary and secondary channel signals of a current frame, performing decoding based on the bitstream to determine a downmix mode of the current frame, and determining an encoding mode of the current frame based on a downmix mode of a previous frame and the downmix mode of the current frame.

The following describes various downmix mode switching cost functions using examples. In actual application, a switching cost function may be constructed in various manners, which are not necessarily limited to the following example forms.

For example, a cost function for downmix mode A-to-downmix mode B switching of the current frame may be as follows:

$$\text{Cost_AB} = \sum_{n=start_sample_A}^{end_sample_A} [(\alpha_{1_pre} - \alpha_1) * X_L(n) + (\alpha_{2_pre} + \alpha_2) * X_R(n)],$$

and $$\alpha_{2_pre} = 1 - \alpha_{1_pre},$$

$$\alpha_2 = 1 - \alpha_1,$$

where Cost_AB represents a value of the cost function for downmix mode A-to-downmix mode B switching, start_sample_A represents a calculation start sampling point of the cost function for downmix mode A-to-downmix mode B switching, end_sample_A represents a calculation end sampling point of the cost function for downmix mode A-to-downmix mode B switching, start_sample_A is an integer greater than 0 and less than N−1, end_sample_A is an integer greater than 0 and less than N−1, and start_sample_A is less than end_sample_A, where for example, a value range of end_sample_A-start_sample_A may be [60, 200], and for example, end_sample_A-start_sample_A is equal to 60, 69, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio_SM, where ratio_SM represents a channel combination ratio factor corresponding to the anticorrelated signal channel combination scheme for the current frame, and $\alpha_{1_pre}$=tdm_last_ratio, where tdm_last_ratio represents a channel combination ratio factor corresponding to the anticorrelated signal channel combination scheme for the previous frame.

For another example, a cost function for downmix mode A-to-downmix mode C switching of the current frame may be as follows:

$$\text{Cost_AC} = \sum_{n=start_sample_A}^{end_sample_A} [(\alpha_{1_pre} - \alpha_1) * X_L(n) + (\alpha_{2_pre} - \alpha_2) * X_R(n)],$$

and $$\alpha_{2_pre} = 1 - \alpha_{1_pre},$$

$$\alpha_2 = 1 - \alpha_1,$$

where Cost_AC represents a value of the cost function for downmix mode A-to-downmix mode C switching, start_sample_A represents a calculation start sampling point of the cost function for downmix mode A-to-downmix mode C switching, end_sample_A represents a calculation end sampling point of the cost function for downmix mode A-to-downmix mode C switching, start_sample_A is an integer greater than 0 and less than N−1, end_sample_A is an integer greater than 0 and less than N−1, and start_sample_A is less than end_sample_A, n represents a sequence number of a sampling point, and N represents a frame length, $X_L(n)$ represents the left channel signal of the current frame, and $X_R(n)$ represents the right channel signal of the current frame, $\alpha_1$=ratio_SM, where ratio_SM represents a channel combination ratio factor corresponding to the anticorrelated signal channel combination scheme for the current frame, and $\alpha_{1_pre}$=tdm_last_ratio, where tdm_last_ratio represents a channel combination ratio factor corresponding to the anticorrelated signal channel combination scheme for the previous frame.

For another example, a cost function for downmix mode B-to-downmix mode A switching of the current frame is as follows:

$$\text{Cost_BA} = \sum_{n=start_sample_B}^{end_sample_B} [(\alpha_{1_pre} - \alpha_1) * X_L(n) - (\alpha_{2_pre} + \alpha_2) * X_R(n)],$$

and $$\alpha_{2_pre} = 1 - \alpha_{1_pre},$$

$$\alpha_2 = 1 - \alpha_1,$$

where Cost_BA represents a value of the cost function for downmix mode B-to-downmix mode A switching, start_sample_B represents a calculation start sampling point of the cost function for downmix mode B-to-downmix mode A switching, end_sample_B represents a calculation end sampling point of the cost function for downmix mode B-to-downmix mode A switching, start_sample_B is an integer greater than 0 and less than N−1, end_sample_B is an integer greater than 0 and less than N−1, and start_sample_B is less than end_sample_B, where for example, a value range of end_sample_B-start_sample_B may be [60, 200], and for example, end_sample_B-start_sample_B is equal to 60, 67, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio, where ratio represents a channel combination ratio factor corresponding to the correlated signal channel combination scheme for the current frame, and $\alpha_{1_pre}$=tdm_last_ratio_SM, where tdm_last_ratio_SM represents a channel combination ratio factor corresponding to the anticorrelated signal channel combination scheme for the previous frame.

For another example, a cost function for downmix mode B-to-downmix mode D switching of the current frame may be as follows:

$$\text{Cost_BD} = \sum_{n=start_sample_B}^{end_sample_B} [(\alpha_{1_pre} + \alpha_1) * X_L(n) - (\alpha_{2_pre} - \alpha_2) * X_R(n)],$$

and $$\alpha_{2_pre} = 1 - \alpha_{1_pre},$$

$$\alpha_2 = 1 - \alpha_1,$$

where Cost_BD represents a value of the cost function for downmix mode B-to-downmix mode D switching, start_sample_B represents a calculation start sampling point of the cost function for downmix mode B-to-downmix mode D switching, end_sample_B represents a calculation end sampling point of the cost function for downmix mode B-to-downmix mode D switching, start_sample_B is an integer greater than 0 and less than N−1, end_sample_B is an integer greater than 0 and less than N−1, and start_sample_B is less than end_sample_B, where for example, a value range of end_sample_B-start_sample_B may be [60, 200], and for example, end_sample_B-start_sample_B is equal to 60, 67, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio, where ratio represents a channel combination ratio factor corresponding to the correlated signal channel combination scheme for the current frame, and $\alpha_{1_pre}$=tdm_last_ratio_SM, where tdm_last_ratio_SM represents a channel combination ratio factor corresponding to the anticorrelated signal channel combination scheme for the previous frame.

For another example, a cost function for downmix mode C-to-downmix mode D switching of the current frame may be as follows:

$$\text{Cost_CD} = \sum_{n=start_sample_C}^{end_sample_C} [-(\alpha_{1_pre} - \alpha_1) * X_L(n) + (\alpha_{2_pre} + \alpha_2) * X_R(n)],$$

and $$\alpha_{2_pre} = 1 - \alpha_{1_pre},$$

$$\alpha_2 = 1 - \alpha_1,$$

where Cost_CD represents a value of the cost function for downmix mode C-to-downmix mode D switching, start_sample_C represents a calculation start sampling point of the cost function for downmix mode C-to-downmix mode D switching, end_sample_C represents a calculation end sampling point of the cost function for downmix mode C-to-downmix mode D switching, start_sample_C is an integer greater than 0 and less than N−1, end_sample_C is an integer greater than 0 and less than N−1, and start_sample_C is less than end_sample_C, where for example, a value range of end_sample_C-start_sample_C may be [60, 200], and for example, end_sample_C-start_sample_C is equal to 60, 71, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio, where ratio represents a channel combination ratio factor corresponding to the correlated signal channel combination scheme for the current frame, and $\alpha_{1_pre}$=tdm_last_ratio_SM, where tdm_last_ratio_SM represents a channel combination ratio factor corresponding to the anticorrelated signal channel combination scheme for the previous frame.

For another example, a cost function for downmix mode C-to-downmix mode A switching of the current frame may be as follows:

$$\text{Cost_CA} = \sum_{n=start_sample_C}^{end_sample_C} [-(\alpha_{1_pre} + \alpha_1) * X_L(n) + (\alpha_{2_pre} - \alpha_2) * X_R(n)],$$

and $$\alpha_{2_pre} = 1 - \alpha_{1_pre},$$

$$\alpha_2 = 1 - \alpha_1,$$

where Cost_CA represents a value of the cost function for downmix mode C-to-downmix mode A switching, start_sample_C represents a calculation start sampling point of the cost function for downmix mode C-to-downmix mode A switching, end_sample_C represents a calculation end sampling point of the cost function for downmix mode C-to-downmix mode A switching, start_sample_C is an integer greater than 0 and less than N−1, end_sample_C is an integer greater than 0 and less than N−1, and start_sample_C is less than end_sample_C, where for example, a value range of end_sample_C-start_sample_C may be [60, 200], and for example, end_sample_C-start_sample_C is equal to 60, 71, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio, where ratio represents a channel combination ratio factor corresponding to the correlated signal channel combination scheme for the current frame, and $\alpha_{1_pre}$=tdm_last_ratio_SM, where tdm_last_ratio_SM represents a channel combination ratio factor corresponding to the anticorrelated signal channel combination scheme for the previous frame.

For another example, a cost function for downmix mode D-to-downmix mode C switching of the current frame may be as follows:

$$\text{Cost_DC} = \sum_{n=start_sample_D}^{end_sample_D} [-(\alpha_{1_pre} - \alpha_1) * X_L(n) - (\alpha_{2_pre} + \alpha_2) * X_R(n)],$$

and $$\alpha_{2_pre} = 1 - \alpha_{1_pre},$$

$$\alpha_2 = 1 - \alpha_1,$$

where Cost_DC represents a value of the cost function for downmix mode D-to-downmix mode C switching, start_sample_D represents a calculation start sampling point of the cost function for downmix mode D-to-downmix mode C switching, end_sample_D represents a calculation end sampling point of the cost function for downmix mode D-to-downmix mode C switching, start_sample_D is an integer greater than 0 and less than N−1, end_sample_D is an integer greater than 0 and less than N−1, and start_sample_D is less than end_sample_D, where for example, a value range of end_sample_D-start_sample_D may be [60, 200], and for example, end_sample_D-start_sample_D is equal to 60, 73, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio_SM, where ratio_SM represents a channel combination ratio factor corresponding to the anticorrelated signal channel combination scheme for the current frame, and $\alpha_{1_pre}$=tdm_last_ratio, where tdm_last_ratio represents a channel combination ratio factor corresponding to the anticorrelated signal channel combination scheme for the previous frame.

For another example, a cost function for downmix mode D-to-downmix mode B switching of the current frame is as follows:

$$\text{Cost_DB} = \sum_{n=start_sample_D}^{end_sample_D} [-(\alpha_{1_pre} + \alpha_1) * X_L(n) - (\alpha_{2_pre} + \alpha_2) * X_R(n)],$$

and $$\alpha_{2_pre} = 1 - \alpha_{1_pre},$$

$$\alpha_2 = 1 - \alpha_1,$$

where Cost_DB represents a value of the cost function for downmix mode D-to-downmix mode B switching, start_sample_D represents a calculation start sampling point of the cost function for downmix mode D-to-downmix mode B switching, end_sample_D represents a calculation end sampling point of the cost function for downmix mode D-to-downmix mode B switching, start_sample_D is an integer greater than 0 and less than N−1, end_sample_D is an integer greater than 0 and less than N−1, and start_sample_D is less than end_sample_D, where for example, a value range of end_sample_D-start_sample_D may be [60, 200], and for example, end_sample_D-start_sample_D is equal to 60, 73, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio_SM, where ratio_SM represents a channel combination ratio factor corresponding to the anticorrelated signal channel combination scheme for the current frame, and $\alpha_{1_pre}$=tdm_last_ratio, where tdm_last_ratio represents a channel combination ratio factor corresponding to the anticorrelated signal channel combination scheme for the previous frame.

The following describes, using examples, some downmix matrices and upmix matrices that correspond to different downmix modes of the current frame.

For example, $M_{2A}$ represents a downmix matrix corresponding to a downmix mode A of the current frame, and $M_{2A}$ is constructed based on a channel combination ratio factor corresponding to the correlated signal channel combination scheme for the current frame. In this case, for example:

$$M_{2A} = \begin{bmatrix} 0.5 & 0.5 \\ 0.5 & -0.5 \end{bmatrix}, \text{ or}$$

$$M_{2A} = \begin{bmatrix} \text{ratio} & 1-\text{ratio} \\ 1-\text{ratio} & -\text{ratio} \end{bmatrix},$$

where ratio represents a channel combination ratio factor corresponding to the correlated signal channel combination scheme for the current frame.

Correspondingly, $\hat{M}_{2A}$ represents an upmix matrix corresponding to the downmix matrix $M_{2A}$ corresponding to the downmix mode A of the current frame, and $\hat{M}_{2A}$ is constructed based on the channel combination ratio factor corresponding to the correlated signal channel combination scheme for the current frame. For example:

$$\hat{M}_{2A} = \begin{bmatrix} 1 & 1 \\ 1 & -1 \end{bmatrix}, \text{ or}$$

$$\hat{M}_{2A} = \frac{1}{\text{ratio}^2 + (1-\text{ratio})^2} * \begin{bmatrix} \text{ratio} & 1-\text{ratio} \\ 1-\text{ratio} & -\text{ratio} \end{bmatrix}.$$

For example, $M_{2B}$ represents a downmix matrix corresponding to a downmix mode B of the current frame, and $M_{2B}$ is constructed based on a channel combination ratio factor corresponding to the anticorrelated signal channel combination scheme for the current frame. For example:

$$M_{2B} = \begin{bmatrix} \alpha_1 & -\alpha_2 \\ -\alpha_2 & -\alpha_1 \end{bmatrix}, \text{ or}$$

$$M_{2B} = \begin{bmatrix} 0.5 & -0.5 \\ -0.5 & -0.5 \end{bmatrix},$$

where $\alpha_1$=ratio_SM, $\alpha_2$=1−ratio_SM, and ratio_SM represents the channel combination ratio factor corresponding to the anticorrelated signal channel combination scheme for the current frame.

Correspondingly, $\hat{M}_{2B}$ represents an upmix matrix corresponding to the downmix matrix $M_{2B}$ corresponding to the downmix mode B of the current frame, and $\hat{M}_{2B}$ is constructed based on the channel combination ratio factor corresponding to the anticorrelated signal channel combination scheme for the current frame. For example:

$$\hat{M}_{2B} = \begin{bmatrix} 1 & -1 \\ -1 & -1 \end{bmatrix}, \text{ or}$$

$$\hat{M}_{2B} = \frac{1}{\alpha_1^2 + \alpha_2^2} * \begin{bmatrix} \alpha_1 & -\alpha_2 \\ -\alpha_2 & -\alpha_1 \end{bmatrix},$$

where $\alpha_1$=ratio_SM, $\alpha_2$=1−ratio_SM, and ratio_SM represents the channel combination ratio factor corresponding to the anticorrelated signal channel combination scheme for the current frame.

For example, $M_{2C}$ represents a downmix matrix corresponding to a downmix mode C of the current frame, and $M_{2C}$ is constructed based on a channel combination ratio factor corresponding to the anticorrelated signal channel combination scheme for the current frame. For example:

$$M_{2C} = \begin{bmatrix} -\alpha_1 & \alpha_2 \\ \alpha_2 & \alpha_1 \end{bmatrix}, \text{ or}$$

$$M_{2C} = \begin{bmatrix} -0.5 & 0.5 \\ 0.5 & 0.5 \end{bmatrix},$$

where $\alpha_1$=ratio_SM, $\alpha_2$=1−ratio_SM, and ratio_SM represents the channel combination ratio factor corresponding to the anticorrelated signal channel combination scheme for the current frame.

Correspondingly, $\hat{M}_{2C}$ represents an upmix matrix corresponding to the downmix matrix $M_{2C}$ corresponding to the downmix mode C of the current frame, and $\hat{M}_{2C}$ is constructed based on the channel combination ratio factor corresponding to the anticorrelated signal channel combination scheme for the current frame. For example:

$$\hat{M}_{2C} = \begin{bmatrix} -1 & 1 \\ 1 & 1 \end{bmatrix}, \text{ or}$$

$$\hat{M}_{2C} = \frac{1}{\alpha_1^2 + \alpha_2^2} * \begin{bmatrix} -\alpha_1 & \alpha_2 \\ \alpha_2 & \alpha_1 \end{bmatrix},$$

where $\alpha_1$=ratio_SM, $\alpha_2$=1−ratio_SM, and ratio_SM represents the channel combination ratio factor corresponding to the anticorrelated signal channel combination scheme for the current frame.

For example, $M_{2D}$ represents a downmix matrix corresponding to a downmix mode D of the current frame, and $M_{2D}$ is constructed based on a channel combination ratio factor corresponding to the correlated signal channel combination scheme for the current frame. For example:

$$M_{2D} = \begin{bmatrix} -\alpha_1 & -\alpha_2 \\ -\alpha_2 & \alpha_1 \end{bmatrix}, \text{ or}$$

$$M_{2D} = \begin{bmatrix} -0.5 & -0.5 \\ -0.5 & 0.5 \end{bmatrix},$$

where $\alpha_1$=ratio, $\alpha_2$=1−ratio, and ratio represents the channel combination ratio factor corresponding to the correlated signal channel combination scheme for the current frame.

Correspondingly, $\hat{M}_{2D}$ represents an upmix matrix corresponding to the downmix matrix $M_{2D}$ corresponding to the downmix mode D of the current frame, and $\hat{M}_{2D}$ is constructed based on the channel combination ratio factor corresponding to the correlated signal channel combination scheme for the current frame. For example:

$$\hat{M}_{2D} = \begin{bmatrix} -1 & -1 \\ -1 & 1 \end{bmatrix}, \text{ or}$$

$$\hat{M}_{2D} = \frac{1}{\alpha_1^2 + \alpha_2^2} * \begin{bmatrix} -\alpha_1 & -\alpha_2 \\ -\alpha_2 & \alpha_1 \end{bmatrix},$$

where $\alpha_1$=ratio, $\alpha_2$=1−ratio, and ratio represents the channel combination ratio factor corresponding to the correlated signal channel combination scheme for the current frame.

The following describes some downmix matrices and upmix matrices for the previous frame using examples.

For example, $M_{1A}$ represents a downmix matrix corresponding to a downmix mode A of the previous frame, and $M_{1A}$ is constructed based on the channel combination ratio factor corresponding to the correlated signal channel combination scheme for the previous frame. In this case, for example:

$$M_{1A} = \begin{bmatrix} 0.5 & 0.5 \\ 0.5 & -0.5 \end{bmatrix}, \text{ or}$$

$$M_{1A} = \begin{bmatrix} \alpha_{1_pre} & 1 - \alpha_{1_pre} \\ 1 - \alpha_{1_pre} & -\alpha_{1_pre} \end{bmatrix},$$

where $\alpha_{1_pre}$=tdm_last_ratio, and tdm_last_ratio represents a channel combination ratio factor corresponding to the anticorrelated signal channel combination scheme for the previous frame.

Correspondingly, $\hat{M}_{1A}$ represents an upmix matrix corresponding to the downmix matrix $M_{1A}$ corresponding to the downmix mode A of the previous frame ($\hat{M}_{1A}$ is referred to as an upmix matrix corresponding to the downmix mode A of the previous frame), and $\hat{M}_{1A}$ is constructed based on the channel combination ratio factor corresponding to the correlated signal channel combination scheme for the previous frame. For example:

$$\hat{M}_{1A} = \begin{bmatrix} 1 & 1 \\ 1 & -1 \end{bmatrix}, \text{ or}$$

$$\hat{M}_{1A} = \frac{1}{\alpha_{1_pre}^2 + (1 - \alpha_{1_pre})^2} * \begin{bmatrix} \alpha_{1_pre} & 1 - \alpha_{1_pre} \\ 1 - \alpha_{1_pre} & -\alpha_{1_pre} \end{bmatrix},$$

where $\alpha_{1_pre}$=tdm_last_ratio, and tdm_last_ratio represents the channel combination ratio factor corresponding to the anticorrelated signal channel combination scheme for the previous frame.

For example, $M_{1B}$ represents a downmix matrix corresponding to a downmix mode B of the previous frame, and $M_{1B}$ is constructed based on the channel combination ratio factor corresponding to the anticorrelated signal channel combination scheme for the previous frame. For example:

$$M_{1B} = \begin{bmatrix} \alpha_{1_pre} & -\alpha_{2_pre} \\ -\alpha_{2_pre} & -\alpha_{1_pre} \end{bmatrix}, \text{ or}$$

$$M_{1B} = \begin{bmatrix} 0.5 & -0.5 \\ -0.5 & -0.5 \end{bmatrix},$$

where $\alpha_{1_pre}$=tdm_last_ratio_SM, $\alpha_{2_pre}=\alpha_{1_pre}$, and tdm_last_ratio_SM represents the channel combination ratio factor corresponding to the anticorrelated signal channel combination scheme for the previous frame.

Correspondingly, $\hat{M}_{1B}$ represents an upmix matrix corresponding to the downmix matrix $M_{1B}$ corresponding to the downmix mode B of the previous frame, and $\hat{M}_{1B}$ is constructed based on the channel combination ratio factor corresponding to the anticorrelated signal channel combination scheme for the previous frame. For example:

$$\hat{M}_{1B} = \begin{bmatrix} 1 & -1 \\ -1 & -1 \end{bmatrix}, \text{ or}$$

$$\hat{M}_{1A} = \frac{1}{\alpha_{1_pre}^2 + \alpha_{2_pre}^2} * \begin{bmatrix} \alpha_{1_pre} & -\alpha_{2_pre} \\ -\alpha_{2_pre} & -\alpha_{1_pre} \end{bmatrix},$$

where $\alpha_{1_pre}$=tdm_last_ratio_SM, $\alpha_{2_pre}=1-\alpha_{1_pre}$, and tdm_last_ratio_SM represents the channel combination ratio factor corresponding to the anticorrelated signal channel combination scheme for the previous frame.

For example, $M_{1C}$ represents a downmix matrix corresponding to a downmix mode C of the previous frame, and $M_{1C}$ is constructed based on the channel combination ratio factor corresponding to the anticorrelated signal channel combination scheme for the previous frame. For example:

$$M_{1C} = \begin{bmatrix} -\alpha_{1_pre} & \alpha_{2_pre} \\ \alpha_{2_pre} & \alpha_{1_pre} \end{bmatrix}, \text{ or}$$

$$M_{1C} = \begin{bmatrix} -0.5 & 0.5 \\ 0.5 & 0.5 \end{bmatrix},$$

where $\alpha_{1_pre}$=tdm_last_ratio_SM, $\alpha_{2_pre}=1-\alpha_{1_pre}$, and tdm_last_ratio_SM represents the channel combination ratio factor corresponding to the anticorrelated signal channel combination scheme for the previous frame.

Correspondingly, $\hat{M}_{1C}$ represents an upmix matrix corresponding to the downmix matrix $M_{1C}$ corresponding to the downmix mode C of the previous frame, and $\hat{M}_{1C}$ is constructed based on the channel combination ratio factor corresponding to the anticorrelated signal channel combination scheme for the previous frame. For example:

$$\hat{M}_{1C} = \begin{bmatrix} -1 & 1 \\ 1 & 1 \end{bmatrix}, \text{ or}$$

$$\hat{M}_{1C} = \frac{1}{\alpha_{1_pre}^2 + \alpha_{2_pre}^2} * \begin{bmatrix} -\alpha_{1_pre} & \alpha_{2_pre} \\ \alpha_{2_pre} & \alpha_{1_pre} \end{bmatrix},$$

where $\alpha_{1_pre}$=tdm_last_ratio_SM, $\alpha_{2_pre}=1-\alpha_{1_pre}$, and tdm_last_ratio_SM represents the channel combination ratio factor corresponding to the anticorrelated signal channel combination scheme for the previous frame.

For example, $M_{1D}$ represents a downmix matrix corresponding to a downmix mode D of the previous frame, and $M_{1D}$ is constructed based on the channel combination ratio factor corresponding to the correlated signal channel combination scheme for the previous frame. For example:

$$M_{1D} = \begin{bmatrix} -\alpha_{1_pre} & -\alpha_{2_pre} \\ -\alpha_{2_pre} & \alpha_{1_pre} \end{bmatrix}, \text{ or}$$

$$M_{1D} = \begin{bmatrix} -0.5 & -0.5 \\ -0.5 & 0.5 \end{bmatrix},$$

where $\alpha_{1_pre}$=tdm_last_ratio, $\alpha_{2_pre}=1-\alpha_{1_pre}$, and tdm_last_ratio represents the channel combination ratio factor corresponding to the anticorrelated signal channel combination scheme for the previous frame.

Correspondingly, $\hat{M}_{1D}$ represents an upmix matrix corresponding to the downmix matrix $M_{1D}$ corresponding to the downmix mode D of the previous frame, and $\hat{M}_{1D}$ is constructed based on the channel combination ratio factor corresponding to the correlated signal channel combination scheme for the previous frame. For example:

$$\hat{M}_{1D} = \begin{bmatrix} -1 & -1 \\ -1 & 1 \end{bmatrix}, \text{ or}$$

$$\hat{M}_{1D} = \frac{1}{\alpha_{1_pre}^2 + \alpha_{2_pre}^2} * \begin{bmatrix} -\alpha_{1_pre} & -\alpha_{2_pre} \\ -\alpha_{2_pre} & \alpha_{1_pre} \end{bmatrix},$$

where $\alpha_{1_pre}$=tdm_last_ratio, $\alpha_{2_pre}=1-\alpha_{1_pre}$, and tdm_last_ratio represents the channel combination ratio factor corresponding to the anticorrelated signal channel combination scheme for the previous frame.

It can be understood that the foregoing example forms of downmix matrices and upmix matrices are examples, and certainly, there may also be other forms of downmix matrices and upmix matrices in actual application.

According to a fifth aspect, an embodiment of this application further provides an audio encoding apparatus. The apparatus may include a processor and a memory that are coupled to each other. The memory stores a computer program. The processor invokes the computer program stored in the memory, to perform some or all steps of any audio encoding method in the first aspect, or perform some or all steps of any method for determining an audio encoding mode in the second aspect.

According to a sixth aspect, an embodiment of this application further provides an audio decoding apparatus. The apparatus may include a processor and a memory that are coupled to each other. The memory stores a computer program. The processor invokes the computer program stored in the memory, to perform some or all steps of any audio decoding method in the third aspect, or perform some or all steps of any method for determining an audio encoding mode in the fourth aspect.

According to a seventh aspect, an embodiment of this application provides an audio encoding apparatus, including one or more functional units configured to implement any method in the first aspect or the second aspect.

According to an eighth aspect, an embodiment of this application provides an audio decoding apparatus, including one or more functional units configured to implement any method in the third aspect or the fourth aspect.

According to a ninth aspect, an embodiment of this application provides a computer-readable storage medium. The computer-readable storage medium stores program code, and the program code includes an instruction for performing some or all steps of any method in the first aspect or the second aspect.

According to a tenth aspect, an embodiment of this application provides a computer-readable storage medium. The computer-readable storage medium stores program code, and the program code includes an instruction for performing some or all steps of any method in the third aspect or the fourth aspect.

According to an eleventh aspect, an embodiment of this application provides a computer program product. When the computer program product is run on a computer, the computer is enabled to perform some or all of steps of any method in the first aspect or the second aspect.

According to a twelfth aspect, an embodiment of this application provides a computer program product. When the computer program product is run on a computer, the computer is enabled to perform some or all of steps of any method in the third aspect or the fourth aspect.

BRIEF DESCRIPTION OF DRAWINGS

The following describes the accompanying drawings describing some of the embodiments of this application.

DESCRIPTION OF EMBODIMENTS

Figure 1:
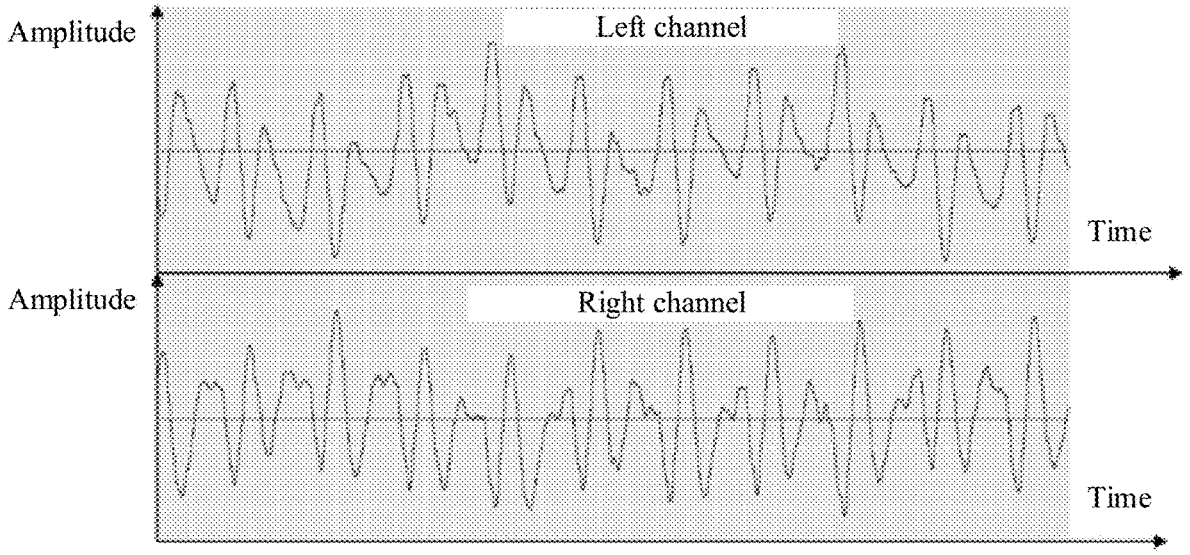
FIG. 1 is a schematic diagram of a near out of phase signal according to an embodiment of this application.

The following describes the embodiments of this application with reference to the accompanying drawings in the embodiments of this application.

The terms "including", "having", or any other variant thereof mentioned in this specification, claims, and the accompanying drawings of this application, are intended to cover a non-exclusive inclusion. For example, a process, a method, a system, a product, or a device that includes a series of steps or units is not limited to the listed steps or units, but optionally further includes an unlisted step or unit, or optionally further includes another inherent step or unit of the process, the method, the product, or the device. In addition, the terms "first", "second", "third", "fourth", and the like are used to distinguish between different objects, but not to describe a particular sequence.

It should be noted that because the solutions in the embodiments of this application are specific to time-domain scenarios, a time-domain signal may be referred to as a "signal" to simplify descriptions. For example, a left channel time-domain signal may be referred to as a "left channel signal". For another example, a right channel time-domain signal may be referred to as a "right channel signal". For another example, a mono time-domain signal may be referred to as a "mono signal". For another example, a reference channel time-domain signal may be referred to as a "reference channel signal". For another example, a primary channel time-domain signal may be referred to as a "primary channel signal", and a secondary channel time-domain signal may be referred to as a "secondary channel signal". For another example, a mid channel time-domain signal may be referred to as a "mid channel signal". For another example, a side channel time-domain signal may be referred to as a "side channel signal". Another case may be deduced by analogy.

It should be noted that in the embodiments of this application, the left channel time-domain signal and the right channel time-domain signal may be jointly referred to as "left and right channel time-domain signals", or may be jointly referred to as "left and right channel signals". In other words, the left and right channel time-domain signals include the left channel time-domain signal and the right channel time-domain signal. For another example, left and right channel time-domain signals of a current frame that are obtained through delay alignment processing include a left channel time-domain signal that is of the current frame and that is obtained through delay alignment processing, and a right channel time-domain signal that is of the current frame and that is obtained through delay alignment processing. Similarly, the primary channel signal and the secondary channel signal may be jointly referred to as "primary and secondary channel signals". In other words, the primary and secondary channel signals include the primary channel signal and the secondary channel signal. For another example, decoded primary and secondary channel signals include a decoded primary channel signal and a decoded secondary channel signal. For another example, reconstructed left and right channel signals include a reconstructed left channel signal and a reconstructed right channel signal. Another case may be deduced by analogy.

For example, in a conventional MS encoding technology, left and right channel signals are first downmixed into a mid channel signal and a side channel signal. For example, L represents the left channel signal, and R represents the right channel signal. In this case, the mid channel signal is $0.5\times(L+R)$, and the mid channel signal represents information about a correlation between left and right channels, the side channel signal is $0.5\times(L-R)$, and the side channel signal represents information about a difference between the left and right channels. Then the mid channel signal and the side channel signal are separately encoded using a mono encoding method. The mid channel signal is usually encoded using more bits, and the side channel signal is usually encoded using fewer bits.

Further, to improve encoding quality, in some solutions, left and right channel time-domain signals are analyzed to extract a time-domain stereo parameter used to indicate a ratio between a left channel and a right channel in time-domain downmix processing. An objective of proposing this method is to improve primary channel energy and reduce secondary channel energy in a time-domain downmixed signal when there is a relatively large energy difference between stereo left and right channel signals.

For example, L represents a left channel signal, and R represents a right channel signal. In this case, a primary channel signal is denoted as Y, where Y=alpha×L+beta×R, and Y represents information about a correlation between two channels, a secondary channel is denoted as X, where X=alpha×L−beta×R, and X represents information about a difference between the two channels, alpha and beta are real numbers between 0 and 1.

FIG. 1 shows cases of amplitude changes of a left channel signal and a right channel signal. At a specific moment in time domain, amplitudes of corresponding sampling points of the left channel signal and the right channel signal have basically same absolute values but opposite signs, this is a typical near out of phase signal. FIG. 1 merely shows a typical example of a near out of phase signal. Actually, a near out of phase signal is a stereo signal with a phase difference between left and right channel signals being close to 180°. For example, a stereo signal with a phase difference between left and right channel signals being within [180−θ, 180+θ] may be referred to as a near out of phase signal. θ may be any angle from 0° to 90°. For example, θ may be equal to an angle such as 0°, 5°, 15°, 17°, 20°, 30°, or 40°.

Similarly, a near in phase signal is a stereo signal with a phase difference between left and right channel signals being close to 0°. For example, a stereo signal with a phase difference between left and right channel signals being within [−θ, θ] may be referred to as a near in phase signal. θ may be any angle from 0° to 90°. For example, θ may be equal to an angle such as 0°, 5°, 15°, 17°, 20°, 30°, or 40°.

When left and right channel signals constitute a near in phase signal, usually, energy of a primary channel signal generated through time-domain downmix processing is greater than energy of a secondary channel signal. If more bits are used to encode the primary channel signal and fewer bits are used to encode the secondary channel signal, this helps achieve a better encoding effect. However, when left and right channel signals constitute a near out of phase signal, if a same time-domain downmix processing method is used, energy of a generated primary channel signal is very small or even absent. This degrades final encoding quality.

The following continues to discuss some technical solutions that help improve stereo encoding/decoding quality.

An audio encoding apparatus and an audio decoding apparatus mentioned in the embodiments of this application each may be an apparatus with functions such as collecting, storing, and transmitting out a voice signal. Further, the audio encoding apparatus and the audio decoding apparatus each may be, for example, a mobile phone, a server, a tablet computer, a personal computer, or a notebook computer.

It can be understood that in the solutions of this application, left and right channel signals are left and right channel signals of a stereo signal. The stereo signal may be an original stereo signal, or may be a stereo signal constituted by two signals that are included in multi-channel signals, or may be an audio stereo signal constituted by two signals that are generated by combining a plurality of signals included in multi-channel signals. An audio encoding method may be alternatively a stereo encoding method used in multi-channel encoding, and the audio encoding apparatus may be alternatively a stereo encoding apparatus used in a multi-channel encoding apparatus. Similarly, an audio decoding method may be alternatively a stereo decoding method used in multi-channel decoding, and the audio decoding apparatus may be alternatively a stereo decoding apparatus used in a multi-channel decoding apparatus. The audio encoding method in the embodiments of this application is, for example, specific to stereo encoding scenarios. The audio decoding method in the embodiments of this application is, for example, specific to stereo decoding scenarios.

The following first provides a method for determining an audio encoding mode. The method may include determining a channel combination scheme for a current frame, determining an encoding mode of the current frame based on a downmix mode of a previous frame and the channel combination scheme for the current frame, performing time-domain downmix processing on left and right channel signals of the current frame based on the encoding mode of the current frame, to obtain primary and secondary channel signals of the current frame, and encoding the obtained primary and secondary channel signals of the current frame.

Figure 2:
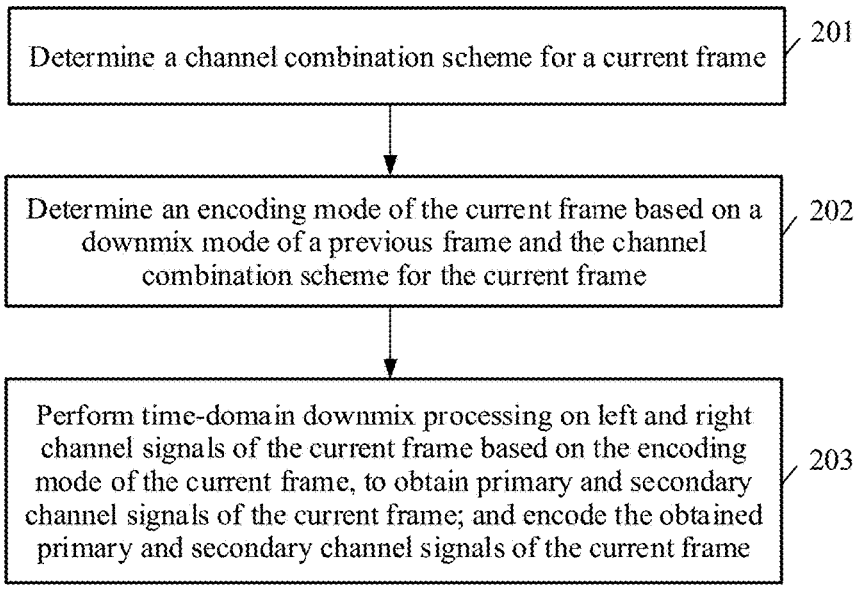
FIG. 2 is a schematic flowchart of an encoding method according to an embodiment of this application.

FIG. 2 is a schematic flowchart of an audio encoding method according to an embodiment of this application. Related steps of the audio encoding method may be implemented by an encoding apparatus. For example, the method may include the following steps.

201. Determine a channel combination scheme for a current frame.

The channel combination scheme for the current frame is one of a plurality of channel combination schemes. For example, the plurality of channel combination schemes may include an anticorrelated signal channel combination scheme and a correlated signal channel combination scheme. The correlated signal channel combination scheme is a channel combination scheme corresponding to a near in phase signal. The anticorrelated signal channel combination scheme is a channel combination scheme corresponding to a near out of phase signal. It can be understood that the channel combination scheme corresponding to a near in phase signal is applicable to a near in phase signal, and the channel combination scheme corresponding to a near out of phase signal is applicable to a near out of phase signal.

202. Determine an encoding mode of the current frame based on a downmix mode of a previous frame and the channel combination scheme for the current frame.

In addition, if the current frame is the first frame (that is, there is no previous frame for the current frame), a downmix mode and the encoding mode of the current frame may be determined based on the channel combination scheme for the current frame. Alternatively, a default downmix mode and encoding mode may be used as a downmix mode and the encoding mode of the current frame.

The downmix mode of the previous frame may be one of the following plurality of downmix modes: a downmix mode A, a downmix mode B, a downmix mode C, and a downmix mode D. The downmix mode A and the downmix mode D are correlated signal downmix modes. The downmix mode B and the downmix mode C are anticorrelated signal downmix modes. The downmix mode A of the previous frame, the downmix mode B of the previous frame, the downmix mode C of the previous frame, and the downmix mode D of the previous frame correspond to different downmix matrices.

The downmix mode of the current frame may be one of the following plurality of downmix modes: the downmix mode A, the downmix mode B, the downmix mode C, and the downmix mode D. The downmix mode A and the downmix mode D are correlated signal downmix modes. The downmix mode B and the downmix mode C are anticorrelated signal downmix modes. The downmix mode A of the current frame, the downmix mode B of the current frame, the downmix mode C of the current frame, and the downmix mode D of the current frame correspond to different downmix matrices.

In some embodiments of this application, "time-domain downmix" is sometimes referred to as "downmix", and "time-domain upmix" is sometimes referred to as "upmix". For example, a "time-domain downmix mode" is referred to as a "downmix mode", a "time-domain downmix matrix" is referred to as a "downmix matrix", a "time-domain upmix mode" is referred to as an "upmix mode", a "time-domain upmix matrix" is referred to as an "upmix matrix", "time-domain upmix processing" is referred to as "upmix processing", "time-domain downmix processing" is referred to as "downmix processing", and so on.

It can be understood that names of objects such as an encoding mode, a decoding mode, a downmix mode, an upmix mode, and a channel combination scheme in the embodiments of this application are examples, and other names may be alternatively used in actual application.

203. Perform time-domain downmix processing on left and right channel signals of the current frame based on the encoding mode of the current frame, to obtain primary and secondary channel signals of the current frame; and encode the obtained primary and secondary channel signals of the current frame.

Time-domain downmix processing may be performed on the left and right channel signals of the current frame to obtain the primary and secondary channel signals of the current frame, and the obtained primary and secondary channel signals of the current frame are further encoded to obtain a bitstream. A channel combination scheme identifier of the current frame (the channel combination scheme identifier of the current frame is used to indicate the channel combination scheme for the current frame) may be further written into the bitstream such that a decoding apparatus determines the channel combination scheme for the current frame based on the channel combination scheme identifier that is of the current frame and that is included in the bitstream. A downmix mode identifier of the current frame (the downmix mode identifier of the current frame is used to indicate the downmix mode of the current frame) may be further written into the bitstream such that the decoding apparatus determines the downmix mode of the current frame based on the downmix mode identifier that is of the current frame and that is included in the bitstream.

Determining an encoding mode of the current frame based on a downmix mode of a previous frame and the channel combination scheme for the current frame may be implemented in various manners.

Further, for example, in some possible implementations, determining an encoding mode of the current frame based on a downmix mode of a previous frame and the channel combination scheme for the current frame may include if the downmix mode of the previous frame is the downmix mode A, and the channel combination scheme for the current frame is the correlated signal channel combination scheme, determining that the downmix mode of the current frame is the downmix mode A, and determining that the encoding mode of the current frame is a downmix mode A-to-downmix mode A encoding mode, if the downmix mode of the previous frame is the downmix mode B, and the channel combination scheme for the current frame is the anticorrelated signal channel combination scheme, determining that the downmix mode of the current frame is the downmix mode B, and determining that the encoding mode of the current frame is a downmix mode B-to-downmix mode B encoding mode, if the downmix mode of the previous frame is the downmix mode C, and the channel combination scheme for the current frame is the anticorrelated signal channel combination scheme, determining that the downmix mode of the current frame is the downmix mode C, and determining that the encoding mode of the current frame is a downmix mode C-to-downmix mode C encoding mode, or if the downmix mode of the previous frame is the downmix mode D, and the channel combination scheme for the current frame is the correlated signal channel combination scheme, determining that the downmix mode of the current frame is the downmix mode D, and determining that the encoding mode of the current frame is a downmix mode D-to-downmix mode D encoding mode.

For another example, in some possible implementations, determining an encoding mode of the current frame based on a downmix mode of a previous frame and the channel combination scheme for the current frame may include determining the encoding mode of the current frame based on the downmix mode of the previous frame, a downmix mode switching cost value of the current frame, and the channel combination scheme for the current frame.

In some possible implementations, the downmix mode switching cost value may represent a downmix mode switching cost. For example, a greater downmix mode switching cost value indicates a greater downmix mode switching cost.

For example, the downmix mode switching cost value of the current frame may be a calculation result calculated based on a downmix mode switching cost function of the current frame (the calculation result is a value of the downmix mode switching cost function). The downmix mode switching cost function may be constructed based on, for example, at least one of the following parameters: at least one time-domain stereo parameter of the current frame (the at least one time-domain stereo parameter of the current frame includes, for example, a channel combination ratio factor of the current frame), at least one time-domain stereo parameter of the previous frame (the at least one time-domain stereo parameter of the previous frame includes, for example, a channel combination ratio factor of the previous frame), and the left and right channel signals of the current frame.

For another example, the downmix mode switching cost value of the current frame may be the channel combination ratio factor of the current frame.

For example, the downmix mode switching cost function may be one of the following switching cost functions: a cost function for downmix mode A-to-downmix mode B switching, a cost function for downmix mode A-to-downmix mode C switching, a cost function for downmix mode D-to-downmix mode B switching, a cost function for downmix mode D-to-downmix mode C switching, a cost function for downmix mode B-to-downmix mode A switching, a cost function for downmix mode B-to-downmix mode D switching, a cost function for downmix mode C-to-downmix mode A switching, and a cost function for downmix mode C-to-downmix mode D switching.

Figure 4:
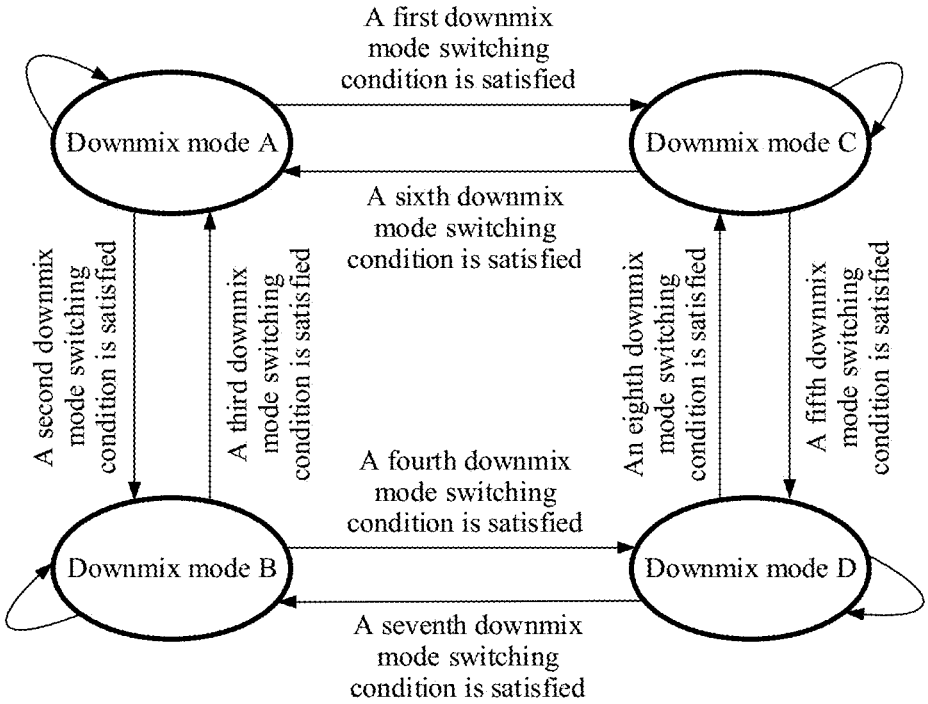
FIG. 4 is a schematic flowchart of downmix mode switching according to an embodiment of this application.

Further, for example, as shown in an example in FIG. 4, in some possible implementations, determining the encoding mode of the current frame based on the downmix mode of the previous frame, a downmix mode switching cost value of the current frame, and the channel combination scheme for the current frame may include if the downmix mode of the previous frame is the downmix mode A, the channel combination scheme for the current frame is the anticorrelated signal channel combination scheme, and the downmix mode switching cost value of the current frame satisfies a first downmix mode switching condition, determining that the downmix mode of the current frame is the downmix mode C, and the encoding mode of the current frame is a downmix mode A-to-downmix mode C encoding mode, where the downmix mode switching cost value is the value of the downmix mode switching cost function, and the first mode switching condition is that a value of the cost function for downmix mode A-to-downmix mode B switching of the current frame is greater than or equal to a value of the cost function for downmix mode A-to-downmix mode C switching, if the downmix mode of the previous frame is the downmix mode A, the channel combination scheme for the current frame is the anticorrelated signal channel combination scheme, and the downmix mode switching cost value of the current frame satisfies a second downmix mode switching condition, determining that the downmix mode of the current frame is the downmix mode B, and the encoding mode of the current frame is a downmix mode A-to-downmix mode B encoding mode, where the downmix mode switching cost value is the value of the downmix mode switching cost function, and the second mode switching condition is that a value of the cost function for downmix mode A-to-downmix mode B switching of the current frame is less than or equal to a value of the cost function for downmix mode A-to-downmix mode C switching, if the downmix mode of the previous frame is the downmix mode B, the channel combination scheme for the current frame is the correlated signal channel combination scheme, and the downmix mode switching cost value of the current frame satisfies a third downmix mode switching condition, determining that the downmix mode of the current frame is the downmix mode A, and the encoding mode of the current frame is a downmix mode B-to-downmix mode A encoding mode, where the downmix mode switching cost value is the value of the downmix mode switching cost function, and the third mode switching condition is that a value of the cost function for downmix mode B-to-downmix mode A switching of the current frame is less than or equal to a value of the cost function for downmix mode B-to-downmix mode D switching, if the downmix mode of the previous frame is the downmix mode B, the channel combination scheme for the current frame is the correlated signal channel combination scheme, and the downmix mode switching cost value of the current frame satisfies a fourth downmix mode switching condition, determining that the downmix mode of the current frame is the downmix mode D, and the encoding mode of the current frame is a downmix mode B-to-downmix mode D encoding mode, where the downmix mode switching cost value is the value of the downmix mode switching cost function, and the fourth mode switching condition is that a value of the cost function for downmix mode B-to-downmix mode A switching of the current frame is greater than or equal to a value of the cost function for downmix mode B-to-downmix mode D switching, if the downmix mode of the previous frame is the downmix mode C, the channel combination scheme for the current frame is the correlated signal channel combination scheme, and the downmix mode switching cost value of the current frame satisfies a fifth downmix mode switching condition, determining that the downmix mode of the current frame is the downmix mode D, and the encoding mode of the current frame is a downmix mode C-to-downmix mode D encoding mode, where the downmix mode switching cost value is the value of the downmix mode switching cost function, and the fifth mode switching condition is that a value of the cost function for downmix mode C-to-downmix mode A switching of the current frame is greater than or equal to a value of the cost function for downmix mode C-to-downmix mode D switching, if the downmix mode of the previous frame is the downmix mode C, the channel combination scheme for the current frame is the correlated signal channel combination scheme, and the downmix mode switching cost value of the current frame satisfies a sixth downmix mode switching condition, determining that the downmix mode of the current frame is the downmix mode A, and the encoding mode of the current frame is a downmix mode C-to-downmix mode A encoding mode, where the downmix mode switching cost value is the value of the downmix mode switching cost function, and the sixth mode switching condition is that a value of the cost function for downmix mode C-to-downmix mode A switching of the current frame is less than or equal to a value of the cost function for downmix mode C-to-downmix mode D switching, if the downmix mode of the previous frame is the downmix mode D, the channel combination scheme for the current frame is the anticorrelated signal channel combination scheme, and the downmix mode switching cost value of the current frame satisfies a seventh downmix mode switching condition, determining that the downmix mode of the current frame is the downmix mode B, and the encoding mode of the current frame is a downmix mode D-to-downmix mode B encoding mode, where the downmix mode switching cost value is the value of the downmix mode switching cost function, and the seventh mode switching condition is that a value of the cost function for downmix mode D-to-downmix mode B switching of the current frame is less than or equal to a value of the cost function for downmix mode D-to-downmix mode C switching, or if the downmix mode of the previous frame is the downmix mode D, the channel combination scheme for the current frame is the anticorrelated signal channel combination scheme, and the downmix mode switching cost value of the current frame satisfies an eighth downmix mode switching condition, determining that the downmix mode of the current frame is the downmix mode C, and the encoding mode of the current frame is a downmix mode D-to-downmix mode C encoding mode, where the downmix mode switching cost value is the value of the downmix mode switching cost function, and the eighth mode switching condition is that a value of the cost function for downmix mode D-to-downmix mode B switching of the current frame is greater than or equal to a value of the cost function for downmix mode D-to-downmix mode C switching.

Figure 5:
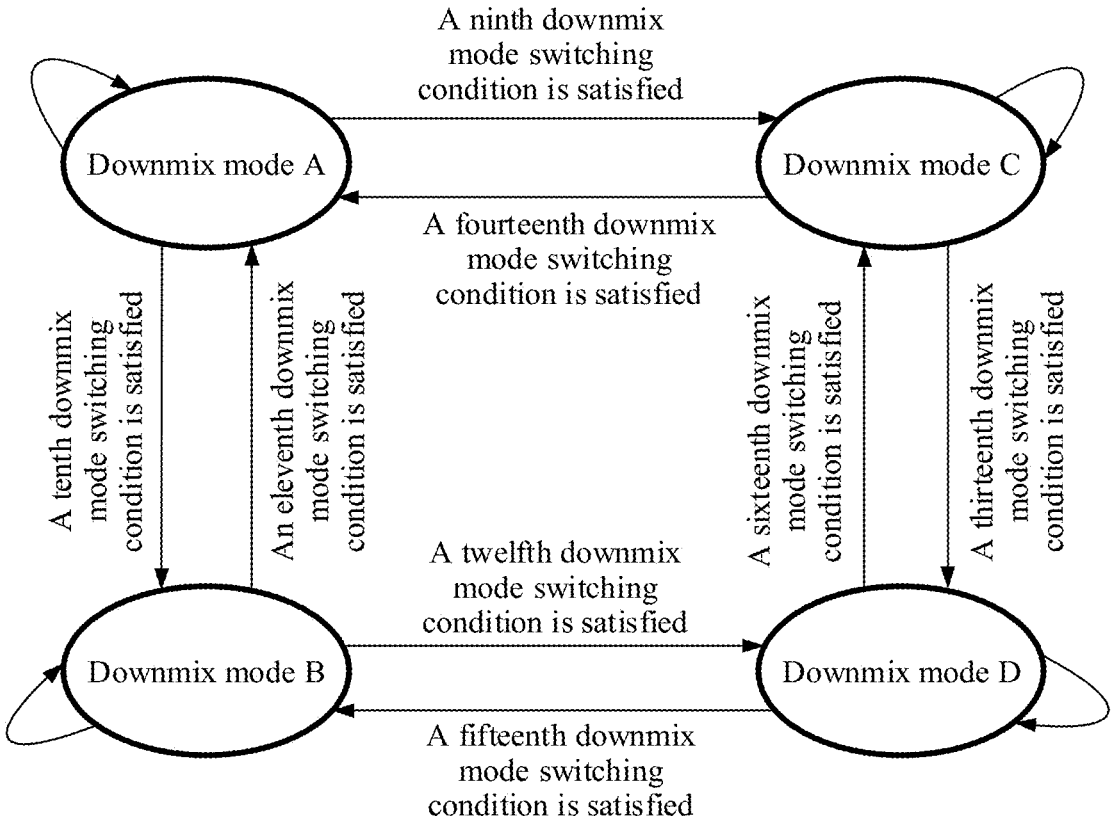
FIG. 5 is a schematic flowchart of another type of downmix mode switching according to an embodiment of this application.

Further, for another example, as shown in an example in FIG. 5, in some possible implementations, determining the encoding mode of the current frame based on the downmix mode of the previous frame, a downmix mode switching cost value of the current frame, and the channel combination scheme for the current frame may include if the downmix mode of the previous frame is the downmix mode A, the channel combination scheme for the current frame is the anticorrelated signal channel combination scheme, and the downmix mode switching cost value of the current frame satisfies a ninth downmix mode switching condition, determining that the downmix mode of the current frame is the downmix mode C, and the encoding mode of the current frame is a downmix mode A-to-downmix mode C encoding mode, where the downmix mode switching cost value of the current frame is the channel combination ratio factor of the current frame, and the ninth mode switching condition is that the channel combination ratio factor of the current frame is less than or equal to a channel combination ratio factor threshold S1, if the downmix mode of the previous frame is the downmix mode A, the channel combination scheme for the current frame is the anticorrelated signal channel combination scheme, and the downmix mode switching cost value of the current frame satisfies a tenth downmix mode switching condition, determining that the downmix mode of the current frame is the downmix mode B, and the encoding mode of the current frame is a downmix mode A-to-downmix mode B encoding mode, where the downmix mode switching cost value of the current frame is the channel combination ratio factor of the current frame, and the tenth mode switching condition is that the channel combination ratio factor of the current frame is greater than or equal to a channel combination ratio factor threshold S1, if the downmix mode of the previous frame is the downmix mode B, the channel combination scheme for the current frame is the correlated signal channel combination scheme, and the downmix mode switching cost value of the current frame satisfies an eleventh downmix mode switching condition, determining that the downmix mode of the current frame is the downmix mode A, and the encoding mode of the current frame is a downmix mode B-to-downmix mode A encoding mode, where the downmix mode switching cost value of the current frame is the channel combination ratio factor of the current frame, and the eleventh mode switching condition is that the channel combination ratio factor of the current frame is greater than or equal to a channel combination ratio factor threshold S2, if the downmix mode of the previous frame is the downmix mode B, the channel combination scheme for the current frame is the correlated signal channel combination scheme, and the downmix mode switching cost value of the current frame satisfies a twelfth downmix mode switching condition, determining that the downmix mode of the current frame is the downmix mode D, and the encoding mode of the current frame is a downmix mode B-to-downmix mode D encoding mode, where the downmix mode switching cost value of the current frame is the channel combination ratio factor of the current frame, and the twelfth mode switching condition is that the channel combination ratio factor of the current frame is less than or equal to a channel combination ratio factor threshold S2, if the downmix mode of the previous frame is the downmix mode C, the channel combination scheme for the current frame is the correlated signal channel combination scheme, and the downmix mode switching cost value of the current frame satisfies a thirteenth downmix mode switching condition, determining that the downmix mode of the current frame is the downmix mode D, and the encoding mode of the current frame is a downmix mode C-to-downmix mode D encoding mode, where the downmix mode switching cost value of the current frame is the channel combination ratio factor of the current frame, and the thirteenth mode switching condition is that the channel combination ratio factor of the current frame is greater than or equal to a channel combination ratio factor threshold S3, if the downmix mode of the previous frame is the downmix mode C, the channel combination scheme for the current frame is the correlated signal channel combination scheme, and the downmix mode switching cost value of the current frame satisfies a fourteenth downmix mode switching condition, determining that the downmix mode of the current frame is the downmix mode A, and the encoding mode of the current frame is a downmix mode C-to-downmix mode A encoding mode, where the downmix mode switching cost value of the current frame is the channel combination ratio factor of the current frame, and the fourteenth mode switching condition is that the channel combination ratio factor of the current frame is less than or equal to a channel combination ratio factor threshold S3, if the downmix mode of the previous frame is the downmix mode D, the channel combination scheme for the current frame is the anticorrelated signal channel combination scheme, and the downmix mode switching cost value of the current frame satisfies a fifteenth downmix mode switching condition, determining that the downmix mode of the current frame is the downmix mode B, and the encoding mode of the current frame is a downmix mode D-to-downmix mode B encoding mode, where the downmix mode switching cost value of the current frame is the channel combination ratio factor of the current frame, and the fifteenth mode switching condition is that the channel combination ratio factor of the current frame is less than or equal to a channel combination ratio factor threshold S4, or if the downmix mode of the previous frame is the downmix mode D, the channel combination scheme for the current frame is the anticorrelated signal channel combination scheme, and the downmix mode switching cost value of the current frame satisfies a sixteenth downmix mode switching condition, determining that the downmix mode of the current frame is the downmix mode C, and the encoding mode of the current frame is a downmix mode D-to-downmix mode C encoding mode, where the downmix mode switching cost value of the current frame is the channel combination ratio factor of the current frame, and the sixteenth mode switching condition is that the channel combination ratio factor of the current frame is greater than or equal to a channel combination ratio factor threshold S4.

A value range of the channel combination ratio factor threshold S1 may be, for example, [0.4, 0.6]. For example, S1 may be equal to 0.4, 0.42, 0.45, 0.5, 0.55, 0.58, 0.6, or another value.

A value range of the channel combination ratio factor threshold S2 may be, for example, [0.4, 0.6]. For example, S2 may be equal to 0.4, 0.42, 0.45, 0.5, 0.55, 0.57, 0.6, or another value.

A value range of the channel combination ratio factor threshold S3 may be, for example, [0.4, 0.6]. For example, S3 may be equal to 0.4, 0.42, 0.45, 0.5, 0.55, 0.59, 0.6, or another value.

A value range of the channel combination ratio factor threshold S4 may be, for example, [0.4, 0.6]. For example, S4 may be equal to 0.4, 0.43, 0.45, 0.5, 0.55, 0.58, 0.6, or another value.

It can be understood that the foregoing example of the value range of the channel combination ratio factor threshold S4 is an example, and the value range may be flexibly set based on switching measurement.

When the downmix mode of the current frame is different from the downmix mode of the previous frame, segmented time-domain downmix processing may be performed on the left and right channel signals of the current frame based on the encoding mode of the current frame. A mechanism of performing segmented time-domain downmix processing on the left and right channel signals of the current frame is introduced when the downmix mode of the current frame is different from the downmix mode of the previous frame. The segmented time-domain downmix processing mechanism helps implement smooth transition of a channel combination scheme, thereby helping improve encoding quality.

It can be understood that in the foregoing encoding solution, the channel combination scheme for the current frame needs to be determined, and the encoding mode of the current frame needs to be determined based on the downmix mode of the previous frame and the channel combination scheme for the current frame. This indicates that there are a plurality of possible channel combination schemes for the current frame, and there are a plurality of possible encoding modes of the current frame. In comparison with a conventional solution in which there is only one channel combination scheme and one encoding mode, this helps achieve better compatibility and matching between a plurality of possible channel combination schemes, a plurality of encoding modes, and a plurality of possible scenarios, thereby helping improve encoding quality.

In addition, because the channel combination scheme corresponding to the near out of phase signal is introduced, when a stereo signal of the current frame is a near out of phase signal, there are a more targeted channel combination scheme and encoding mode, and this helps improve encoding quality.

Further, two different downmix modes are introduced for the correlated signal channel combination scheme and the anticorrelated signal channel combination scheme. Therefore, properly designing corresponding downmix matrices helps implement random switching without a requirement for a switching location.

Correspondingly, the following describes a time-domain stereo decoding scenario using an example.

Figure 3:
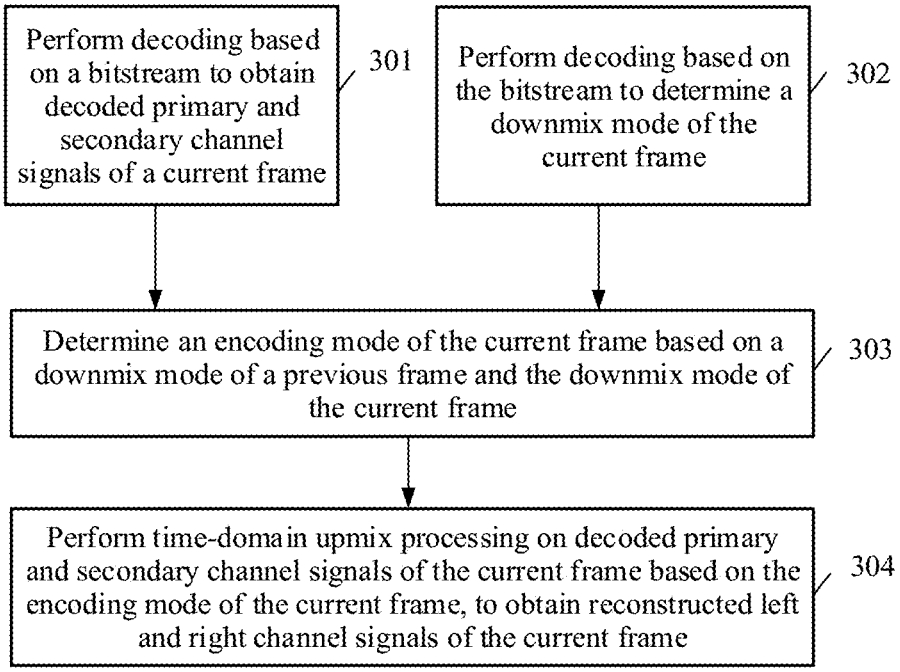
FIG. 3 is a schematic flowchart of a method for determining an audio encoding mode according to an embodiment of this application.

Referring to FIG. 3, the following further provides an audio decoding method. Related steps of the audio decoding method may be implemented by a decoding apparatus. The method may further include the following steps.

301. Perform decoding based on a bitstream to obtain decoded primary and secondary channel signals of a current frame.

302. Perform decoding based on the bitstream to determine a downmix mode of the current frame.

For example, the decoding apparatus writes a downmix mode identifier of the current frame (the downmix mode identifier of the current frame indicates the downmix mode of the current frame) into the bitstream. In this case, decoding may be performed based on the bitstream to obtain the downmix mode identifier of the current frame. Further, the downmix mode of the current frame may be determined based on the downmix mode identifier that is of the current frame and that is obtained through decoding. Certainly, the decoding apparatus may alternatively determine the downmix mode of the current frame in a manner similar to that used by an encoding apparatus, or may determine the downmix mode of the current frame based on other information included in the bitstream.

A downmix mode of a previous frame may be one of the following plurality of downmix modes: a downmix mode A, a downmix mode B, a downmix mode C, and a downmix mode D. The downmix mode A and the downmix mode D are correlated signal downmix modes. The downmix mode B and the downmix mode C are anticorrelated signal downmix modes. The downmix mode A of the previous frame, the downmix mode B of the previous frame, the downmix mode C of the previous frame, and the downmix mode D of the previous frame correspond to different downmix matrices.

The downmix mode of the current frame may be one of the following plurality of downmix modes: the downmix mode A, the downmix mode B, the downmix mode C, and the downmix mode D. The downmix mode A and the downmix mode D are correlated signal downmix modes. The downmix mode B and the downmix mode C are anticorrelated signal downmix modes. The downmix mode A of the current frame, the downmix mode B of the current frame, the downmix mode C of the current frame, and the downmix mode D of the current frame correspond to different downmix matrices.

It can be understood that different downmix matrices correspond to different upmix matrices.

For example, the downmix mode identifier may include, for example, at least two bits. For example, when a value of the downmix mode identifier is "00", it may indicate that the downmix mode of the current frame is the downmix mode A. For example, when a value of the downmix mode identifier is "01", it may indicate that the downmix mode of the current frame is the downmix mode B. For example, when a value of the downmix mode identifier is "10", it may indicate that the downmix mode of the current frame is the downmix mode C. For example, when a value of the downmix mode identifier is "11", it may indicate that the downmix mode of the current frame is the downmix mode D.

It can be understood that because the downmix mode A and the downmix mode D are correlated signal downmix modes, when it is determined, based on the downmix mode identifier that is of the current frame and that is obtained through decoding, that the downmix mode of the current frame is the downmix mode A or the downmix mode D, it may be determined that a channel combination scheme for the current frame is a correlated channel combination scheme.

Similarly, because the downmix mode B and the downmix mode C are anticorrelated signal downmix modes, when it is determined, based on the downmix mode identifier that is of the current frame and that is obtained through decoding, that the downmix mode of the current frame is the downmix mode B or the downmix mode C, it may be determined that a channel combination scheme for the current frame is an anticorrelated channel combination scheme.

303. Determine an encoding mode of the current frame based on the downmix mode of the previous frame and the downmix mode of the current frame.

It is determined, based on the downmix mode of the previous frame and the downmix mode of the current frame, that the encoding mode of the current frame may be a downmix mode switching encoding mode or a downmix mode non-switching encoding mode. Further, downmix mode non-switching encoding modes may include a downmix mode A-to-downmix mode A encoding mode, a downmix mode B-to-downmix mode B encoding mode, a downmix mode C-to-downmix mode C encoding mode, and a downmix mode D-to-downmix mode D encoding mode.

Further, downmix mode switching encoding modes may include a downmix mode A-to-downmix mode B encoding mode, a downmix mode A-to-downmix mode C encoding mode, a downmix mode B-to-downmix mode A encoding mode, a downmix mode B-to-downmix mode D encoding mode, a downmix mode C-to-downmix mode A encoding mode, a downmix mode C-to-downmix mode D encoding mode, a downmix mode D-to-downmix mode B encoding mode, and a downmix mode D-to-downmix mode C encoding mode.

Further, for example, determining an encoding mode of the current frame based on the downmix mode of the previous frame and the downmix mode of the current frame may include if the downmix mode of the previous frame is the downmix mode A, and the downmix mode of the current frame is the downmix mode A, determining that the encoding mode of the current frame is the downmix mode A-to-downmix mode A encoding mode, if the downmix mode of the previous frame is the downmix mode A, and the downmix mode of the current frame is the downmix mode B, determining that the encoding mode of the current frame is the downmix mode A-to-downmix mode B encoding mode, if the downmix mode of the previous frame is the downmix mode A, and the downmix mode of the current frame is the downmix mode C, determining that the encoding mode of the current frame is the downmix mode A-to-downmix mode C encoding mode, if the downmix mode of the previous frame is the downmix mode B, and the downmix mode of the current frame is the downmix mode B, determining that the encoding mode of the current frame is the downmix mode B-to-downmix mode B encoding mode, if the downmix mode of the previous frame is the downmix mode B, and the downmix mode of the current frame is the downmix mode A, determining that the encoding mode of the current frame is the downmix mode B-to-downmix mode A encoding mode, if the downmix mode of the previous frame is the downmix mode B, and the downmix mode of the current frame is the downmix mode D, determining that the encoding mode of the current frame is the downmix mode B-to-downmix mode D encoding mode, if the downmix mode of the previous frame is the downmix mode C, and the downmix mode of the current frame is the downmix mode C, determining that the encoding mode of the current frame is the downmix mode C-to-downmix mode C encoding mode, if the downmix mode of the previous frame is the downmix mode C, and the downmix mode of the current frame is the downmix mode A, determining that the encoding mode of the current frame is the downmix mode C-to-downmix mode A encoding mode, if the downmix mode of the previous frame is the downmix mode C, and the downmix mode of the current frame is the downmix mode D, determining that the encoding mode of the current frame is the downmix mode C-to-downmix mode D encoding mode, if the downmix mode of the previous frame is the downmix mode D, and the downmix mode of the current frame is the downmix mode D, determining that the encoding mode of the current frame is the downmix mode D-to-downmix mode D encoding mode, if the downmix mode of the previous frame is the downmix mode D, and the downmix mode of the current frame is the downmix mode C, determining that the encoding mode of the current frame is the downmix mode D-to-downmix mode C encoding mode, or if the downmix mode of the previous frame is the downmix mode D, and the downmix mode of the current frame is the downmix mode B, determining that the encoding mode of the current frame is the downmix mode D-to-downmix mode B encoding mode.

304. Perform time-domain upmix processing on the decoded primary and secondary channel signals of the current frame based on the encoding mode of the current frame, to obtain reconstructed left and right channel signals of the current frame.

The reconstructed left and right channel signals may be decoded left and right channel signals, or delay adjustment processing and/or time-domain post-processing may be performed on the reconstructed left and right channel signals to obtain decoded left and right channel signals.

It can be understood that a downmix mode corresponds to an upmix mode, and an encoding mode corresponds to a decoding mode.

For example, when the downmix mode of the current frame is different from the downmix mode of the previous frame, segmented time-domain upmix processing may be performed on the decoded primary and secondary channel signals of the current frame based on the encoding mode of the current frame. A mechanism of performing segmented time-domain upmix processing on the decoded primary and secondary channel signals of the current frame is introduced when the downmix mode of the current frame is different from the downmix mode of the previous frame. The segmented time-domain upmix processing mechanism helps implement smooth transition of a channel combination scheme, thereby helping improve encoding quality.

It can be understood that in the foregoing decoding solution, the encoding mode of the current frame needs to be determined based on the downmix mode of the previous frame and the downmix mode of the current frame. This indicates that there are a plurality of possible downmix modes of the previous frame and the current frame, and there are a plurality of possible encoding modes of the current frame. In comparison with a conventional solution in which there is only one downmix mode and one encoding mode, this helps achieve better compatibility and matching between a plurality of possible downmix modes, a plurality of encoding modes, and a plurality of possible scenarios, thereby helping improve encoding quality.

In addition, because the channel combination scheme corresponding to the near out of phase signal is introduced, when a stereo signal of the current frame is a near out of phase signal, there are a more targeted channel combination scheme and encoding mode, and this helps improve encoding quality.

The following describes examples of some specific implementations of determining the channel combination scheme for the current frame by the encoding apparatus. The determining the channel combination scheme for the current frame by the encoding apparatus may be further implemented in various manners.

When the downmix mode of the current frame is different from the downmix mode of the previous frame, it may be determined that the encoding mode of the current frame may be, for example, a downmix mode switching encoding mode. In this case, segmented time-domain downmix processing may be performed on the left and right channel signals of the current frame based on the downmix mode of the current frame and the downmix mode of the previous frame.

A mechanism of performing segmented time-domain downmix processing on the left and right channel signals of the current frame is introduced when the channel combination scheme for the current frame is different from a channel combination scheme for the previous frame. The segmented time-domain downmix processing mechanism helps implement smooth transition of a channel combination scheme, thereby helping improve encoding quality.

In some possible implementations, the determining the channel combination scheme for the current frame may include determining a near in/out of phase signal type of a stereo signal of the current frame using the left and right channel signals of the current frame, and determining the channel combination scheme for the current frame based on the near in/out of phase signal type of the stereo signal of the current frame and the channel combination scheme for the previous frame. The near in/out of phase signal type of the stereo signal of the current frame may be a near in phase signal or a near out of phase signal. The near in/out of phase signal type of the stereo signal of the current frame may be indicated using a near in/out of phase signal type identifier of the current frame. Further, for example, when a value of the near in/out of phase signal type identifier of the current frame is "1", the near in/out of phase signal type of the stereo signal of the current frame is a near in phase signal, or when a value of the near in/out of phase signal type identifier of the current frame is "0", the near in/out of phase signal type of the stereo signal of the current frame is a near out of phase signal, and vice versa.

A channel combination scheme for an audio frame (for example, the previous frame or the current frame) may be indicated using a channel combination scheme identifier of the audio frame. Further, for example, when a value of the channel combination scheme identifier of the audio frame is "0", the channel combination scheme for the audio frame is a correlated signal channel combination scheme, or when a value of the channel combination scheme identifier of the audio frame is "1", the channel combination scheme for the audio frame is an anticorrelated signal channel combination scheme, and vice versa.

Determining a near in/out of phase signal type of a stereo signal of the current frame using the left and right channel signals of the current frame may include calculating a value xorr of a correlation between the left and right channel signals of the current frame, and when xorr is less than or equal to a first threshold, determining that the near in/out of phase signal type of the stereo signal of the current frame is a near in phase signal, when xorr is greater than a first threshold, determining that the near in/out of phase signal type of the stereo signal of the current frame is a near out of phase signal. Further, if the near in/out of phase signal type identifier of the current frame is used to indicate the near in/out of phase signal type of the stereo signal of the current frame, when the near in/out of phase signal type of the stereo signal of the current frame is a near in phase signal, the value of the near in/out of phase signal type identifier of the current frame may be set to indicate that the near in/out of phase signal type of the stereo signal of the current frame is a near in phase signal, or when the near in/out of phase signal type of the current frame is a near out of phase signal, the value of the near in/out of phase signal type identifier of the current frame may be set to indicate that the near in/out of phase signal type of the stereo signal of the current frame is a near out of phase signal.

A value range of the first threshold may be, for example, [0.5, 1.0). For example, the first threshold may be equal to 0.5, 0.85, 0.75, 0.65, or 0.81.

Further, for example, when a value of a near in/out of phase signal type identifier of the audio frame (for example, the previous frame or the current frame) is "0", a near in/out of phase signal type of a stereo signal of the audio frame is a near in phase signal, or when a value of a near in/out of phase signal type identifier of the audio frame (for example, the previous frame or the current frame) is "1", a near in/out of phase signal type of a stereo signal of the audio frame is a near out of phase signal, and so on.

Determining the channel combination scheme for the current frame based on the near in/out of phase signal type of the stereo signal of the current frame and a channel combination scheme for the previous frame, for example, may include when the near in/out of phase signal type of the stereo signal of the current frame is the near in phase signal and the channel combination scheme for the previous frame is the correlated signal channel combination scheme, determining that the channel combination scheme for the current frame is the correlated signal channel combination scheme, or when the near in/out of phase signal type of the stereo signal of the current frame is the near out of phase signal and the channel combination scheme for the previous frame is the anticorrelated signal channel combination scheme, determining that the channel combination scheme for the current frame is the anticorrelated signal channel combination scheme, when the near in/out of phase signal type of the stereo signal of the current frame is the near in phase signal and the channel combination scheme for the previous frame is the anticorrelated signal channel combination scheme, if signal-to-noise ratios of the left and right channel signals of the current frame are both less than a second threshold, determining that the channel combination scheme for the current frame is the correlated signal channel combination scheme, or if the signal-to-noise ratio of the left channel signal and/or the signal-to-noise ratio of the right channel signal of the current frame are/is greater than or equal to the second threshold, determining that the channel combination scheme for the current frame is the anticorrelated signal channel combination scheme, or when the near in/out of phase signal type of the stereo signal of the current frame is the near out of phase signal and the channel combination scheme for the previous frame is the correlated signal channel combination scheme, if the signal-to-noise ratios of the left and right channel signals of the current frame are both less than the second threshold, determining that the channel combination scheme for the current frame is the anticorrelated signal channel combination scheme, or if the signal-to-noise ratio of the left channel signal and/or the signal-to-noise ratio of the right channel signal of the current frame are/is greater than or equal to the second threshold, determining that the channel combination scheme for the current frame is the correlated signal channel combination scheme.

A value range of the second threshold may be, for example, [0.8, 1.2]. For example, the second threshold may be equal to 0.8, 0.85, 0.9, 1, 1.1, or 1.18.

A channel combination scheme identifier of the current frame may be denoted as tdm_SM_flag.

A channel combination scheme identifier of the previous frame may be denoted as tdm_last_SM_flag.

It can be understood that the foregoing examples provide some implementations of determining the channel combination scheme for the current frame, but actual application may be not limited to the foregoing example manners.

The following describes various downmix mode switching cost functions using examples. A downmix mode switching cost function may be one of the following switching cost functions: a cost function for downmix mode A-to-downmix mode B switching, a cost function for downmix mode A-to-downmix mode C switching, a cost function for downmix mode D-to-downmix mode B switching, a cost function for downmix mode D-to-downmix mode C switching, a cost function for downmix mode B-to-downmix mode A switching, a cost function for downmix mode B-to-downmix mode D switching, a cost function for downmix mode C-to-downmix mode A switching, and a cost function for downmix mode C-to-downmix mode D switching. For example, the downmix mode switching cost function may be constructed based on, for example, at least one of the following parameters: at least one time-domain stereo parameter of the current frame (the at least one time-domain stereo parameter of the current frame includes, for example, a channel combination ratio factor of the current frame), at least one time-domain stereo parameter of the previous frame (the at least one time-domain stereo parameter of the previous frame includes, for example, a channel combination ratio factor of the previous frame), and the left and right channel signals of the current frame.

In actual application, a switching cost function may be constructed in various manners. The following provides descriptions using examples.

For example, a cost function for downmix mode A-to-downmix mode B switching of the current frame may be as follows:

$$\text{Cost_AB} = \sum_{n=start_sample_A}^{end_sample_A} [(\alpha_{1_pre} - \alpha_1) * X_L(n) + (\alpha_{2_pre} + \alpha_2) * X_R(n)],$$

$$\alpha_{2_pre} = 1 - \alpha_{1_pre},$$

$$\alpha_2 = 1 - \alpha_1,$$

where Cost_AB represents a value of the cost function for downmix mode A-to-downmix mode B switching, start_sample_A represents a calculation start sampling point of the cost function for downmix mode A-to-downmix mode B switching, end_sample_A represents a calculation end sampling point of the cost function for downmix mode A-to-downmix mode B switching, start_sample_A is an integer greater than 0 and less than N−1, end_sample_A is an integer greater than 0 and less than N−1, and start_sample_A is less than end_sample_A, where for example, a value range of end_sample_A-start_sample_A may be [60, 200], and for example, end_sample_A-start_sample_A is equal to 60, 69, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio_SM, where ratio_SM represents a channel combination ratio factor corresponding to the anticorrelated signal channel combination scheme for the current frame, and $\alpha_{1_pre}$=tdm_last_ratio, where tdm_last_ratio represents a channel combination ratio factor corresponding to the anticorrelated signal channel combination scheme for the previous frame.

For another example, a cost function for downmix mode A-to-downmix mode C switching of the current frame may be as follows:

$$\text{Cost_AC} = \sum_{n=start_sample_A}^{end_sample_A} [(\alpha_{1_pre} + \alpha_1) * X_L(n) + (\alpha_{2_pre} - \alpha_2) * X_R(n)],$$

$$\alpha_{2_pre} = 1 - \alpha_{1_pre},$$

$$\alpha_2 = 1 - \alpha_1,$$

where Cost_AC represents a value of the cost function for downmix mode A-to-downmix mode C switching, start_sample_A represents a calculation start sampling point of the cost function for downmix mode A-to-downmix mode C switching, end_sample_A represents a calculation end sampling point of the cost function for downmix mode A-to-downmix mode C switching, start_sample_A is an integer greater than 0 and less than N−1, end_sample_A is an integer greater than 0 and less than N−1, and start_sample_A is less than end_sample_A, n represents a sequence number of a sampling point, and N represents a frame length, $X_L(n)$ represents the left channel signal of the current frame, and $X_R(n)$ represents the right channel signal of the current frame, $\alpha_1$=ratio_SM, where ratio_SM represents a channel combination ratio factor corresponding to the anticorrelated signal channel combination scheme for the current frame, and $\alpha_{1_pre}$=tdm_last_ratio, where tdm_last_ratio represents a channel combination ratio factor corresponding to the anticorrelated signal channel combination scheme for the previous frame.

For another example, a cost function for downmix mode B-to-downmix mode A switching of the current frame is as follows:

$$\text{Cost_BA} = \sum_{n=start_sample_B}^{end_sample_B} [(\alpha_{1_pre} - \alpha_1) * X_L(n) - (\alpha_{2_pre} + \alpha_2) * X_R(n)],$$

$$\alpha_{2_pre} = 1 - \alpha_{1_pre},$$

$$\alpha_2 = 1 - \alpha_1,$$

where Cost_BA represents a value of the cost function for downmix mode B-to-downmix mode A switching, start_sample_B represents a calculation start sampling point of the cost function for downmix mode B-to-downmix mode A switching, end_sample_B represents a calculation end sampling point of the cost function for downmix mode B-to-downmix mode A switching, start_sample_B is an integer greater than 0 and less than N−1, end_sample_B is an integer greater than 0 and less than N−1, and start_sample_B is less than end_sample_B, where for example, a value range of end_sample_B-start_sample_B may be [60, 200], and for example, end_sample_B-start_sample_B is equal to 60, 67, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio, where ratio represents a channel combination ratio factor corresponding to the correlated signal channel combination scheme for the current frame, and $\alpha_{1_pre}$=tdm_last_ratio_SM, where tdm_last_ratio_SM represents a channel combination ratio factor corresponding to the anticorrelated signal channel combination scheme for the previous frame.

For another example, a cost function for downmix mode B-to-downmix mode D switching of the current frame may be as follows:

$$\text{Cost_BD} = \sum_{n=start_sample_B}^{end_sample_B} [(\alpha_{1_pre} + \alpha_1) * X_L(n) - (\alpha_{2_pre} - \alpha_2) * X_R(n)],$$

$$\alpha_{2_pre} = 1 - \alpha_{1_pre},$$

$$\alpha_2 = 1 - \alpha_1,$$

where Cost_BD represents a value of the cost function for downmix mode B-to-downmix mode D switching, start_sample_B represents a calculation start sampling point of the cost function for downmix mode B-to-downmix mode D switching, end_sample_B represents a calculation end sampling point of the cost function for downmix mode B-to-downmix mode D switching, start_sample_B is an integer greater than 0 and less than N−1, end_sample_B is an integer greater than 0 and less than N−1, and start_sample_B is less than end_sample_B, where for example, a value range of end_sample_B-start_sample_B may be [60, 200], and for example, end_sample_B-start_sample_B is equal to 60, 67, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio, where ratio represents a channel combination ratio factor corresponding to the correlated signal channel combination scheme for the current frame, and $\alpha_{1_pre}$=tdm_last_ratio_SM, where tdm_last_ratio_SM represents a channel combination ratio factor corresponding to the anticorrelated signal channel combination scheme for the previous frame.

For another example, a cost function for downmix mode C-to-downmix mode D switching of the current frame may be as follows:

$$\text{Cost_CD} = \sum_{n=start_sample_C}^{end_sample_C} [-(\alpha_{1_pre} - \alpha_1) * X_L(n) + (\alpha_{2_pre} + \alpha_2) * X_R(n)],$$

$$\alpha_{2_pre} = 1 - \alpha_{1_pre},$$

$$\alpha_2 = 1 - \alpha_1,$$

where Cost_CD represents a value of the cost function for downmix mode C-to-downmix mode D switching, start_sample_C represents a calculation start sampling point of the cost function for downmix mode C-to-downmix mode D switching, end_sample_C represents a calculation end sampling point of the cost function for downmix mode C-to-downmix mode D switching, start_sample_C is an integer greater than 0 and less than N−1, end_sample_C is an integer greater than 0 and less than N−1, and start_sample_C is less than end_sample_C, where for example, a value range of end_sample_C-start_sample_C may be [60, 200], and for example, end_sample_C-start_sample_C is equal to 60, 71, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio, where ratio represents a channel combination ratio factor corresponding to the correlated signal channel combination scheme for the current frame, and $\alpha_{1_pre}$=tdm_last_ratio_SM, where tdm_last_ratio_SM represents a channel combination ratio factor corresponding to the anticorrelated signal channel combination scheme for the previous frame.

For another example, a cost function for downmix mode C-to-downmix mode A switching of the current frame may be as follows:

$$\text{Cost_CA} = \sum_{n=start_sample_C}^{end_sample_C} [-(\alpha_{1_pre} + \alpha_1) * X_L(n) + (\alpha_{2_pre} - \alpha_2) * X_R(n)],$$

$$\alpha_{2_pre} = 1 - \alpha_{1_pre},$$

$$\alpha_2 = 1 - \alpha_1,$$

where Cost_CA represents a value of the cost function for downmix mode C-to-downmix mode A switching, start_sample_C represents a calculation start sampling point of the cost function for downmix mode C-to-downmix mode A switching, end_sample_C represents a calculation end sampling point of the cost function for downmix mode C-to-downmix mode A switching, start_sample_C is an integer greater than 0 and less than N−1, end_sample_C is an integer greater than 0 and less than N−1, and start_sample_C is less than end_sample_C, where for example, a value range of end_sample_C-start_sample_C may be [60, 200], and for example, end_sample_C-start_sample_C is equal to 60, 71, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio, where ratio represents a channel combination ratio factor corresponding to the correlated signal channel combination scheme for the current frame, and $\alpha_{1_pre}$=tdm_last_ratio_SM, where tdm_last_ratio_SM represents a channel combination ratio factor corresponding to the anticorrelated signal channel combination scheme for the previous frame.

For another example, a cost function for downmix mode D-to-downmix mode C switching of the current frame may be as follows:

$$\text{Cost_DC} = \sum_{n=start_sample_D}^{end_sample_D} [-(\alpha_{1_pre} - \alpha_1) * X_L(n) - (\alpha_{2_pre} + \alpha_2) * X_R(n)],$$

$$\alpha_{2_pre} = 1 - \alpha_{1_pre},$$

$$\alpha_2 = 1 - \alpha_1,$$

where Cost_DC represents a value of the cost function for downmix mode D-to-downmix mode C switching, start_sample_D represents a calculation start sampling point of the cost function for downmix mode D-to-downmix mode C switching, end_sample_D represents a calculation end sampling point of the cost function for downmix mode D-to-downmix mode C switching, start_sample_D is an integer greater than 0 and less than N−1, end_sample_D is an integer greater than 0 and less than N−1, and start_sample_D is less than end_sample_D, where for example, a value range of end_sample_D-start_sample_D may be [60, 200], and for example, end_sample_D-start_sample_D is equal to 60, 73, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio_SM, where ratio_SM represents a channel combination ratio factor corresponding to the anticorrelated signal channel combination scheme for the current frame, and $\alpha_{1_pre}$=tdm_last_ratio, where tdm_last_ratio represents a channel combination ratio factor corresponding to the anticorrelated signal channel combination scheme for the previous frame.

For another example, a cost function for downmix mode D-to-downmix mode B switching of the current frame is as follows:

$$\text{Cost_DB} = \sum_{n=start_sample_D}^{end_sample_D} [-(\alpha_{1_pre} + \alpha_1) * X_L(n) - (\alpha_{2_pre} + \alpha_2) * X_R(n)],$$

$$\alpha_{2_pre} = 1 - \alpha_{1_pre},$$

$$\alpha_2 = 1 - \alpha_1,$$

where Cost_DB represents a value of the cost function for downmix mode D-to-downmix mode B switching, start_sample_D represents a calculation start sampling point of the cost function for downmix mode D-to-downmix mode B switching, end_sample_D represents a calculation end sampling point of the cost function for downmix mode D-to-downmix mode B switching, start_sample_D is an integer greater than 0 and less than N−1, end_sample_D is an integer greater than 0 and less than N−1, and start_sample_D is less than end_sample_D, where for example, a value range of end_sample_D-start_sample_D may be [60, 200], and for example, end_sample_D-start_sample_D is equal to 60, 73, 80, 100, 120, 150, 180, 191, 200, or another value, n represents a sequence number of a sampling point, and N represents a frame length, $X_L(n)$ represents the left channel signal of the current frame, and $X_R(n)$ represents the right channel signal of the current frame, $\alpha_1$=ratio_SM, where ratio_SM represents a channel combination ratio factor corresponding to the anticorrelated signal channel combination scheme for the current frame, and $\alpha_{1_pre}$=tdm_last_ratio, where tdm_last_ratio represents a channel combination ratio factor corresponding to the anticorrelated signal channel combination scheme for the previous frame.

The following describes, using examples, some downmix matrices and upmix matrices that correspond to different downmix modes of the current frame.

For example, $M_{2A}$ represents a downmix matrix corresponding to the downmix mode A of the current frame, and $M_{2A}$ is constructed based on a channel combination ratio factor corresponding to the correlated signal channel combination scheme for the current frame. In this case, for example:

$$M_{2A} = \begin{bmatrix} 0.5 & 0.5 \\ 0.5 & -0.5 \end{bmatrix}, \text{ or}$$

$$M_{2A} = \begin{bmatrix} \text{ratio} & 1-\text{ratio} \\ 1-\text{ratio} & -\text{ratio} \end{bmatrix},$$

where ratio represents the channel combination ratio factor corresponding to the correlated signal channel combination scheme for the current frame.

Correspondingly, $\hat{M}_{2A}$ represents an upmix matrix corresponding to the downmix matrix $M_{2A}$ corresponding to the downmix mode A of the current frame, and $\hat{M}_{2A}$ is constructed based on the channel combination ratio factor corresponding to the correlated signal channel combination scheme for the current frame. For example:

$$\hat{M}_{2A} = \begin{bmatrix} 1 & 1 \\ 1 & -1 \end{bmatrix}, \text{ or}$$

$$\hat{M}_{2A} = \frac{1}{\text{ratio}^2 + (1-\text{ratio})^2} * \begin{bmatrix} \text{ratio} & 1-\text{ratio} \\ 1-\text{ratio} & -\text{ratio} \end{bmatrix},$$

For example, $M_{2B}$ represents a downmix matrix corresponding to the downmix mode B of the current frame, and $M_{2B}$ is constructed based on a channel combination ratio factor corresponding to the anticorrelated signal channel combination scheme for the current frame. For example:

$$M_{2B} = \begin{bmatrix} \alpha_1 & -\alpha_2 \\ -\alpha_2 & -\alpha_1 \end{bmatrix}, \text{ or}$$

-continued $$M_{2B} = \begin{bmatrix} 0.5 & -0.5 \\ -0.5 & -0.5 \end{bmatrix},$$

where $\alpha_1$=ratio_SM, $\alpha_2$=1−ratio_SM, and ratio_SM represents the channel combination ratio factor corresponding to the anticorrelated signal channel combination scheme for the current frame.

Correspondingly, $\hat{M}_{2B}$ represents an upmix matrix corresponding to the downmix matrix $M_{2B}$ corresponding to the downmix, mode B of the current frame, and $\hat{M}_{2B}$ is constructed based on the channel combination ratio factor corresponding to the anticorrelated signal channel combination scheme for the current frame. For example:

$$\hat{M}_{2B} = \begin{bmatrix} 1 & -1 \\ -1 & -1 \end{bmatrix}, \text{ or}$$

$$\hat{M}_{2B} = \frac{1}{\alpha_1^2 + \alpha_2^2} * \begin{bmatrix} \alpha_1 & -\alpha_2 \\ -\alpha_2 & -\alpha_1 \end{bmatrix},$$

where $\alpha_1$=ratio_SM, $\alpha_2$=1−ratio_SM, and ratio_SM represents the channel combination ratio factor corresponding to the anticorrelated signal channel combination scheme for the current frame.

For example, $M_{2C}$ represents a downmix matrix corresponding to the downmix mode C of the current frame, and $M_{2C}$ is constructed based on a channel combination ratio factor corresponding to the anticorrelated signal channel combination scheme for the current frame. For example:

$$M_{2C} = \begin{bmatrix} -\alpha_1 & \alpha_2 \\ \alpha_2 & \alpha_1 \end{bmatrix}, \text{ or}$$

$$M_{2C} = \begin{bmatrix} -0.5 & 0.5 \\ 0.5 & 0.5 \end{bmatrix},$$

where $\alpha_1$=ratio_SM, $\alpha_2$=1−ratio_SM, and ratio_SM represents the channel combination ratio factor corresponding to the anticorrelated signal channel combination scheme for the current frame.

Correspondingly, $\hat{M}_{2C}$ represents an upmix matrix corresponding to the downmix matrix $M_{2C}$ corresponding to the downmix mode C of the current frame, and $\hat{M}_{2C}$ is constructed based on the channel combination ratio factor corresponding to the anticorrelated signal channel combination scheme for the current frame. For example:

$$\hat{M}_{2C} = \begin{bmatrix} -1 & 1 \\ 1 & 1 \end{bmatrix}, \text{ or}$$

$$\hat{M}_{2C} = \frac{1}{\alpha_1^2 + \alpha_2^2} * \begin{bmatrix} -\alpha_1 & \alpha_2 \\ \alpha_2 & \alpha_1 \end{bmatrix},$$

where $\alpha_1$=ratio_SM, $\alpha_2$=1−ratio_SM, and ratio_SM represents the channel combination ratio factor corresponding to the anticorrelated signal channel combination scheme for the current frame.

For example, $M_{2D}$ represents a downmix matrix corresponding to the downmix mode D of the current frame, and $M_{2D}$ is constructed based on a channel combination ratio factor corresponding to the correlated signal channel combination scheme for the current frame. For example:

$$M_{2D} = \begin{bmatrix} -\alpha_1 & -\alpha_2 \\ -\alpha_2 & \alpha_1 \end{bmatrix}, \text{ or}$$

$$M_{2D} = \begin{bmatrix} -0.5 & -0.5 \\ -0.5 & 0.5 \end{bmatrix},$$

where $\alpha_1$=ratio_SM, $\alpha_2$=1−ratio_SM, and ratio represents the channel combination ratio factor corresponding to the correlated signal channel combination scheme for the current frame.

Correspondingly, $\hat{M}_{2D}$ represents an upmix matrix corresponding to the downmix matrix $M_{2D}$ corresponding to the downmix mode D of the current frame, and $\hat{M}_{2D}$ is constructed based on the channel combination ratio factor corresponding to the correlated signal channel combination scheme for the current frame. For example:

$$\hat{M}_{2D} = \begin{bmatrix} -1 & -1 \\ -1 & 1 \end{bmatrix}, \text{ or}$$

$$\hat{M}_{2D} = \frac{1}{\alpha_1^2 + \alpha_2^2} * \begin{bmatrix} -\alpha_1 & -\alpha_2 \\ -\alpha_2 & \alpha_1 \end{bmatrix},$$

where $\alpha_1$=ratio, $\alpha_2$=1−ratio, and ratio represents the channel combination ratio factor corresponding to the correlated signal channel combination scheme for the current frame.

The following describes some downmix matrices and upmix matrices for the previous frame using examples.

For example, $M_{1A}$ represents a downmix matrix corresponding to the downmix mode A of the previous frame, and $M_{1A}$ is constructed based on the channel combination ratio factor corresponding to the correlated signal channel combination scheme for the previous frame. In this case, for example:

$$M_{1A} = \begin{bmatrix} 0.5 & 0.5 \\ 0.5 & -0.5 \end{bmatrix}, \text{ or}$$

$$M_{1A} = \begin{bmatrix} \alpha_{1_pre} & 1-\alpha_{1_pre} \\ 1-\alpha_{1_pre} & -\alpha_{1_pre} \end{bmatrix},$$

where $\alpha_{1_pre}$=tdm_last_ratio, tdm_last_ratio represents the channel combination ratio factor corresponding to the anticorrelated signal channel combination scheme for the previous frame.

Correspondingly, $\hat{M}_{1A}$ represents an upmix matrix corresponding to the downmix matrix $M_{1A}$ corresponding to the downmix mode A of the previous frame ($\hat{M}_{1A}$ is referred to as an upmix matrix corresponding to the downmix mode A of the previous frame), and $\hat{M}_{1A}$ is constructed based on the channel combination ratio factor corresponding to the correlated signal channel combination scheme for the previous frame. For example:

$$\hat{M}_{1A} = \begin{bmatrix} 1 & 1 \\ 1 & -1 \end{bmatrix}, \text{ or}$$

$$\hat{M}_{1A} = \frac{1}{\alpha_{1_pre}^2 + (1-\alpha_{1_pre})^2} * \begin{bmatrix} \alpha_{1_pre} & 1-\alpha_{1_pre} \\ 1-\alpha_{1_pre} & -\alpha_{1_pre} \end{bmatrix},$$

where $\alpha_{1_pre}$=tdm_last_ratio, tdm_last_ratio represents the channel combination ratio factor corresponding to the anticorrelated signal channel combination scheme for the previous frame.

For example, $M_{1B}$ represents a downmix matrix corresponding to the downmix mode B of the previous frame, and $M_{1B}$ is constructed based on the channel combination ratio factor corresponding to the anticorrelated signal channel combination scheme for the previous frame. For example:

$$M_{1B} = \begin{bmatrix} \alpha_{1_pre} & -\alpha_{2_pre} \\ -\alpha_{2_pre} & -\alpha_{1_pre} \end{bmatrix}, \text{ or}$$

$$M_{1B} = \begin{bmatrix} 0.5 & -0.5 \\ -0.5 & -0.5 \end{bmatrix},$$

where $\alpha_{1_pre}$=tdm_last_ratio_SM, $\alpha_{2_pre}$=1−$\alpha_{1_pre}$, and tdm_last_ratio_SM represents the channel combination ratio factor corresponding to the anticorrelated signal channel combination scheme for the previous frame.

Correspondingly, $\hat{M}_{1B}$ is represents an upmix matrix corresponding to the downmix matrix $M_{1B}$ corresponding to the downmix mode B of the previous frame, and $\hat{M}_{1B}$ is constructed based on the channel combination ratio factor corresponding to the anticorrelated signal channel combination scheme for the previous frame. For example:

$$\hat{M}_{1B} = \begin{bmatrix} 1 & -1 \\ -1 & -1 \end{bmatrix}, \text{ or}$$

$$\hat{M}_{1B} = \frac{1}{\alpha_{1_pre}^2 + \alpha_{2_pre}^2} * \begin{bmatrix} \alpha_{1_pre} & -\alpha_{2_pre} \\ -\alpha_{2_pre} & -\alpha_{1_pre} \end{bmatrix},$$

where $\alpha_{1_pre}$=tdm_last_ratio_SM, $\alpha_{2_pre}$=1−$\alpha_{1_pre}$, and tdm_last_ratio_SM represents the channel combination ratio factor corresponding to the anticorrelated signal channel combination scheme for the previous frame.

For example, $M_{1C}$ represents a downmix matrix corresponding to the downmix mode C of the previous frame, and $M_{1C}$ is constructed based on the channel combination ratio factor corresponding to the anticorrelated signal channel combination scheme for the previous frame. For example:

$$M_{1C} = \begin{bmatrix} -\alpha_{1_pre} & \alpha_{2_pre} \\ \alpha_{2_pre} & \alpha_{1_pre} \end{bmatrix}, \text{ or}$$

$$M_{1C} = \begin{bmatrix} -0.5 & 0.5 \\ 0.5 & 0.5 \end{bmatrix},$$

where $\alpha_{1_pre}$=tdm_last_ratio_SM, $\alpha_{2_pre}$=1−$\alpha_{1_pre}$, and tdm_last_ratio_SM represents the channel combination ratio factor corresponding to the anticorrelated signal channel combination scheme for the previous frame.

Correspondingly, $\hat{M}_{1C}$ represents an upmix matrix corresponding to the downmix matrix $M_{1C}$ corresponding to the downmix mode C of the previous frame, and $\hat{M}_{1C}$ is constructed based on the channel combination ratio factor corresponding to the anticorrelated signal channel combination scheme for the previous frame. For example:

$$\hat{M}_{1C} = \begin{bmatrix} -1 & 1 \\ 1 & 1 \end{bmatrix}, \text{ or}$$

-continued $$\hat{M}_{1C} = \frac{1}{\alpha_{1_pre}^2 + \alpha_{2_pre}^2} * \begin{bmatrix} -\alpha_{1_pre} & \alpha_{2_pre} \\ \alpha_{2_pre} & \alpha_{1_pre} \end{bmatrix},$$

where $\alpha_{1_pre}$=tdm_last_ratio_SM, $\alpha_{2_pre}=1-\alpha_{1_pre}$, and tdm_last_ratio_SM represents the channel combination ratio factor corresponding to the anticorrelated signal channel combination scheme for the previous frame.

For example, $M_{1D}$ represents a downmix matrix corresponding to the downmix mode D of the previous frame, and $M_{1D}$ is constructed based on the channel combination ratio factor corresponding to the correlated signal channel combination scheme for the previous frame. For example:

$$M_{1D} = \begin{bmatrix} -\alpha_{1_pre} & -\alpha_{2_pre} \\ -\alpha_{2_pre} & \alpha_{1_pre} \end{bmatrix}, \text{ or}$$

$$M_{1B} = \begin{bmatrix} -0.5 & -0.5 \\ -0.5 & 0.5 \end{bmatrix},$$

where $\alpha_{1_pre}$=tdm_last_ratio, $\alpha_{2_pre}=1-\alpha_{1_pre}$, and tdm_last_ratio represents the channel combination ratio factor corresponding to the anticorrelated signal channel combination scheme for the previous frame.

Correspondingly, $\hat{M}_{1D}$ represents an upmix matrix corresponding to the downmix matrix $M_{1D}$ corresponding to the downmix mode D of the previous frame, and $\hat{M}_{1D}$ is constructed based on the channel combination ratio factor corresponding to the correlated signal channel combination scheme for the previous frame. For example:

$$\hat{M}_{1D} = \begin{bmatrix} -1 & -1 \\ -1 & 1 \end{bmatrix}, \text{ or}$$

$$\hat{M}_{1D} = \frac{1}{\alpha_{1_pre}^2 + \alpha_{2_pre}^2} * \begin{bmatrix} -\alpha_{1_pre} & -\alpha_{2_pre} \\ -\alpha_{2_pre} & \alpha_{1_pre} \end{bmatrix},$$

where $\alpha_{1_pre}$=tdm_last_ratio, $\alpha_{2_pre}=1-\alpha_{1_pre}$, and tdm_last_ratio represents the channel combination ratio factor corresponding to the anticorrelated signal channel combination scheme for the previous frame.

It can be understood that the foregoing example forms of downmix matrices and upmix matrices are examples, and certainly, there may also be other forms of downmix matrices and upmix matrices in actual application.

The following further describes different scenarios of encoding modes and corresponding scenarios of decoding modes using examples. It can be understood that different encoding modes usually correspond to different time-domain downmix processing manners, and each encoding mode may also correspond to one or more time-domain downmix processing manners.

The following first describes, using examples, some encoding/decoding cases in which the downmix mode of the current frame is the same as the downmix mode of the previous frame.

First, an encoding scenario and a decoding scenario in a case in which the encoding mode of the current frame is the downmix mode A-to-downmix mode A encoding mode are described using examples.

For example, the encoding mode of the current frame is the downmix mode A-to-downmix mode A encoding mode. In this case, in some possible encoding implementations, when time-domain downmix processing is performed on the left and right channel signals of the current frame based on the encoding mode of the current frame, to obtain primary and secondary channel signals of the current frame:

$$\begin{bmatrix} Y(n) \\ X(n) \end{bmatrix} = M_{2A} * \begin{bmatrix} X_L(n) \\ X_R(n) \end{bmatrix},$$

where $X_L$, (n) represents the left channel signal of the current frame, $X_R$(n) represents the right channel signal of the current frame, Y(n) represents the primary channel signal that is of the current frame and that is obtained through time-domain downmix processing, X(n) represents the secondary channel signal that is of the current frame and that is obtained through time-domain downmix processing, n represents a sequence number of a sampling point, and $M_{2A}$ represents the downmix matrix corresponding to the downmix mode A of the current frame.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\begin{bmatrix} \hat{x}'_L(n) \\ \hat{x}'_R(n) \end{bmatrix} = \hat{M}_{2A} * \begin{bmatrix} \hat{Y}(n) \\ \hat{X}(n) \end{bmatrix},$$

where n represents a sequence number of a sampling point, $\hat{X}_L'$(n) represents the reconstructed left channel signal of the current frame, $\hat{X}_R'$(n) represents the reconstructed right channel signal of the current frame, $\hat{Y}$(n) represents the decoded primary channel signal of the current frame, $\hat{X}$(n) represents the decoded secondary channel signal of the current frame, and $\hat{M}_{2A}$ represents the upmix matrix corresponding to the downmix mode A of the current frame.

For another example, the encoding mode of the current frame is the downmix mode A-to-downmix mode A encoding mode. In this case, in some other possible encoding implementations, when time-domain downmix processing is performed on the left and right channel signals of the current frame based on the encoding mode of the current frame, to obtain primary and secondary channel signals of the current frame:

$$\text{if } 0 \le n < N - \text{delay_com:}$$

$$\begin{bmatrix} Y(n) \\ X(n) \end{bmatrix} = M_{1A} * \begin{bmatrix} X_L(n) \\ X_R(n) \end{bmatrix}, \text{ and}$$

$$\text{if } N - \text{delay_com} \le n < N:$$

$$\begin{bmatrix} Y(n) \\ X(n) \end{bmatrix} = M_{2A} * \begin{bmatrix} X_L(n) \\ X_R(n) \end{bmatrix},$$

where $X_L$(n) represents the left channel signal of the current frame, $X_R$(n) represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1A} * \begin{bmatrix} \hat{Y}(n) \\ \hat{X}(n) \end{bmatrix}, \text{ and}$$

$$\text{if } N - \text{upmixing_delay} \le n < N:$$

$$\begin{bmatrix} \hat{x}'_L(n) \\ \hat{x}'_R(n) \end{bmatrix} = \hat{M}_{2A} * \begin{bmatrix} \hat{Y}(n) \\ \hat{X}(n) \end{bmatrix},$$

where n represents a sequence number of a sampling point, $\hat{X}_L'(n)$ represents the reconstructed left channel signal of the current frame, $\hat{X}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, upmixing_delay represents decoding delay compensation, delay_com represents encoding delay compensation, n represents a sequence number of a sampling point, and N represents a frame length, for example, n=0, 1, . . . , N−1, and $M_{1A}$ represents the downmix matrix corresponding to the downmix mode A of the previous frame, $M_{2A}$ represents the downmix matrix corresponding to the downmix mode A of the current frame, $\hat{M}_{1A}$ represents the upmix matrix corresponding to the downmix mode A of the previous frame, and $\hat{M}_{2A}$ represents the upmix matrix corresponding to the downmix mode A of the current frame.

For another example, the encoding mode of the current frame is the downmix mode A-to-downmix mode A encoding mode. In this case, in some other possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com}:$$

$$\begin{bmatrix} Y(n) \\ X(n) \end{bmatrix} = M_{1A} * \begin{bmatrix} X_L(n) \\ X_R(n) \end{bmatrix},$$

$$\text{if } N - \text{delay_com} \le n < N - \text{delay_com} + \text{NOVA_A}:$$

$$\begin{bmatrix} Y(n) \\ X(n) \end{bmatrix} = \text{fade_out}(n) * M_{1A} * \begin{bmatrix} X_L(n) \\ X_R(n) \end{bmatrix} + \text{fade_in}(n) * M_{2A} * \begin{bmatrix} X_L(n) \\ X_R(n) \end{bmatrix}, \text{ and}$$

$$\text{if } N - \text{delay_com} + \text{NOVA_A} \le n < N:$$

$$\begin{bmatrix} Y(n) \\ X(n) \end{bmatrix} = M_{2A} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_A}},$$

and certainly, fade_in(n) may be alternatively a fade-in factor based on another function relationship of n, and fade_out(n) represents a fade-out factor, for example, $$\text{fade_out}(n) = 1 - \frac{n - (N - \text{delay_com})}{\text{NOVA_A}},$$

and certainly, fade_out(n) may be alternatively a fade-out factor based on another function relationship of n.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1A} * \begin{bmatrix} \hat{Y}(n) \\ \hat{X}(n) \end{bmatrix},$$

$$\text{if } N - \text{upmixing_delay} \le n < N - \text{upmixing_delay} + \text{NOVA_A}:$$

$$\begin{bmatrix} \hat{x}'_L(n) \\ \hat{x}'_R(n) \end{bmatrix} = \text{fade_out}(n) * \hat{M}_{1A} * \begin{bmatrix} \hat{Y}(n) \\ \hat{X}(n) \end{bmatrix} + \text{fade_in}(n) * \hat{M}_{2A} * \begin{bmatrix} \hat{Y}(n) \\ \hat{X}(n) \end{bmatrix}, \text{ and}$$

$$\text{if } N - \text{upmixing_delay} + \text{NOVA_A} \le n < N:$$

$$\begin{bmatrix} \hat{x}'_L(n) \\ \hat{x}'_R(n) \end{bmatrix} = \hat{M}_{2A} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_A}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_A}},$$

and certainly, fade_out(n) may be alternatively a fade-out factor based on another function relationship of n, and NOVA_A represents a transition processing length corresponding to the downmix mode A, and a value of NOVA_A may be set based on a requirement of a specific scenario, for example, NOVA_A may be equal to 3/N, or NOVA_A may be another value less than N.

The following describes scenarios of the downmix mode B-to-downmix mode B encoding mode using examples.

For example, the encoding mode of the current frame is the downmix mode B-to-downmix mode B encoding mode. In this case, in some possible implementations, when time-domain downmix processing is performed on the left and right channel signals of the current frame based on the encoding mode of the current frame, to obtain primary and secondary channel signals of the current frame:

$$\begin{bmatrix} Y(n) \\ X(n) \end{bmatrix} = M_{2B} * \begin{bmatrix} X_L(n) \\ X_R(n) \end{bmatrix},$$

where $X_L(n)$ represents the left channel signal of the current frame, $X_R(n)$ represents the right channel signal of the current frame, Y(n) represents the primary channel signal that is of the current frame and that is obtained through time-domain downmix processing, X(n) represents the secondary channel signal that is of the current frame and that is obtained through time-domain downmix processing, n represents a sequence number of a sampling point, and $M_{2B}$ represents the downmix matrix corresponding to the downmix mode B of the current frame.

For another example, the encoding mode of the current frame is the downmix mode B-to-downmix mode B encoding mode. In this case, in some other possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com:}$$

$$\begin{bmatrix} Y(n) \\ X(n) \end{bmatrix} = M_{1B} * \begin{bmatrix} X_L(n) \\ X_R(n) \end{bmatrix}, \text{ and}$$

$$\text{if } N - \text{delay_com} \le n < N:$$

$$\begin{bmatrix} Y(n) \\ X(n) \end{bmatrix} = M_{2B} * \begin{bmatrix} X_L(n) \\ X_R(n) \end{bmatrix},$$

where $X_L$, (n) represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing, and n represents a sequence number of a sampling point, N represents a frame length, and delay_com represents encoding delay compensation.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1B} * \begin{bmatrix} \hat{Y}(n) \\ \hat{X}(n) \end{bmatrix}, \text{ and}$$

$$\text{if } N - \text{upmixing_delay} \le n < N:$$

$$\begin{bmatrix} \hat{x}'_L(n) \\ \hat{x}'_R(n) \end{bmatrix} = \hat{M}_{2B} * \begin{bmatrix} \hat{Y}(n) \\ \hat{X}(n) \end{bmatrix},$$

where n represents a sequence number of a sampling point, $\hat{X}_L'(n)$ represents the reconstructed left channel signal of the current frame, $\hat{X}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, upmixing_delay represents decoding delay compensation, delay_com represents encoding delay compensation, n represents a sequence number of a sampling point, and N represents a frame length, for example, n=0, 1, . . . , N−1, and $M_{1B}$ represents the downmix matrix corresponding to the downmix mode B of the previous frame, $\hat{M}_{2B}$ represents the downmix matrix corresponding to the downmix mode B of the current frame, $\hat{M}_{2B}$ represents the upmix matrix corresponding to the downmix mode B of the previous frame, and $\hat{M}_{2B}$ represents the upmix matrix corresponding to the downmix mode B of the current frame.

For another example, the encoding mode of the current frame is the downmix mode B-to-downmix mode B encoding mode. In this case, in some other possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com:}$$

$$\begin{bmatrix} Y(n) \\ X(n) \end{bmatrix} = M_{1B} * \begin{bmatrix} X_L(n) \\ X_R(n) \end{bmatrix},$$

$$\text{if } N - \text{delay_com} \le n < N - \text{delay_com} + \text{NOVA_B:}$$

$$\begin{bmatrix} Y(n) \\ X(n) \end{bmatrix} = \text{fade_out}(n) * M_{1B} * \begin{bmatrix} X_L(n) \\ X_R(n) \end{bmatrix} + \text{fade_in}(n) * M_{2B} * \begin{bmatrix} X_L(n) \\ X_R(n) \end{bmatrix}, \text{ and}$$

$$\text{if } N - \text{delay_com} + \text{NOVA_B} \le n < N:$$

$$\begin{bmatrix} Y(n) \\ X(n) \end{bmatrix} = M_{2B} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_B}},$$

and certainly, fade_in(n) may be alternatively a fade-in factor based on another function relationship of n, and fade_out(n) represents a fade-out factor, for example, $$\text{fade_out}(n) = 1 - \frac{n - (N - \text{delay_com})}{\text{NOVA_B}},$$

and certainly, fade_out(n) may be alternatively a fade-out factor based on another function relationship of n.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1B} * \begin{bmatrix} \hat{Y}(n) \\ \hat{X}(n) \end{bmatrix},$$

$$\text{if } N - \text{upmixing_delay} \le n < N - \text{upmixing_delay} + \text{NOVA_B:}$$

$$\begin{bmatrix} \hat{x}'_L(n) \\ \hat{x}'_R(n) \end{bmatrix} = \text{fade_out}(n) * \hat{M}_{1B} * \begin{bmatrix} \hat{Y}(n) \\ \hat{X}(n) \end{bmatrix} + \text{fade_in}(n) * \hat{M}_{2B} * \begin{bmatrix} \hat{Y}(n) \\ \hat{X}(n) \end{bmatrix}, \text{ and}$$

-continued if $N - \text{upmixing_delay} + \text{NOVA_1} \le n < N$:

$$\begin{bmatrix} \hat{x}'_L(n) \\ \hat{x}'_R(n) \end{bmatrix} = \hat{M}_{2B} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_B}},$$

and certainly, fade_in(n) may be alternatively a fade-in factor based on another function relationship of n,fade_out (n) represents a fade-out factor, for example, $$\text{fade_out}(n) = 1 - \frac{n - (N - \text{upmixing_delay})}{\text{NOVA_B}},$$

and certainly, fade_out(n) may be alternatively a fade-out factor based on another function relationship of n, and NOVA_B represents a transition processing length corresponding to the downmix mode B, and a value of NOVA_B may be set based on a requirement of a specific scenario, for example, NOVA_B may be equal to 3/N, or NOVA_B may be another value less than N.

The following describes scenarios of the downmix mode C-to-downmix mode C encoding mode using examples.

For example, the encoding mode of the current frame is the downmix mode C-to-downmix mode C encoding mode. In this case, in some possible implementations, when time-domain downmix processing is performed on the left and right channel signals of the current frame based on the encoding mode of the current frame, to obtain primary and secondary channel signals of the current frame:

$$\begin{bmatrix} Y(n) \\ X(n) \end{bmatrix} = M_{2C} * \begin{bmatrix} X_L(n) \\ X_R(n) \end{bmatrix},$$

where $X_L$, (n) represents the left channel signal of the current frame, $X_R$(n) represents the right channel signal of the current frame, Y(n) represents the primary channel signal that is of the current frame and that is obtained through time-domain downmix processing, X(n) represents the secondary channel signal that is of the current frame and that is obtained through time-domain downmix processing, n represents a sequence number of a sampling point, and $M_{2C}$ represents the downmix matrix corresponding to the downmix mode C of the current frame, Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\begin{bmatrix} \hat{x}'_L(n) \\ \hat{x}'_R(n) \end{bmatrix} = \hat{M}_{2C} * \begin{bmatrix} \hat{Y}(n) \\ \hat{X}(n) \end{bmatrix},$$

where n represents a sequence number of a sampling point, $\hat{X}_L'$(n) represents the reconstructed left channel signal of the current frame, $\hat{X}_R'$(n) represents the reconstructed right channel signal of the current frame, $\hat{Y}$(n) represents the decoded primary channel signal of the current frame, $\hat{X}$(n) represents the decoded secondary channel signal of the current frame, and $\hat{M}_{2C}$ represents the upmix matrix corresponding to the downmix mode C of the current frame.

For another example, the encoding mode of the current frame is the downmix mode C-to-downmix mode C encoding mode. In this case, in some other possible implementations, when time-domain downmix processing is performed on the left and right channel signals of the current frame based on the encoding mode of the current frame, to obtain primary and secondary channel signals of the current frame:

if $0 \le n < N - \text{delay_com}$:

$$\begin{bmatrix} Y(n) \\ X(n) \end{bmatrix} = M_{1C} * \begin{bmatrix} X_L(n) \\ X_R(n) \end{bmatrix}, \text{ and}$$

if $N - \text{delay_com} \le n < N$:

$$\begin{bmatrix} Y(n) \\ X(n) \end{bmatrix} = M_{2C} * \begin{bmatrix} X_L(n) \\ X_R(n) \end{bmatrix},$$

where $X_L$(n) represents the left channel signal of the current frame, $X_R$(n) represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

if $0 \le n < N - \text{upmixing_delay}$ $$\begin{bmatrix} \hat{x}'_L(n) \\ \hat{x}'_R(n) \end{bmatrix} = \hat{M}_{1C} * \begin{bmatrix} \hat{Y}(n) \\ \hat{X}(n) \end{bmatrix}, \text{ and}$$

if $N - \text{upmixing_delay} \le n < N$:

$$\begin{bmatrix} \hat{x}'_L(n) \\ \hat{x}'_R(n) \end{bmatrix} = \hat{M}_{2C} * \begin{bmatrix} \hat{Y}(n) \\ \hat{X}(n) \end{bmatrix},$$

where n represents a sequence number of a sampling point, $\hat{X}_L'$(n) represents the reconstructed left channel signal of the current frame, $\hat{X}_R'$(n) represents the reconstructed right channel signal of the current frame, $\hat{Y}$(n) represents the decoded primary channel signal of the current frame, and $\hat{X}$(n) represents the decoded secondary channel signal of the current frame, upmixing_delay represents decoding delay compensation, delay_com represents encoding delay compensation, n represents a sequence number of a sampling point, and N represents a frame length, for example, n=0, 1, . . . , N−1, and $M_{1C}$ represents the downmix matrix corresponding to the downmix mode C of the previous frame, $M_{2C}$ represents the downmix matrix corresponding to the downmix mode C of the current frame, $\hat{M}_{1C}$ represents the upmix matrix corresponding to the downmix mode C of the previous frame, and $\hat{M}_{2C}$ represents the upmix matrix corresponding to the downmix mode C of the current frame.

For another example, the encoding mode of the current frame is the downmix mode C-to-downmix mode C encoding mode. In this case, in some other possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com}:$$

$$\begin{bmatrix} Y(n) \\ X(n) \end{bmatrix} = M_{1C} * \begin{bmatrix} X_L(n) \\ X_R(n) \end{bmatrix},$$

$$\text{if } N - \text{delay_com} \le n < N - \text{delay_com} + \text{NOVA_C}:$$

$$\begin{bmatrix} Y(n) \\ X(n) \end{bmatrix} = \text{fade_out}(n) * M_{1C} * \begin{bmatrix} X_L(n) \\ X_R(n) \end{bmatrix} + \text{fade_in}(n) * M_{2C} * \begin{bmatrix} X_L(n) \\ X_R(n) \end{bmatrix}, \text{ and}$$

$$\text{if } N - \text{delay_com} + \text{NOVA_C} \le n < N:$$

$$\begin{bmatrix} Y(n) \\ X(n) \end{bmatrix} = M_{2C} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_C}},$$

and certainly, fade_in(n) may be alternatively a fade-in factor based on another function relationship of n, and fade_out(n) represents a fade-out factor, for example, $$\text{fade_out}(n) = 1 - \frac{n - (N - \text{delay_com})}{\text{NOVA_C}},$$

and certainly, fade_out(n) may be alternatively a fade-out factor based on another function relationship of n.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1C} * \begin{bmatrix} \hat{Y}(n) \\ \hat{X}(n) \end{bmatrix},$$

$$\text{if } N - \text{upmixing_delay} \le n < N - \text{upmixing_delay} + \text{NOVA_C}:$$

$$\begin{bmatrix} \hat{x}'_L(n) \\ \hat{x}'_R(n) \end{bmatrix} = \text{fade_out}(n) * \hat{M}_{1C} * \begin{bmatrix} \hat{Y}(n) \\ \hat{X}(n) \end{bmatrix} + \text{fade_in}(n) * \hat{M}_{2C} * \begin{bmatrix} \hat{Y}(n) \\ \hat{X}(n) \end{bmatrix}, \text{ and}$$

$$\text{if } N - \text{upmixing_delay} + \text{NOVA_C} \le n < N:$$

$$\begin{bmatrix} \hat{x}'_L(n) \\ \hat{x}'_R(n) \end{bmatrix} = \hat{M}_{2C} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_C}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_C}},$$

and certainly, fade_out(n) may be alternatively a fade-out factor based on another function relationship of n, and NOVA_C represents a transition processing length corresponding to the downmix mode C, and a value of NOVA_C may be set based on a requirement of a specific scenario, for example, NOVA_C may be equal to 3/N, or NOVA_C may be another value less than N.

The following describes scenarios of the downmix mode D-to-downmix mode D encoding mode using examples.

For example, the encoding mode of the current frame is the downmix mode D-to-downmix mode D encoding mode. In this case, in some possible implementations, when time-domain downmix processing is performed on the left and right channel signals of the current frame based on the encoding mode of the current frame, to obtain primary and secondary channel signals of the current frame:

$$\begin{bmatrix} Y(n) \\ X(n) \end{bmatrix} = M_{2D} * \begin{bmatrix} X_L(n) \\ X_R(n) \end{bmatrix},$$

where $X_L(n)$ represents the left channel signal of the current frame, $X_R(n)$ represents the right channel signal of the current frame, Y(n) represents the primary channel signal that is of the current frame and that is obtained through time-domain downmix processing, X(n) represents the secondary channel signal that is of the current frame and that is obtained through time-domain downmix processing, n represents a sequence number of a sampling point, and $M_{2D}$ represents the downmix matrix corresponding to the downmix mode D of the current frame.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\begin{bmatrix} \hat{x}'_L(n) \\ \hat{x}'_R(n) \end{bmatrix} = \hat{M}_{2D} * \begin{bmatrix} \hat{Y}(n) \\ \hat{X}(n) \end{bmatrix},$$

where n represents a sequence number of a sampling point, $\hat{X}_L'(n)$ represents the reconstructed left channel signal of the current frame, $\hat{X}_R'(n)$ represents the reconstructed right channel signal of the current frame, $\hat{Y}(n)$ represents the decoded primary channel signal of the current frame, $\hat{X}(n)$ represents the decoded secondary channel signal of the current frame, and $\hat{M}_{2D}$ represents the upmix matrix corresponding to the downmix mode D of the current frame.

For another example, the encoding mode of the current frame is the downmix mode D-to-downmix mode D encoding mode. In this case, in some other possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com}:$$

$$\begin{bmatrix} Y(n) \\ X(n) \end{bmatrix} = M_{1D} * \begin{bmatrix} X_L(n) \\ X_R(n) \end{bmatrix}, \text{ and}$$

$$\text{if } N - \text{delay_com} \le n < N:$$

$$\begin{bmatrix} Y(n) \\ X(n) \end{bmatrix} = M_{2D} * \begin{bmatrix} X_L(n) \\ X_R(n) \end{bmatrix},$$

where $X_L(n)$ represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1D} * \begin{bmatrix} \hat{Y}(n) \\ \hat{X}(n) \end{bmatrix}, \text{ and}$$

$$\text{if } N - \text{upmixing_delay} \le n < N:$$

$$\begin{bmatrix} \hat{x}'_L(n) \\ \hat{x}'_R(n) \end{bmatrix} = \hat{M}_{2D} * \begin{bmatrix} \hat{Y}(n) \\ \hat{X}(n) \end{bmatrix},$$

where n represents a sequence number of a sampling point, $\hat{X}_L'(n)$ represents the reconstructed left channel signal of the current frame, $\hat{X}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, upmixing_delay represents decoding delay compensation, delay_com represents encoding delay compensation, N represents a frame length, for example, n=0, 1, . . . , N−1, and $M_{1D}$ represents the downmix matrix corresponding to the downmix mode D of the previous frame, $M_{2D}$ represents the downmix matrix corresponding to the downmix mode D of the current frame, $\hat{M}_{1D}$ represents the upmix matrix corresponding to the downmix mode D of the previous frame, and $\hat{M}_{2D}$ represents the upmix matrix corresponding to the downmix mode D of the current frame.

For another example, the encoding mode of the current frame is the downmix mode D-to-downmix mode D encoding mode. In this case, in some other possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com}:$$

$$\begin{bmatrix} Y(n) \\ X(n) \end{bmatrix} = M_{1D} * \begin{bmatrix} X_L(n) \\ X_R(n) \end{bmatrix},$$

$$\text{if } N - \text{delay_com} \le n < N - \text{delay_com} + \text{NOVA_D}:$$

$$\begin{bmatrix} Y(n) \\ X(n) \end{bmatrix} = \text{fade_out}(n) * M_{1D} * \begin{bmatrix} X_L(n) \\ X_R(n) \end{bmatrix} + \text{fade_in}(n) * M_{2D} * \begin{bmatrix} X_L(n) \\ X_R(n) \end{bmatrix}, \text{ and}$$

$$\text{if } N - \text{delay_com} + \text{NOVA_D} \le n < N:$$

$$\begin{bmatrix} Y(n) \\ X(n) \end{bmatrix} = M_{2D} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_D}},$$

and certainly, fade_in(n) may be alternatively a fade-in factor based on another function relationship of n, and fade_out(n) represents a fade-out factor, for example, $$\text{fade_out}(n) = 1 - \frac{n - (N - \text{delay_com})}{\text{NOVA_D}},$$

and certainly, fade_out(n) may be alternatively a fade-out factor based on another function relationship of n.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1D} * \begin{bmatrix} \hat{Y}(n) \\ \hat{X}(n) \end{bmatrix},$$

$$\text{if } N - \text{upmixing_delay} \le n < N - \text{upmixing_delay} + \text{NOVA_D}:$$

$$\begin{bmatrix} \hat{x}'_L(n) \\ \hat{x}'_R(n) \end{bmatrix} = \text{fade_out}(n) * \hat{M}_{1D} * \begin{bmatrix} \hat{Y}(n) \\ \hat{X}(n) \end{bmatrix} + \text{fade_in}(n) * \hat{M}_{2D} * \begin{bmatrix} \hat{Y}(n) \\ \hat{X}(n) \end{bmatrix}, \text{ and}$$

$$\text{if } N - \text{upmixing_delay} + \text{NOVA_D} \le n < N:$$

$$\begin{bmatrix} \hat{x}'_L(n) \\ \hat{x}'_R(n) \end{bmatrix} = \hat{M}_{2D} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_D}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_D}},$$

and certainly, fade_out(n) may be alternatively a fade-out factor based on another function relationship of n, and NOVA_D represents a transition processing length corresponding to the downmix mode D, and a value of NOVA_D may be set based on a requirement of a specific scenario, for example, NOVA_D may be equal to 3/N, or NOVA_D may be another value less than N.

The following describes, using examples, some encoding/decoding cases in which the downmix mode of the current frame is different from the downmix mode of the previous frame. For example, when the downmix mode of the current frame is different from the downmix mode of the previous frame, the decoding apparatus may perform segmented time-domain upmix processing on the left and right channel signals of the current frame based on the encoding mode of the current frame. For example, when the downmix mode of the current frame is different from the downmix mode of the previous frame, the decoding/encoding apparatus may perform segmented time-domain upmix processing on the decoded primary and secondary channel signals of the current frame based on the encoding mode of the current frame.

The following first describes scenarios of the downmix mode A-to-downmix mode B encoding mode using examples.

Further, for example, the encoding mode of the current frame is the downmix mode A-to-downmix mode B encoding mode. In this case, in some possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com}:$$

$$\begin{bmatrix} Y(n) \\ X(n) \end{bmatrix} = M_{1A} * \begin{bmatrix} X_L(n) \\ X_R(n) \end{bmatrix},$$

$$\text{if } N - \text{delay_com} \le n < N - \text{delay_com} + \text{NOVA_AB}:$$

$$\begin{bmatrix} Y(n) \\ X(n) \end{bmatrix} = \text{fade_out}(n) * M_{1A} * \begin{bmatrix} X_L(n) \\ X_R(n) \end{bmatrix} + \text{fade_in}(n) * M_{2B} * \begin{bmatrix} X_L(n) \\ X_R(n) \end{bmatrix}, \text{ and}$$

$$\text{if } N - \text{delay_com} + \text{NOVA_AB} \le n < N:$$

$$\begin{bmatrix} Y(n) \\ X(n) \end{bmatrix} = M_{2B} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_AB}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{delay_com})}{\text{NOVA_AB}},$$

and certainly, fade_out(n) may be alternatively a fade-out factor based on another function relationship of n, and $X_L(n)$ represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1A} * \begin{bmatrix} \hat{Y}(n) \\ \hat{X}(n) \end{bmatrix},$$

$$\text{if } N - \text{upmixing_delay} \le n < N - \text{upmixing_delay} + \text{NOVA_AB}:$$

$$\begin{bmatrix} \hat{x}'_L(n) \\ \hat{x}'_R(n) \end{bmatrix} = \text{fade_out}(n) * \hat{M}_{1A} * \begin{bmatrix} \hat{Y}(n) \\ \hat{X}(n) \end{bmatrix} + \text{fade_in}(n) * \hat{M}_{2B} * \begin{bmatrix} \hat{Y}(n) \\ \hat{X}(n) \end{bmatrix}, \text{ and}$$

$$\text{if } N - \text{upmixing_delay} + \text{NOVA_AB} \le n < N:$$

$$\begin{bmatrix} \hat{x}'_L(n) \\ \hat{x}'_R(n) \end{bmatrix} = \hat{M}_{2B} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_AB}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_AB}},$$

and certainly, fade_out(n) may be alternatively a fade-out factor based on another function relationship of n, n represents a sequence number of a sampling point, $\hat{X}_L'(n)$ represents the reconstructed left channel signal of the current frame, $\hat{X}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, NOVA_AB represents a transition processing length corresponding to downmix mode A-to-downmix mode B switching, and a value of NOVA_AB may be set based on a requirement of a specific scenario, for example, NOVA_AB may be equal to 3/N, or NOVA_AB may be another value less than N, N represents a frame length, for example, n=0, 1, . . . , N−1, delay_com represents encoding delay compensation, and upmixing_delay represents decoding delay compensation, and $M_{1A}$ represents the downmix matrix corresponding to the downmix mode A of the previous frame, $M_{2B}$ represents the downmix matrix corresponding to the downmix mode B of the current frame, $\hat{M}_{1A}$ represents the upmix matrix corresponding to the downmix mode A of the previous frame, and $\hat{M}_{2B}$ represents the upmix matrix corresponding to the downmix mode B of the current frame.

The following describes scenarios of the downmix mode A-to-downmix mode C encoding mode using examples.

Further, for example, the encoding mode of the current frame is the downmix mode A-to-downmix mode C encoding mode. In this case, in some possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com:}$$

$$\begin{bmatrix} Y(n) \\ X(n) \end{bmatrix} = M_{1A} * \begin{bmatrix} X_L(n) \\ X_R(n) \end{bmatrix},$$

$$\text{if } N - \text{delay_com} \le n < N - \text{delay_com} + \text{NOVA_AC:}$$

$$\begin{bmatrix} Y(n) \\ X(n) \end{bmatrix} = \text{fade_out}(n) * M_{1A} * \begin{bmatrix} X_L(n) \\ X_R(n) \end{bmatrix} + \text{fade_in}(n) * M_{2C} * \begin{bmatrix} X_L(n) \\ X_R(n) \end{bmatrix}, \text{ and}$$

$$\text{if } N - \text{delay_com} + \text{NOVA_AC} \le n < N:$$

$$\begin{bmatrix} Y(n) \\ X(n) \end{bmatrix} = M_{2C} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_AC}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{delay_com})}{\text{NOVA_AC}},$$

and certainly, fade_out(n) may be alternatively a fade-out factor based on another function relationship of n, and $X_L$, (n) represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay:}$$

$$\begin{bmatrix} \hat{x}'_L(n) \\ \hat{x}'_R(n) \end{bmatrix} = \hat{M}_{1A} * \begin{bmatrix} \hat{Y}(n) \\ \hat{X}(n) \end{bmatrix},$$

-continued $$\text{if } N - \text{upmixing_delay} \le n < N - \text{upmixing_delay} + \text{NOVA_AC:}$$

$$\begin{bmatrix} \hat{x}'_L(n) \\ \hat{x}'_R(n) \end{bmatrix} = \text{fade_out}(n) * \hat{M}_{1A} * \begin{bmatrix} \hat{Y}(n) \\ \hat{X}(n) \end{bmatrix} + \text{fade_in}(n) * \hat{M}_{2C} * \begin{bmatrix} \hat{Y}(n) \\ \hat{X}(n) \end{bmatrix},$$

and $$\text{if } N - \text{upmixing_delay} + \text{NOVA_AC} \le n < N:$$

$$\begin{bmatrix} \hat{x}'_L(n) \\ \hat{x}'_R(n) \end{bmatrix} = \hat{M}_{2c} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_1}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_1}},$$

and certainly, fade_out(n) may be alternatively a fade-out factor based on another function relationship of n, n represents a sequence number of a sampling point, $\hat{X}_L'(n)$ represents the reconstructed left channel signal of the current frame, $\hat{X}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, NOVA_AC represents a transition processing length corresponding to downmix mode A-to-downmix mode C switching, and a value of NOVA_AC may be set based on a requirement of a specific scenario, for example, NOVA_AC may be equal to 3/N, or NOVA_AC may be another value less than N, N represents a frame length, for example, n=0, 1, . . . , N−1, delay_com represents encoding delay compensation, and upmixing_delay represents decoding delay compensation, and $M_{1A}$ represents the downmix matrix corresponding to the downmix mode A of the previous frame, $M_{2C}$ represents the downmix matrix corresponding to the downmix mode C of the current frame, $\hat{M}_{1A}$ represents the upmix matrix corresponding to the downmix mode A of the previous frame, and $\hat{M}_{2C}$ represents the upmix matrix corresponding to the downmix mode C of the current frame.

The following describes scenarios of the downmix mode B-to-downmix mode A encoding mode using examples.

Further, for example, the encoding mode of the current frame is the downmix mode B-to-downmix mode A encoding mode. In this case, in some possible implementations, when time-domain downmix processing is performed on the left and right channel signals of the current frame based on the encoding mode of the current frame, to obtain primary and secondary channel signals of the current frame:

if $0 \le n < N - \text{delay_com}$:

$$\begin{bmatrix} Y(n) \\ X(n) \end{bmatrix} = M_{1B} * \begin{bmatrix} X_L(n) \\ X_R(n) \end{bmatrix},$$

if $N - \text{delay_com} \le n < N - \text{delay_com} + \text{NOVA_BA}$:

$$\begin{bmatrix} Y(n) \\ X(n) \end{bmatrix} = \text{fade_out}(n) * M_{1B} * \begin{bmatrix} X_L(n) \\ X_R(n) \end{bmatrix} + \text{fade_in}(n) * M_{2A} * \begin{bmatrix} X_L(n) \\ X_R(n) \end{bmatrix},$$

and if $N - \text{delay_com} + \text{NOVA_BA} \le n < N$:

$$\begin{bmatrix} Y(n) \\ X(n) \end{bmatrix} = M_{2A} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_BA}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{delay_com})}{\text{NOVA_BA}},$$

and certainly, fade_out(n) may be alternatively a fade-out factor based on another function relationship of n, and $X_L(n)$ represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame, if $0 \le n < N - \text{upmixing_delay}$ $$\begin{bmatrix} \hat{x}'_L(n) \\ \hat{x}'_R(n) \end{bmatrix} = \hat{M}_{1B} * \begin{bmatrix} \hat{Y}(n) \\ \hat{X}(n) \end{bmatrix},$$

if $N - \text{upmixing_delay} \le n < N - \text{upmixing_delay} + \text{NOVA_BA}$:

$$\begin{bmatrix} \hat{x}'_L(n) \\ \hat{x}'_R(n) \end{bmatrix} = \text{fade_out}(n) * \hat{M}_{1B} * \begin{bmatrix} \hat{Y}(n) \\ \hat{X}(n) \end{bmatrix} + \text{fade_in}(n) * \hat{M}_{2A} * \begin{bmatrix} \hat{Y}(n) \\ \hat{X}(n) \end{bmatrix},$$

-continued and if $N - \text{upmixing_delay} + \text{NOVA_BA} \le n < N$:

$$\begin{bmatrix} \hat{x}'_L(n) \\ \hat{x}'_R(n) \end{bmatrix} = \hat{M}_{2A} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_BA}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_BA}},$$

and certainly, fade_out(n) may be alternatively a fade-out factor based on another function relationship of n, n represents a sequence number of a sampling point, $\hat{X}_L'(n)$ represents the reconstructed left channel signal of the current frame, $\hat{X}_R(n)$ represents the reconstructed right channel signal of the current frame, $\hat{Y}(n)$ represents the decoded primary channel signal of the current frame, and $\hat{X}(n)$ represents the decoded secondary channel signal of the current frame, NOVA_BA represents a transition processing length corresponding to downmix mode B-to-downmix mode A switching, and a value of NOVA_BA may be set based on a requirement of a specific scenario, for example, NOVA_BA may be equal to 3/N, or NOVA_BA may be another value less than N, N represents a frame length, for example, n=0, 1, . . . , N−1, delay_com represents encoding delay compensation, and upmixing_delay represents decoding delay compensation, and $M_{1B}$ represents the downmix matrix corresponding to the downmix mode B of the previous frame, $M_{2A}$ represents the downmix matrix corresponding to the downmix mode A of the current frame, $\hat{M}_{1B}$ represents the upmix matrix corresponding to the downmix mode B of the previous frame, and $\hat{M}_{2A}$ represents the upmix matrix corresponding to the downmix mode A of the current frame.

The following describes scenarios of the downmix mode B-to-downmix mode D encoding mode using examples.

Further, for example, the encoding mode of the current frame is the downmix mode B-to-downmix mode D encoding mode. In this case, in some possible implementations, when time-domain downmix processing is performed on the left and right channel signals of the current frame based on the encoding mode of the current frame, to obtain primary and secondary channel signals of the current frame:

if $0 \le n < N - \text{delay_com}$:

$$\begin{bmatrix} Y(n) \\ X(n) \end{bmatrix} = M_{1B} * \begin{bmatrix} X_L(n) \\ X_R(n) \end{bmatrix},$$

if $N - \text{delay_com} \le n < N - \text{delay_com} + \text{NOVA_BD}$:

$$\begin{bmatrix} Y(n) \\ X(n) \end{bmatrix} = \text{fade_out}(n) * M_{1B} * \begin{bmatrix} X_L(n) \\ X_R(n) \end{bmatrix} + \text{fade_in}(n) * M_{2D} * \begin{bmatrix} X_L(n) \\ X_R(n) \end{bmatrix},$$

-continued and if $N - \text{delay_com} + \text{NOVA_BD} \le n < N$:

$$\begin{bmatrix} Y(n) \\ X(n) \end{bmatrix} = M_{2D} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_BD}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{delay_com})}{\text{NOVA_BD}},$$

and certainly, fade_out(n) may be alternatively a fade-out factor based on another function relationship of n, and $X_L(n)$ represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

if $0 \le n < N - \text{upmixing_delay}$:

$$\begin{bmatrix} \hat{x}'_L(n) \\ \hat{x}'_R(n) \end{bmatrix} = \hat{M}_{1B} * \begin{bmatrix} \hat{Y}(n) \\ \hat{X}(n) \end{bmatrix},$$

if $N - \text{upmixing_delay} \le n < N - \text{upmixing_delay} + \text{NOVA_BD}$:

$$\begin{bmatrix} \hat{x}'_L(n) \\ \hat{x}'_R(n) \end{bmatrix} = \text{fade_out}(n) * \hat{M}_{1B} * \begin{bmatrix} \hat{Y}(n) \\ \hat{X}(n) \end{bmatrix} + \text{fade_in}(n) * \hat{M}_{2D} * \begin{bmatrix} \hat{Y}(n) \\ \hat{X}(n) \end{bmatrix},$$

and if $N - \text{upmixing_delay} + \text{NOVA_BD} \le n < N$:

$$\begin{bmatrix} \hat{x}'_L(n) \\ \hat{x}'_R(n) \end{bmatrix} = \hat{M}_{2D} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_BD}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_BD}},$$

and certainly, fade_out(n) may be alternatively a fade-out factor based on another function relationship of n, n represents a sequence number of a sampling point, $\hat{X}_L'(n)$ represents the reconstructed left channel signal of the current frame, $\hat{X}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, NOVA_BD represents a transition processing length corresponding to downmix mode B-to-downmix mode D switching, and a value of NOVA_BD may be set based on a requirement of a specific scenario, for example, NOVA_BD may be equal to 3/N, or NOVA_BD may be another value less than N, N represents a frame length, for example, n=0, 1, . . . , N−1, delay_com represents encoding delay compensation, and upmixing_delay represents decoding delay compensation, and $M_{1B}$ represents the downmix matrix corresponding to the downmix mode B of the previous frame, $M_{2D}$ represents the downmix matrix corresponding to the downmix mode D of the current frame, $\hat{M}_{1B}$ represents the upmix matrix corresponding to the downmix mode B of the previous frame, and $\hat{M}_{2D}$ represents the upmix matrix corresponding to the downmix mode D of the current frame.

The following describes scenarios of the downmix mode C-to-downmix mode A encoding mode using examples.

Further, for example, the encoding mode of the current frame is the downmix mode C-to-downmix mode A encoding mode. In this case, in some possible implementations, when time-domain downmix processing is performed on the left and right channel signals of the current frame based on the encoding mode of the current frame, to obtain primary and secondary channel signals of the current frame:

if $0 \le n < N - \text{delay_com}$:

$$\begin{bmatrix} Y(n) \\ X(n) \end{bmatrix} = M_{1C} * \begin{bmatrix} X_L(n) \\ X_R(n) \end{bmatrix},$$

if $N - \text{delay_com} \le n < N - \text{delay_com} + \text{NOVA_CA}$:

$$\begin{bmatrix} X(n) \\ Y(n) \end{bmatrix} = \text{fade_out}(n) * M_{1C} * \begin{bmatrix} X_L(n) \\ X_R(n) \end{bmatrix} + \text{fade_in}(n) * M_{2A} * \begin{bmatrix} X_L(n) \\ X_R(n) \end{bmatrix}, \text{ and}$$

if $N - \text{delay_com} + \text{NOVA_CA} \le n < N$:

$$\begin{bmatrix} Y(n) \\ X(n) \end{bmatrix} = M_{2A} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_CA}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{delay_com})}{\text{NOVA_CA}},$$

and certainly, fade_out(n) may be alternatively a fade-out factor based on another function relationship of n, and $X_L(n)$ represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1C} * \begin{bmatrix} \hat{Y}(n) \\ \hat{X}(n) \end{bmatrix},$$

$$\text{if } N - \text{upmixing_delay} \le n < N - \text{upmixing_delay} + \text{NOVA_CA}:$$

$$\begin{bmatrix} \hat{x}'_L(n) \\ \hat{x}'_R(n) \end{bmatrix} = \text{fade_out}(n) * \hat{M}_{1C} * \begin{bmatrix} \hat{Y}(n) \\ \hat{X}(n) \end{bmatrix} + \text{fade_in}(n) * \hat{M}_{2A} * \begin{bmatrix} \hat{Y}(n) \\ \hat{X}(n) \end{bmatrix}, \text{ and}$$

$$\text{if } N - \text{upmixing_delay} + \text{NOVA_CA} \le n < N:$$

$$\begin{bmatrix} \hat{x}'_L(n) \\ \hat{x}'_R(n) \end{bmatrix} = \hat{M}_{2A} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_CA}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_CA}},$$

and certainly, fade_out(n) may be alternatively a fade-out factor based on another function relationship of n, n represents a sequence number of a sampling point, $\hat{X}_L'(n)$ represents the reconstructed left channel signal of the current frame, $\hat{X}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, NOVA_CA represents a transition processing length corresponding to downmix mode C-to-downmix mode A switching, and a value of NOVA_CA may be set based on a requirement of a specific scenario, for example, NOVA_CA may be equal to 3/N, or NOVA_CA may be another value less than N, n represents a sequence number of a sampling point, and N represents a frame length, delay_com represents encoding delay compensation, and upmixing_delay represents decoding delay compensation, and $M_{1C}$ represents the downmix matrix corresponding to the downmix mode C of the previous frame, $M_{2A}$ represents the downmix matrix corresponding to the downmix mode A of the current frame, $\hat{M}_{1C}$ represents the upmix matrix corresponding to the downmix mode C of the previous frame, and $\hat{M}_{2A}$ represents the upmix matrix corresponding to the downmix mode A of the current frame.

The following describes scenarios of the downmix mode C-to-downmix mode D encoding mode using examples.

Further, for example, the encoding mode of the current frame is the downmix mode C-to-downmix mode D encoding mode. In this case, in some possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com}:$$

$$\begin{bmatrix} Y(n) \\ X(n) \end{bmatrix} = M_{1C} * \begin{bmatrix} X_L(n) \\ X_R(n) \end{bmatrix},$$

$$\text{if } N - \text{delay_com} \le n < N - \text{delay_com} + \text{NOVA_CD}:$$

$$\begin{bmatrix} X(n) \\ Y(n) \end{bmatrix} = \text{fade_out}(n) * M_{1C} * \begin{bmatrix} X_L(n) \\ X_R(n) \end{bmatrix} + \text{fade_in}(n) * M_{2D} * \begin{bmatrix} X_L(n) \\ X_R(n) \end{bmatrix}, \text{ and}$$

$$\text{if } N - \text{delay_com} + \text{NOVA_CD} \le n < N:$$

$$\begin{bmatrix} Y(n) \\ X(n) \end{bmatrix} = M_{2D} * \begin{bmatrix} X_L(n) \\ X_R(n) \end{bmatrix},$$

where fade_in(n) represents a fade-in factor, for example, $$\text{fade_in}(n) = 1 - \frac{n - (N - \text{delay_com})}{\text{NOVA_CD}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{delay_com})}{\text{NOVA_CD}},$$

and certainly, fade_out(n) may be alternatively a fade-out factor based on another function relationship of n, and $X_L(n)$ represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

$$\text{if } 0 \le n < N - \text{upmixing_delay}$$

$$\begin{bmatrix} \hat{x}'_L(n) \\ \hat{x}'_R(n) \end{bmatrix} = \hat{M}_{1C} * \begin{bmatrix} \hat{Y}(n) \\ \hat{X}(n) \end{bmatrix},$$

-continued if $N - \text{upmixing_delay} \le n < N - \text{upmixing_delay} + \text{NOVA_CD}$:

$$\begin{bmatrix} \hat{x}'_L(n) \\ \hat{x}'_R(n) \end{bmatrix} = \text{fade_out}(n) * \hat{M}_{1C} * \begin{bmatrix} \hat{Y}(n) \\ \hat{X}(n) \end{bmatrix} + \text{fade_in}(n) * \hat{M}_{2D} * \begin{bmatrix} \hat{Y}(n) \\ \hat{X}(n) \end{bmatrix}, \text{ and}$$

if $N - \text{upmixing_delay} + \text{NOVA_CD} \le n < N$:

$$\begin{bmatrix} \hat{x}'_L(n) \\ \hat{x}'_R(n) \end{bmatrix} = \hat{M}_{2D} * \begin{bmatrix} \hat{Y}(n) \\ \hat{X}(n) \end{bmatrix},$$

where fade_in(n) represents a fade-in factor, for example, $$\text{fade_in}(n) = \frac{n - (N - \text{upmixing_delay})}{\text{NOVA_CD}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_CD}},$$

and certainly, fade_out(n) may be alternatively a fade-out factor based on another function relationship of n, n represents a sequence number of a sampling point, $\hat{x}_L'(n)$ represents the reconstructed left channel signal of the current frame, $\hat{x}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, NOVA_CD represents a transition processing length corresponding to downmix mode C-to-downmix mode D switching, and a value of NOVA_CD may be set based on a requirement of a specific scenario, for example, NOVA_CD may be equal to 3/N, or NOVA_CD may be another value less than N, N represents a frame length, for example, n=0, 1, . . . , N−1, delay_com represents encoding delay compensation, and upmixing_delay represents decoding delay compensation, and $M_{1C}$ represents the downmix matrix corresponding to the downmix mode C of the previous frame, $M_{2D}$ represents the downmix matrix corresponding to the downmix mode D of the current frame, $\hat{M}_{1C}$ represents the upmix matrix corresponding to the downmix mode C of the previous frame, and $\hat{M}_{2D}$ represents the upmix matrix corresponding to the downmix mode D of the current frame.

The following describes scenarios of the downmix mode D-to-downmix mode C encoding mode using examples.

Further, for example, the encoding mode of the current frame is the downmix mode D-to-downmix mode C encoding mode. In this case, in some possible implementations, when time-domain downmix processing is performed on the left and right channel signals of the current frame based on the encoding mode of the current frame, to obtain primary and secondary channel signals of the current frame:

if $0 \le n < N - \text{delay_com}$:

$$\begin{bmatrix} Y(n) \\ X(n) \end{bmatrix} = M_{1D} * \begin{bmatrix} X_L(n) \\ X_R(n) \end{bmatrix},$$

-continued if $N - \text{delay_com} \le n < N - \text{delay_com} + \text{NOVA_DC}$:

$$\begin{bmatrix} X(n) \\ Y(n) \end{bmatrix} = \text{fade_out}(n) * M_{1D} * \begin{bmatrix} X_L(n) \\ X_R(n) \end{bmatrix} + \text{fade_in}(n) * M_{2C} * \begin{bmatrix} X_L(n) \\ X_R(n) \end{bmatrix}, \text{ and}$$

if $N - \text{delay_com} + \text{NOVA_DC} \le n < N$:

$$\begin{bmatrix} Y(n) \\ X(n) \end{bmatrix} = M_{2C} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_DC}},$$

and certainly, fade_in(n) be alternatively a fade-in factor based on another function relationship of n, fade_out(n) represents a fade-out factor, for example, $$\text{fade_out}(n) = 1 - \frac{n - (N - \text{upmixing_delay})}{\text{NOVA_DC}},$$

and certainly, fade_out(n) may be alternatively a fade-out factor based on another function relationship of n, and $X_L(n)$ represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame:

if $0 \le n < N - \text{upmixing_delay}$:

$$\begin{bmatrix} \hat{x}'_L(n) \\ \hat{x}'_R(n) \end{bmatrix} = \hat{M}_{1D} * \begin{bmatrix} \hat{Y}(n) \\ \hat{X}(n) \end{bmatrix},$$

if $N - \text{upmixing_delay} \le n < N - \text{upmixing_delay} + \text{NOVA_DC}$:

$$\begin{bmatrix} \hat{x}'_L(n) \\ \hat{x}'_R(n) \end{bmatrix} = \text{fade_out}(n) * \hat{M}_{1D} * \begin{bmatrix} \hat{Y}(n) \\ \hat{X}(n) \end{bmatrix} + \text{fade_in}(n) * \hat{M}_{2C} * \begin{bmatrix} \hat{X}(n) \\ \hat{Y}(n) \end{bmatrix}, \text{ and}$$

if $N - \text{upmixing_delay} + \text{NOVA_DC} \le n < N$:

$$\begin{bmatrix} \hat{x}'_L(n) \\ \hat{x}'_R(n) \end{bmatrix} = \hat{M}_{2C} * \begin{bmatrix} \hat{x}'_L(n) \\ \hat{x}'_R(n) \end{bmatrix},$$

where fade_in(n) represents a fade-in factor, for example, $$\text{fade_in}(n) = \frac{n - (N - \text{upmixing_delay})}{\text{NOVA_DC}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_DC}},$$

and certainly, fade_out(n) may be alternatively a fade-out factor based on another function relationship of n, n represents a sequence number of a sampling point, $\hat{x}_L'(n)$ represents the reconstructed left channel signal of the current frame, $\hat{x}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, NOVA_DC represents a transition processing length corresponding to downmix mode D-to-downmix mode C switching, and a value of NOVA_DC may be set based on a requirement of a specific scenario, for example, NOVA_DC may be equal to 3/N, or NOVA_DC may be another value less than N, n represents a sequence number of a sampling point, and N represents a frame length, delay_com represents encoding delay compensation, and upmixing_delay represents decoding delay compensation, and $M_{1D}$ represents the downmix matrix corresponding to the downmix mode D of the previous frame, $M_{2C}$ represents the downmix matrix corresponding to the downmix mode C of the current frame, $\hat{M}_{1D}$ represents the upmix matrix corresponding to the downmix mode D of the previous frame, and $\hat{M}_{2C}$ represents the upmix matrix corresponding to the downmix mode C of the current frame.

The following describes scenarios of the downmix mode D-to-downmix mode B encoding mode using examples.

Further, for example, the encoding mode of the current frame is the downmix mode D-to-downmix mode B encoding mode. In this case, in some possible implementations, when time-domain downmix processing is performed on the left and right channel signals of the current frame based on the encoding mode of the current frame, to obtain primary and secondary channel signals of the current frame:

$$\text{if } 0 \le n < N - \text{delay_com}:$$

$$\begin{bmatrix} Y(n) \\ X(n) \end{bmatrix} = M_{1D} * \begin{bmatrix} X_L(n) \\ X_R(n) \end{bmatrix},$$

$$\text{if } N - \text{delay_com} \le n < N - \text{delay_com} + \text{NOVA_DB}:$$

$$\begin{bmatrix} Y(n) \\ X(n) \end{bmatrix} = \text{fade_out}(n) * M_{1D} * \begin{bmatrix} X_L(n) \\ X_R(n) \end{bmatrix} + \text{fade_in}(n) * M_{2B} * \begin{bmatrix} X_L(n) \\ X_R(n) \end{bmatrix}, \text{ and}$$

$$\text{if } N - \text{delay_com} + \text{NOVA_DB} \le n < N:$$

$$\begin{bmatrix} Y(n) \\ X(n) \end{bmatrix} = M_{2B} * \begin{bmatrix} X_L(n) \\ X_R(n) \end{bmatrix},$$

where fade_in(n) represents a fade-in factor, for example, $$\text{fade_in}(n) = \frac{n - (N - \text{delay_com})}{\text{NOVA_DB}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{delay_com})}{\text{NOVA_DB}},$$

and certainly, fade_out(n) may be alternatively a fade-out factor based on another function relationship of n, and $X_L(n)$ represents the left channel signal of the current frame, $X_R(n)$ represents the right channel signal of the current frame, Y(n) represents the primary channel signal that is of the current frame and that is obtained through time-domain downmix processing, and X(n) represents the secondary channel signal that is of the current frame and that is obtained through time-domain downmix processing.

Correspondingly, in a corresponding decoding scenario, when time-domain upmix processing is performed on the decoded primary and secondary channel signals of the current frame based on the encoding mode of the current frame, to obtain the reconstructed left and right channel signals of the current frame, $$\text{if } 0 \le n < N - \text{upmixing_delay}:$$

$$\begin{bmatrix} \hat{x}_L'(n) \\ \hat{x}_R'(n) \end{bmatrix} = \hat{M}_{1D} * \begin{bmatrix} \hat{Y}(n) \\ \hat{X}(n) \end{bmatrix},$$

$$\text{if } N - \text{upmixing_delay} \le n < N - \text{upmixing_delay} + \text{NOVA_DB}:$$

$$\begin{bmatrix} \hat{x}_L'(n) \\ \hat{x}_R'(n) \end{bmatrix} = \text{fade_out}(n) * \hat{M}_{1D} * \begin{bmatrix} \hat{Y}(n) \\ \hat{X}(n) \end{bmatrix} + \text{fade_in}(n) * \hat{M}_{2B} * \begin{bmatrix} \hat{X}(n) \\ \hat{Y}(n) \end{bmatrix}, \text{ and}$$

$$\text{if } N - \text{upmixing_delay} + \text{NOVA_DB} \le n < N:$$

$$\begin{bmatrix} \hat{x}_L'(n) \\ \hat{x}_R'(n) \end{bmatrix} = \hat{M}_{2B} * \begin{bmatrix} Y(n) \\ X(n) \end{bmatrix},$$

where fade_in (n) represents a fade-in factor, for example, $$\text{fade_in}(n) = \frac{n - (N - \text{upmixing_delay})}{\text{NOVA_DB}},$$

and certainly, fade_in(n) may be alternatively a fade-in factor based on another function relationship of n, fade_out (n) represents a fade-out factor, for example, $$\text{fade_out}(n) = 1 - \frac{n - (N - \text{upmixing_delay})}{\text{NOVA_DB}},$$

and certainly, fade_out(n) may be alternatively a fade-out factor based on another function relationship of n, where n represents a sequence number of a sampling point, $\hat{x}_L'(n)$ represents the reconstructed left channel signal of the current frame, $\hat{x}_R'(n)$ represents the reconstructed right channel signal of the current frame, $\hat{Y}(n)$ represents the decoded primary channel signal of the current frame, and $\hat{X}(n)$ represents the decoded secondary channel signal of the current frame, NOVA_DB represents a transition processing length corresponding to downmix mode D-to-downmix mode B switching, and a value of NOVA_DB may be set based on a requirement of a specific scenario, for example, NOVA_DB may be equal to 3/N, or NOVA_DB may be another value less than N, N represents a frame length, for example n=0, 1, . . . , N−1, delay_com represents delay encoding delay compensation, and upmixing_delay represents decoding delay compensation, and $M_{1D}$ represents the downmix matrix corresponding to the downmix mode D of the previous frame, $M_{2B}$ represents the downmix matrix corresponding to the downmix mode B of the current frame, $\hat{M}_{1D}$ represents the upmix matrix corresponding to the downmix mode D of the previous frame, and $\hat{M}_{2B}$ represents the upmix matrix corresponding to the downmix mode B of the current frame.

It can be understood that in the foregoing example encoding/decoding scenarios, transition processing lengths corresponding to different downmix modes may be different from each other, partially the same, or completely the same. For example NOVA_A, NOVA_B, NOVA_C, NOVA_D, NOVA_DB, and NOVA_DC may be different from each other, partially the same, or completely the same. Another case may be deduced by analogy.

In the foregoing example scenarios, the left and right channel signals of the current frame may be further original left and right channel signals of the current frame (the original left and right channel signals are left and right channel signals that have not undergone time-domain pre-processing, for example, may be left and right channel signals obtained through sampling), or may be left and right channel signals of the current frame that are obtained through time-domain pre-processing, or may be left and right channel signals of the current frame that are obtained through time-domain delay alignment processing.

Further, for example:

$$\begin{bmatrix} X_L(n) \\ X_R(n) \end{bmatrix} = \begin{bmatrix} x_L(n) \\ x_R(n) \end{bmatrix},$$

$$\begin{bmatrix} X_L(n) \\ X_R(n) \end{bmatrix} = \begin{bmatrix} x_{L_HP}(n) \\ x_{R_HP}(n) \end{bmatrix}, \text{ or}$$

$$\begin{bmatrix} X_L(n) \\ X_R(n) \end{bmatrix} = \begin{bmatrix} x'_L(n) \\ x'_R(n) \end{bmatrix},$$

where $x_L(n)$ represents an original left channel signal of the current frame, and $x_R(n)$ represents an original right channel signal of the current frame, $X_{L_HP}$ (n) represents a left channel signal that is of the current frame and that is obtained through time-domain pre-processing, and $X_{R_HP}$ (n) represents a right channel signal that is of the current frame and that is obtained through time-domain pre-processing, and $x_L'(n)$ represents a left channel signal that is of the current frame and that is obtained through delay alignment processing, and $x_R'$ (n) represents a right channel signal that is of the current frame and that is obtained through delay alignment processing.

The foregoing scenario examples provide examples of time-domain upmix and time-domain downmix processing manners for different encoding modes. Certainly, in actual application, other manners similar to the foregoing examples may be alternatively used for time-domain upmix processing and downmix processing. The embodiments of this application are not limited to the time-domain upmix and time-domain downmix processing manners in the foregoing examples.

Figure 6:
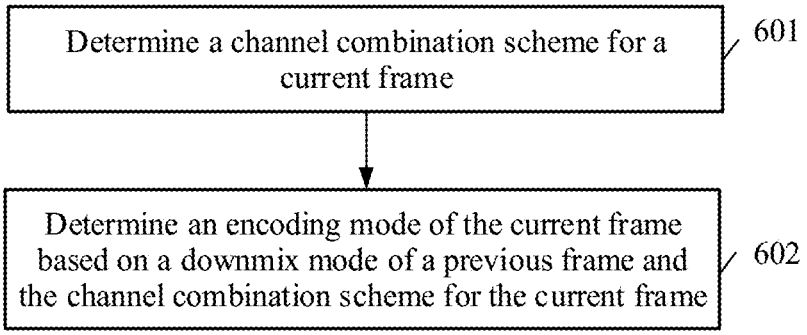
FIG. 6 is a schematic flowchart of a method for determining an audio encoding mode according to an embodiment of this application.

FIG. 6 is a schematic flowchart of a method for determining an audio encoding mode according to an embodiment of this application. Related steps of the method for determining an audio encoding mode may be implemented by an encoding apparatus. For example, the method may include the following steps.

601. Determine a channel combination scheme for the current frame.

For a specific implementation of determining the channel combination scheme for the current frame by the encoding apparatus, refer to related descriptions in other embodiments. Details are not described herein again.

602. Determine an encoding mode of the current frame based on a downmix mode of a previous frame and the channel combination scheme for the current frame.

For a specific implementation of determining the encoding mode of the current frame by the encoding apparatus based on the downmix mode of the previous frame and the channel combination scheme for the current frame, refer to related descriptions in other embodiments. Details are not described herein again.

It can be understood that in the foregoing encoding scenario, the channel combination scheme for the current frame needs to be determined. This indicates that there are a plurality of possible channel combination schemes for the current frame. In comparison with a conventional solution in which there is only one channel combination scheme, this helps achieve better compatibility and matching between a plurality of possible channel combination schemes and a plurality of possible scenarios.

It can be understood that in the foregoing encoding scenario, the encoding mode of the current frame needs to be determined based on the downmix mode of the previous frame and the channel combination scheme for the current frame. This indicates that there are a plurality of possible encoding modes of the current frame. In comparison with a conventional solution in which there is only one encoding mode, this helps achieve better compatibility and matching between a plurality of possible encoding modes and downmix modes and a plurality of possible scenarios.

Figure 7:
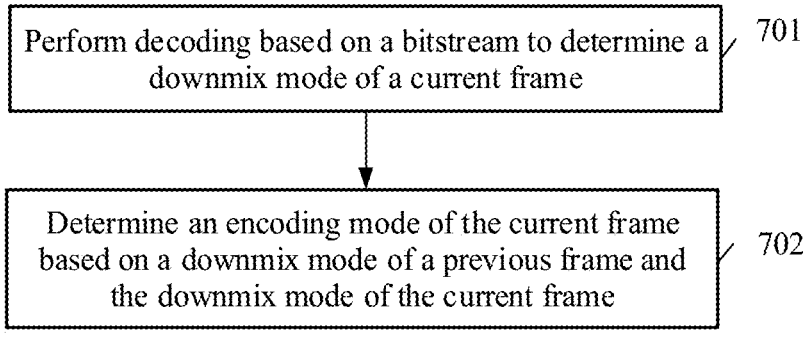
FIG. 7 is a schematic flowchart of another method for determining an audio encoding mode according to an embodiment of this application.

FIG. 7 is a schematic flowchart of a method for determining an audio encoding mode according to an embodiment of this application. Related steps of the method for determining an audio encoding mode may be implemented by a decoding apparatus. For example, the method may include the following steps.

701. Perform decoding based on a bitstream to determine a downmix mode of the current frame.

For example, decoding is performed based on the bitstream to obtain a downmix mode identifier that is of the current frame and that is included in the bitstream (the downmix mode identifier of the current frame indicates the downmix mode of the current frame), and the downmix mode of the current frame is determined based on the obtained downmix mode identifier of the current frame.

702. Determine an encoding mode of the current frame based on a downmix mode of a previous frame and the downmix mode of the current frame.

For a specific implementation of determining the encoding mode of the current frame based on the downmix mode of the previous frame and the downmix mode of the current frame, refer to related descriptions in other embodiments. Details are not described herein again.

It can be understood that in the foregoing decoding scenario, the encoding mode of the current frame needs to be determined based on the downmix mode of the previous frame and the downmix mode of the current frame. This indicates that there are a plurality of possible encoding modes of the current frame. In comparison with a conventional solution in which there is only one encoding mode, this helps achieve better compatibility and matching between a plurality of possible encoding modes and downmix modes and a plurality of possible scenarios.

The following describes some stereo parameters of the current frame or the previous frame.

In some embodiments of this application, a stereo parameter (for example, a channel combination ratio factor and/or an inter-channel time difference) of the current frame may be a fixed value, or may be determined based on a channel combination scheme (for example, a correlated signal channel combination scheme or an anticorrelated signal channel combination scheme) for the current frame.

Figure 8:
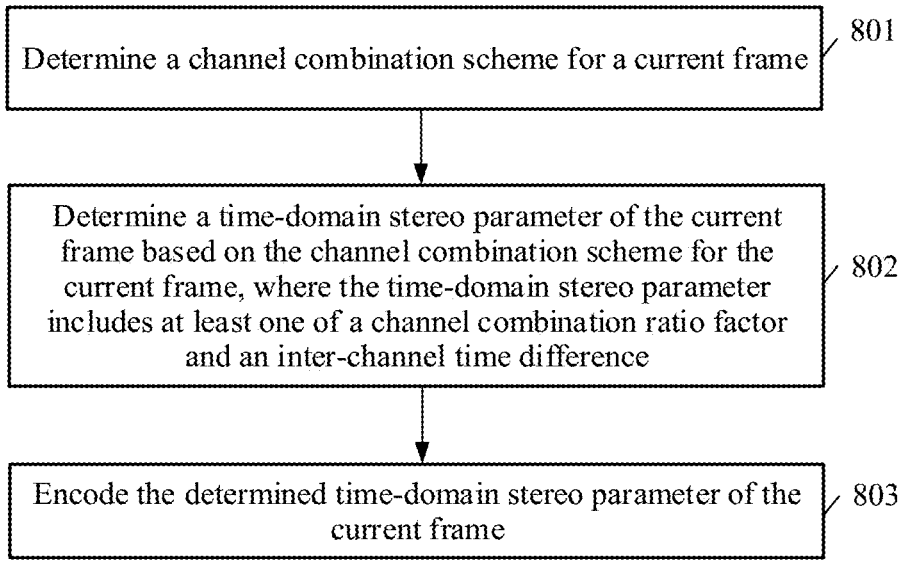
FIG. 8 is a schematic flowchart of a method for determining a time-domain stereo parameter according to an embodiment of this application.

Referring to FIG. 8, the following describes an example of a method for determining a time-domain stereo parameter. Related steps of the method for determining a time-domain stereo parameter may be implemented by an encoding apparatus. The method may include the following steps.

801. Determine a channel combination scheme for the current frame.

802. Determine a time-domain stereo parameter of the current frame based on the channel combination scheme for the current frame, where the time-domain stereo parameter includes at least one of a channel combination ratio factor and an inter-channel time difference.

The channel combination scheme for the current frame is one of a plurality of channel combination schemes.

For example, the plurality of channel combination schemes include an anticorrelated signal channel combination scheme and a correlated signal channel combination scheme.

The correlated signal channel combination scheme is a channel combination scheme corresponding to a near in phase signal. The anticorrelated signal channel combination scheme is a channel combination scheme corresponding to a near out of phase signal. It can be understood that the channel combination scheme corresponding to a near in phase signal is applicable to a near in phase signal, and the channel combination scheme corresponding to a near out of phase signal is applicable to a near out of phase signal.

When the channel combination scheme for the current frame is the correlated signal channel combination scheme, the time-domain stereo parameter of the current frame is a time-domain stereo parameter corresponding to the correlated signal channel combination scheme for the current frame, or when the channel combination scheme for the current frame is the anticorrelated signal channel combination scheme, the time-domain stereo parameter of the current frame is a time-domain stereo parameter corresponding to the anticorrelated signal channel combination scheme for the current frame.

It can be understood that in the foregoing solution, the channel combination scheme for the current frame needs to be determined. This indicates that there are a plurality of possible channel combination schemes for the current frame. In comparison with a conventional solution in which there is only one channel combination scheme, this helps achieve better compatibility and matching between a plurality of possible channel combination schemes and a plurality of possible scenarios. The time-domain stereo parameter of the current frame is determined based on the channel combination scheme for the current frame. This helps achieve better compatibility and matching between the time-domain stereo parameter and a plurality of possible scenarios, thereby helping improve encoding/decoding quality.

In some possible implementations, a channel combination ratio factor corresponding to the anticorrelated signal channel combination scheme for the current frame and that corresponding to the correlated signal channel combination scheme for the current frame may be first calculated separately. Then, when the channel combination scheme for the current frame is the correlated signal channel combination scheme, it is determined that the time-domain stereo parameter of the current frame is the time-domain stereo parameter corresponding to the correlated signal channel combination scheme for the current frame, or when the channel combination scheme for the current frame is the anticorrelated signal channel combination scheme, it is determined that the time-domain stereo parameter of the current frame is the time-domain stereo parameter corresponding to the anticorrelated signal channel combination scheme for the current frame. Alternatively, the time-domain stereo parameter corresponding to the correlated signal channel combination scheme for the current frame may be first calculated. When the channel combination scheme for the current frame is the correlated signal channel combination scheme, it is determined that the time-domain stereo parameter of the current frame is the time-domain stereo parameter corresponding to the correlated signal channel combination scheme for the current frame. When the channel combination scheme for the current frame is the anticorrelated signal channel combination scheme, the time-domain stereo parameter corresponding to the anticorrelated signal channel combination scheme for the current frame is then calculated, and the calculated time-domain stereo parameter corresponding to the anticorrelated signal channel combination scheme for the current frame is determined as the time-domain stereo parameter of the current frame.

Alternatively, the channel combination scheme for the current frame may be first determined. When the channel combination scheme for the current frame is the correlated signal channel combination scheme, the time-domain stereo parameter corresponding to the correlated signal channel combination scheme for the current frame is calculated. In this case, the time-domain stereo parameter of the current frame is the time-domain stereo parameter corresponding to the correlated signal channel combination scheme for the current frame. When the channel combination scheme for the current frame is the anticorrelated signal channel combination scheme, the time-domain stereo parameter corresponding to the anticorrelated signal channel combination scheme for the current frame is calculated. In this case, the time-domain stereo parameter of the current frame is the time-domain stereo parameter corresponding to the anticorrelated signal channel combination scheme for the current frame.

In some possible implementations, the determining a time-domain stereo parameter of the current frame based on the channel combination scheme for the current frame includes determining, based on the channel combination scheme for the current frame, an initial value of the channel combination ratio factor corresponding to the channel combination scheme for the current frame. When the initial value of the channel combination ratio factor corresponding to the channel combination scheme (the correlated signal channel combination scheme or the anticorrelated signal channel combination scheme) for the current frame does not need to be modified, the channel combination ratio factor corresponding to the channel combination scheme for the current frame is equal to the initial value of the channel combination ratio factor corresponding to the channel combination scheme for the current frame. When the initial value of the channel combination ratio factor corresponding to the channel combination scheme (the correlated signal channel combination scheme or the anticorrelated signal channel combination scheme) for the current frame needs to be modified, the initial value of the channel combination ratio factor corresponding to the channel combination scheme for the current frame is modified to obtain a modified value of the channel combination ratio factor corresponding to the channel combination scheme for the current frame, and the channel combination ratio factor corresponding to the channel combination scheme for the current frame is equal to the modified value of the channel combination ratio factor corresponding to the channel combination scheme for the current frame.

For example, the determining a time-domain stereo parameter of the current frame based on the channel combination scheme for the current frame may include calculating frame energy of a left channel signal of the current frame based on the left channel signal of the current frame, calculating frame energy of a right channel signal of the current frame based on the right channel signal of the current frame, and calculating, based on the frame energy of the left channel signal of the current frame and the frame energy of the right channel signal of the current frame, an initial value of the channel combination ratio factor corresponding to the correlated signal channel combination scheme for the current frame.

When the initial value of the channel combination ratio factor corresponding to the correlated signal channel combination scheme for the current frame does not need to be modified, the channel combination ratio factor corresponding to the correlated signal channel combination scheme for the current frame is equal to the initial value of the channel combination ratio factor corresponding to the correlated signal channel combination scheme for the current frame, and a code index of the channel combination ratio factor corresponding to the correlated signal channel combination scheme for the current frame is equal to a code index of the initial value of the channel combination ratio factor corresponding to the correlated signal channel combination scheme for the current frame.

When the initial value of the channel combination ratio factor corresponding to the correlated signal channel combination scheme for the current frame needs to be modified, the initial value of the channel combination ratio factor corresponding to the correlated signal channel combination scheme for the current frame and a code index of the initial value are modified to obtain a modified value of the channel combination ratio factor corresponding to the correlated signal channel combination scheme for the current frame and a code index of the modified value. The channel combination ratio factor corresponding to the correlated signal channel combination scheme for the current frame is equal to the modified value of the channel combination ratio factor corresponding to the correlated signal channel combination scheme for the current frame, and a code index of the channel combination ratio factor corresponding to the correlated signal channel combination scheme for the current frame is equal to the code index of the modified value of the channel combination ratio factor corresponding to the correlated signal channel combination scheme for the current frame.

Further, for example, when the initial value of the channel combination ratio factor corresponding to the correlated signal channel combination scheme for the current frame and the code index of the initial value are modified:

ratio_idx_mod=0.5*(tdm_last_ratio_idx+16), and $$\text{ratio_mod}_{qua}=\text{ratio_tabl}[\text{ratio_idx_mod}],$$

where tdm_last_ratio_idx represents a code index of a channel combination ratio factor corresponding to a correlated signal channel combination scheme for a previous frame, ratio_idx_mod represents the code index corresponding to the modified value of the channel combination ratio factor corresponding to the correlated signal channel combination scheme for the current frame, and $\text{ratio_mod}_{qua}$ represents the modified value of the channel combination ratio factor corresponding to the correlated signal channel combination scheme for the current frame.

For another example, the determining a time-domain stereo parameter of the current frame based on the channel combination scheme for the current frame includes obtaining a reference channel signal of the current frame based on a left channel signal and a right channel signal of the current frame, calculating a parameter of an amplitude correlation between the left channel signal of the current frame and the reference channel signal, calculating a parameter of an amplitude correlation between the right channel signal of the current frame and the reference channel signal, calculating a parameter of an amplitude correlation difference between the left and right channel signals of the current frame based on the parameter of the amplitude correlation between the left channel signal of the current frame and the reference channel signal, and the parameter of the amplitude correlation between the right channel signal of the current frame and the reference channel signal, and calculating, based on the parameter of the amplitude correlation difference between the left and right channel signals of the current frame, the channel combination ratio factor corresponding to the anticorrelated signal channel combination scheme for the current frame.

The calculating, based on the parameter of the amplitude correlation difference between the left and right channel signals of the current frame, the channel combination ratio factor corresponding to the anticorrelated signal channel combination scheme for the current frame, for example, may include calculating, based on the parameter of the amplitude correlation difference between the left and right channel signals of the current frame, an initial value of the channel combination ratio factor corresponding to the anticorrelated signal channel combination scheme for the current frame, and modifying the initial value of the channel combination ratio factor corresponding to the anticorrelated signal channel combination scheme for the current frame, to obtain the channel combination ratio factor corresponding to the anticorrelated signal channel combination scheme for the current frame. It can be understood that when the initial value of the channel combination ratio factor corresponding to the anticorrelated signal channel combination scheme for the current frame does not need to be modified, the channel combination ratio factor corresponding to the anticorrelated signal channel combination scheme for the current frame is equal to the initial value of the channel combination ratio factor corresponding to the anticorrelated signal channel combination scheme for the current frame.

In a possible implementation:

$$\text{corr_LM} = \frac{\sum_{n=0}^{N-1} |x'_L(n)| * |\text{mono_i}(n)|}{\sum_{n=0}^{N-1} |\text{mono_i}(n)| * |\text{mono_i}(n)|},$$

$$\text{corr_RM} = \frac{\sum_{n=0}^{N-1} |x'_R(n)| * |\text{mono_i}(n)|}{\sum_{n=0}^{N-1} |\text{mono_i}(n)| * |\text{mono_i}(n)|}, \text{ and}$$

$$\text{mono_i}(n) = \frac{x'_L(n) - x'_R(n)}{2},$$

where mono_i(n) represents the reference channel signal of the current frame, and $x_L'(n)$ represents a left channel signal that is of the current frame and that is obtained through delay alignment processing, $x_R'(n)$ represents a right channel signal that is of the current frame and that is obtained through delay alignment processing, corr_LM represents the parameter of the amplitude correlation between the left channel signal of the current frame and the reference channel signal, and corr_RM represents the parameter of the amplitude correlation between the right channel signal of the current frame and the reference channel signal.

In some possible implementations, the calculating a parameter of an amplitude correlation difference between the left and right channel signals of the current frame based on the parameter of the amplitude correlation between the left channel signal of the current frame and the reference channel signal, and the parameter of the amplitude correlation between the right channel signal of the current frame and the reference channel signal includes calculating, based on a parameter of an amplitude correlation between the reference channel signal and the left channel signal that is of the current frame and that is obtained through delay alignment processing, a parameter of an amplitude correlation between the reference channel signal and a left channel signal that is of the current frame and that is obtained through long-time smoothing, calculating, based on a parameter of an amplitude correlation between the reference channel signal and the right channel signal that is of the current frame and that is obtained through delay alignment processing, a parameter of an amplitude correlation between the reference channel signal and a right channel signal that is of the current frame and that is obtained through long-time smoothing, and calculating the parameter of the amplitude correlation difference between the left and right channel signals of the current frame based on the parameter of the amplitude correlation between the reference channel signal and the left channel signal that is of the current frame and that is obtained through long-time smoothing, and the parameter of the amplitude correlation between the reference channel signal and the right channel signal that is of the current frame and that is obtained through long-time smoothing.

There may be various smoothing processing manners. For example:

$$\text{tdm_lt_corr_}LM_SM_{cur}=\alpha*\text{tdm_lt_corr_}LM_SM_{pre}+(1-\alpha)\text{corr_}LM,$$

where $\text{tdm_lt_rms_L_SM}_{cur}=(1-A)*\text{tdm_lt_rms_L_SM}_{pre}+A*\text{rms_L}$, A represents an update factor of long-time smooth frame energy of the left channel signal of the current frame, $\text{tdm_lt_rms_L_SM}_{cur}$ represents the long-time smooth frame energy of the left channel signal of the current frame, rms_L represents frame energy of the left channel signal of the current frame, $\text{tdm_lt_corr_LM_SM}_{cur}$ represents the parameter of the amplitude correlation between the reference channel signal and the left channel signal that is of the current frame and that is obtained through long-time smoothing, $\text{tdm_lt_corr_LM_SM}_{pre}$ represents a parameter of an amplitude correlation between a reference channel signal and a left channel signal that is of the previous frame and that is obtained through long-time smoothing, and a represents a left channel smoothing factor.

For example:

$$\text{tdm_lt_corr_}RM_SM_{cur}=\beta*\text{tdm_lt_corr_}RM_SM_{pre}+(1-\beta)\text{corr_}LM,$$

where $\text{tdm_lt_rms_R_SM}_{cur}=(1-B)*\text{tdm_lt_rms_R_SM}_{pre}+B*\text{rms_R}$, B represents an update factor of long-time smooth frame energy of the right channel signal of the current frame, $\text{tdm_lt_rms_R_SM}_{pre}$ represents the long-time smooth frame energy of the right channel signal of the current frame, rms_R represents frame energy of the right channel signal of the current frame, $\text{tdm_lt_corr_SM}_{cur}$ represents the parameter of the amplitude correlation between the reference channel signal and the right channel signal that is of the current frame and that is obtained through long-time smoothing, $\text{tdm_lt_corr_RM_SM}_{pre}$ represents a parameter of an amplitude correlation between the reference channel signal and a right channel signal that is of the previous frame and that is obtained through long-time smoothing, and β represents a right channel smoothing factor.

In a possible implementation:

$$\text{diff_lt_corr}=\text{tdm_lt_corr_}LM_SM-\text{tdm_lt_corr_}RM_SM,$$

where tdm_lt_corr_LM_SM represents the parameter of the amplitude correlation between the reference channel signal and the left channel signal that is of the current frame and that is obtained through long-time smoothing tdm_lt_corr_RM_SM represents the parameter of the amplitude correlation between the reference channel signal and the right channel signal that is of the current frame and that is obtained through long-time smoothing, and diff_lt_corr represents the parameter of the amplitude correlation difference between the left and right channel signals of the current frame.

In some possible implementations, calculating, based on the parameter of the amplitude correlation difference between the left and right channel signals of the current frame, the channel combination ratio factor corresponding to the anticorrelated signal channel combination scheme for the current frame includes performing mapping processing on the parameter of the amplitude correlation difference between the left and right channel signals of the current frame such that a value range of a parameter that is of the amplitude correlation difference between the left and right channel signals of the current frame and that is obtained through mapping processing is [MAP_MIN,MAP_MAX], and converting the parameter that is of the amplitude correlation difference between the left and right channel signals and that is obtained through mapping processing into the channel combination ratio factor.

In some possible implementations, the performing mapping processing on the parameter of the amplitude correlation difference between the left and right channel signals of the current frame includes performing amplitude limiting processing on the parameter of the amplitude correlation difference between the left and right channel signals of the current frame, and performing mapping processing on a parameter that is of the amplitude correlation difference between the left and right channel signals of the current frame and that is obtained through amplitude limiting processing.

There may be various amplitude limiting processing manners. Further, for example:

$$\text{diff_lt_corr_limit}=\begin{cases}\text{RATIO_MAX}, & \text{if diff_lt_corr} > \text{RATIO_MAX}\\ \text{diff_lt_corr}, & \text{other}\\ \text{RATIO_MIN}, & \text{if diff_lt_corr} < \text{RATIO_MIN}\end{cases},$$

where RATIO_MAX represents a maximum value of the parameter that is of the amplitude correlation difference between the left and right channel signals of the current frame and that is obtained through amplitude limiting processing, RATIO_MIN represents a minimum value of the parameter that is of the amplitude correlation difference between the left and right channel signals of the current frame and that is obtained through amplitude limiting processing, and RATIO_MAX>RATIO_MIN There may be various mapping processing manners. Further, for example:

$$\text{diff_lt_corr_map} = \begin{cases} A_1 * \text{diff_lt_corr_limi} + B_1, & \text{if diff_lt_corr_limit} > \text{RATIO_HIGH} \\ A_2 * \text{diff_lt_corr_limi} + B_2, & \text{if diff_lt_corr_limit} < \text{RATIO_LOW} \\ A_3 * \text{diff_lt_corr_limi} + B_3, & \text{if RATIO_LOW} \le \text{diff_lt_corr_limit} \le \text{RATIO_HIGH} \end{cases},$$

$$A_1 = \frac{\text{MAP_MAX} - MA\ \text{P_HIGH}}{\text{RATIO_MAX} - \text{RATIO_HIGH}}$$

$$B_1 = \text{MAP_MAX} - \text{RATIO_MAX} * A_1,$$

$$\text{or } B_1 = \text{MAP_HIGH} - \text{RATIO_HIGH} * A_1$$

$$A_2 = \frac{\text{MAP_LOW} - MA\ \text{P_MIN}}{\text{RATIO_LOW} - \text{RATIO_MIN}},$$

$$B_2 = \text{MAP_LOW} - \text{RATIO_LOW} * A_2,$$

$$\text{or } B_2 = \text{MAP_MIN} - \text{RATIO_MIN} * A_2$$

$$A_3 = \frac{\text{MAP_HIGH} - M\ \text{AP_LOW}}{\text{RATIO_HIGH} - \text{RATIO_LOW}},$$

$$B_3 = \text{MAP_HIGH} - \text{RATIO_HIGH} * A_3,$$

$$\text{or } B_3 = \text{MAP_LOW} - \text{RATIO_LOW} * A_3$$

where diff_lt_corr_map represents the parameter that is of the amplitude correlation difference between the left and right channel signals of the current frame and that is obtained through mapping processing, MAP_MAX represents a maximum value of the parameter that is of the amplitude correlation difference between the left and right channel signals of the current frame and that is obtained through mapping processing, MAP_HIGH represents a high threshold of the parameter that is of the amplitude correlation difference between the left and right channel signals of the current frame and that is obtained through mapping processing, MAP_LOW represents a low threshold of the parameter that is of the amplitude correlation difference between the left and right channel signals of the current frame and that is obtained through mapping processing, and MAP_MIN represents a minimum value of the parameter that is of the amplitude correlation difference between the left and right channel signals of the current frame and that is obtained through mapping processing:

MAP_MAX>MAP_HIGH>MAP_LOW>MAP_MIN, where RATIO_MAX represents the maximum value of the parameter that is of the amplitude correlation difference between the left and right channel signals of the current frame and that is obtained through amplitude limiting processing, RATIO_HIGH represents a high threshold of the parameter that is of the amplitude correlation difference between the left and right channel signals of the current frame and that is obtained through amplitude limiting processing, RATIO_LOW represents a low threshold of the parameter that is of the amplitude correlation difference between the left and right channel signals of the current frame and that is obtained through amplitude limiting processing, and RATIO_MIN represents the minimum value of the parameter that is of the amplitude correlation difference between the left and right channel signals of the current frame and that is obtained through amplitude limiting processing, and:

RATIO_MAX>RATIO_HIGH>RATIO_LOW>RATIO_MIN.

For another example:

$$\text{diff_lt_corr_map} = \begin{cases} 1.08 * \text{diff_lt_corr_limi} + 0.38, & \text{if diff_lt_corr_limit} > 0.5 * \text{RATIO_MAX} \\ 0.64 * \text{diff_lt_corr_limi} + 1.28, & \text{if diff_lt_corr_limit} < -0.5 * \text{RATIO_MAX} \\ 0.26 * \text{diff_lt_corr_limi} + 0.995, & \text{other} \end{cases},$$

where diff_lt_corr_limit represents the parameter that is of the amplitude correlation difference between the left and right channel signals of the current frame and that is obtained through amplitude limiting processing, and diff_lt_corr_map represents the parameter that is of the amplitude correlation difference between the left and right channel signals of the current frame and that is obtained through mapping processing:

$$\text{diff_lt_corr_limit} = \begin{cases} \text{RATIO_MAX}, & \text{if diff_lt_corr} > \text{RATIO_MAX} \\ \text{diff_lt_corr}, & \text{other} \\ -\text{RATIO_MAX}, & \text{if diff_lt_corr} < -\text{RATIO_MAX} \end{cases},$$

where RATIO_MAX represents a maximum amplitude of the parameter of the amplitude correlation difference between the left and right channel signals of the current frame, and −RATIO_MAX represents a minimum amplitude of the parameter of the amplitude correlation difference between the left and right channel signals of the current frame.

In a possible implementation:

$$\text{ratio_SM} = \frac{1 - \cos\left(\frac{\pi}{2} * \text{diff_lt_corr_map}\right)}{2},$$

where diff_lt_corr_map represents the parameter that is of the amplitude correlation difference between the left and right channel signals of the current frame and that is obtained through mapping processing, and ratio_SM represents the channel combination ratio factor corresponding to the anticorrelated signal channel combination scheme for the current frame, or ratio_SM represents the initial value of the channel combination ratio factor corresponding to the anticorrelated signal channel combination scheme for the current frame.

In some implementations of this application, when the channel combination ratio factor needs to be modified, the channel combination ratio factor may be modified before or after being encoded. Further, for example, the initial value of the channel combination ratio factor (for example, the channel combination ratio factor corresponding to the anticorrelated signal channel combination scheme or the channel combination ratio factor corresponding to the correlated signal channel combination scheme) of the current frame may be first calculated, then the initial value of the channel combination ratio factor is encoded to obtain an initial code index of the channel combination ratio factor of the current frame, and then the obtained initial code index of the channel combination ratio factor of the current frame is modified to obtain a code index of the channel combination ratio factor of the current frame (obtaining the code index of the channel combination ratio factor of the current frame is equivalent to obtaining the channel combination ratio factor of the current frame). Alternatively, the initial value of the channel combination ratio factor of the current frame may be first calculated, then the calculated initial value of the channel combination ratio factor of the current frame is modified to obtain the channel combination ratio factor of the current frame, and then the obtained channel combination ratio factor of the current frame is encoded to obtain a code index of the channel combination ratio factor of the current frame.

The initial value of the channel combination ratio factor corresponding to the anticorrelated signal channel combination scheme for the current frame may be modified in various manners. For example, when the initial value of the channel combination ratio factor corresponding to the anticorrelated signal channel combination scheme for the current frame needs to be modified to obtain the channel combination ratio factor corresponding to the anticorrelated signal channel combination scheme for the current frame, for example, the initial value of the channel combination ratio factor corresponding to the anticorrelated signal channel combination scheme for the current frame may be modified based on a channel combination ratio factor of the previous frame and the initial value of the channel combination ratio factor corresponding to the anticorrelated signal channel combination scheme for the current frame, or the initial value of the channel combination ratio factor corresponding to the anticorrelated signal channel combination scheme for the current frame may be modified based on the initial value of the channel combination ratio factor corresponding to the anticorrelated signal channel combination scheme for the current frame.

For example, first, it is determined whether the initial value of the channel combination ratio factor corresponding to the anticorrelated signal channel combination scheme for the current frame needs to be modified, based on the long-time smooth frame energy of the left channel signal of the current frame, the long-time smooth frame energy of the right channel signal of the current frame, an inter-frame energy difference of the left channel signal of the current frame, a cached encoding parameter (for example, an inter-frame correlation of a primary channel signal or an inter-frame correlation of a secondary channel signal) of the previous frame in a historical cache, channel combination scheme identifiers of the current frame and the previous frame, a channel combination ratio factor corresponding to an anticorrelated signal channel combination scheme for the previous frame, and the initial value of the channel combination ratio factor corresponding to the anticorrelated signal channel combination scheme for the current frame. If the initial value of the channel combination ratio factor corresponding to the anticorrelated signal channel combination scheme for the current frame needs to be modified, the channel combination ratio factor corresponding to the anticorrelated signal channel combination scheme for the previous frame is used as the channel combination ratio factor corresponding to the anticorrelated signal channel combination scheme for the current frame, otherwise, the initial value of the channel combination ratio factor corresponding to the anticorrelated signal channel combination scheme for the current frame is used as the channel combination ratio factor corresponding to the anticorrelated signal channel combination scheme for the current frame.

Certainly, a specific implementation of modifying the initial value of the channel combination ratio factor corresponding to the anticorrelated signal channel combination scheme for the current frame to obtain the channel combination ratio factor corresponding to the anticorrelated signal channel combination scheme for the current frame is not limited to the foregoing examples.

803. Encode the determined time-domain stereo parameter of the current frame.

In some possible implementations, quantization encoding is performed on the determined channel combination ratio factor corresponding to the anticorrelated signal channel combination scheme for the current frame, and:

$$\text{ratio_init_}SM_{qua}=\text{ratio_tabl_}SM[\text{ratio_idx_init_}SM],$$

where ratio_tabl_SM represents a codebook for scalar quantization of the channel combination ratio factor corresponding to the anticorrelated signal channel combination scheme for the current frame ratio_idx_init_SM represents the initial code index of the channel combination ratio factor corresponding to the anticorrelated signal channel combination scheme for the current frame, and ratio_init_$SM_{qua}$ represents an initial quantized code value of the channel combination ratio factor corresponding to the anticorrelated signal channel combination scheme for the current frame.

In a possible implementation:

$$\text{ratio_idx_}SM=\text{ratio_idx_init_}SM, \text{ and}$$

$$\text{ratio_}SM=\text{ratio_tabl}[\text{ratio_idx_}SM],$$

where ratio_SM represents the channel combination ratio factor corresponding to the correlated signal channel combination scheme for the current frame, and ratio_idx_SM represents the code index of the channel combination ratio factor corresponding to the anticorrelated signal channel combination scheme for the current frame, or $$\text{ratio_idx_}SM=\phi*\text{ratio_idx_init_}SM+(1-\phi)*\text{tdm_last_ratio_idx_}SM, \text{ and}$$

$$\text{ratio_}SM=\text{ratio_tabl}[\text{ratio_idx_}SM],$$

where ratio_idx_init_SM represents the initial code index corresponding to the anticorrelated signal channel combination scheme for the current frame tdm_last_ratio_idx_SM, represents a final code index of the channel combination ratio factor corresponding to the anticorrelated signal channel combination scheme for the previous frame, φ is a modification factor of the channel combination ratio factor corresponding to the anticorrelated signal channel combination scheme, and ratio_SM represents the channel combination ratio factor corresponding to the anticorrelated signal channel combination scheme for the previous frame.

In some possible implementations, when the initial value of the channel combination ratio factor corresponding to the anticorrelated signal channel combination scheme for the current frame needs to be modified to obtain the channel combination ratio factor corresponding to the anticorrelated signal channel combination scheme for the current frame, alternatively, quantization encoding may be first performed on the initial value of the channel combination ratio factor corresponding to the anticorrelated signal channel combination scheme for the current frame, to obtain the initial code index of the channel combination ratio factor corresponding to the anticorrelated signal channel combination scheme for the current frame, and then the initial code index of the channel combination ratio factor corresponding to the anticorrelated signal channel combination scheme for the current frame may be modified based on a code index of a channel combination ratio factor of the previous frame and the initial code index of the channel combination ratio factor corresponding to the anticorrelated signal channel combination scheme for the current frame, or the initial code index of the channel combination ratio factor corresponding to the anticorrelated signal channel combination scheme for the current frame may be modified based on the initial code index of the channel combination ratio factor corresponding to the anticorrelated signal channel combination scheme for the current frame.

For example, quantization encoding may be first performed on the initial value of the channel combination ratio factor corresponding to the anticorrelated signal channel combination scheme for the current frame, to obtain the initial code index corresponding to the anticorrelated signal channel combination scheme for the current frame. Then, when the initial value of the channel combination ratio factor corresponding to the anticorrelated signal channel combination scheme for the current frame needs to be modified, the code index of the channel combination ratio factor corresponding to the anticorrelated signal channel combination scheme for the previous frame is used as the code index of the channel combination ratio factor corresponding to the anticorrelated signal channel combination scheme for the current frame, otherwise, the initial code index of the channel combination ratio factor corresponding to the anticorrelated signal channel combination scheme for the current frame is used as the code index of the channel combination ratio factor corresponding to the anticorrelated signal channel combination scheme for the current frame. Finally, a quantized code value corresponding to the code index of the channel combination ratio factor corresponding to the anticorrelated signal channel combination scheme for the current frame is used as the channel combination ratio factor corresponding to the anticorrelated signal channel combination scheme for the current frame.

In addition, when the time-domain stereo parameter includes the inter-channel time difference, the determining a time-domain stereo parameter of the current frame based on the channel combination scheme for the current frame may include calculating the inter-channel time difference of the current frame when the channel combination scheme for the current frame is the correlated signal channel combination scheme. In addition, the calculated inter-channel time difference of the current frame may be written into the bitstream. When the channel combination scheme for the current frame is the anticorrelated signal channel combination scheme, a default inter-channel time difference (for example, 0) is used as the inter-channel time difference of the current frame. In addition, the default inter-channel time difference may not be written into the bitstream, and a decoding apparatus may also use a default inter-channel time difference.

In addition, in some other possible implementations, if the channel combination scheme for the current frame is different from the channel combination scheme for the previous frame (for example, a channel combination scheme identifier of the current frame is different from a channel combination scheme identifier of the previous frame), a value of the channel combination ratio factor of the current frame may also be set to a value of the channel combination ratio factor of the previous frame, otherwise, the channel combination ratio factor of the current frame may be extracted and encoded based on the channel combination scheme and the left and right channel signals obtained through delay alignment and according to a method corresponding to the channel combination scheme for the current frame.

The following further provides a method for encoding a time-domain stereo parameter as an example. For example, the method may include determining a channel combination scheme for a current frame, determining a time-domain stereo parameter of the current frame based on the channel combination scheme for the current frame, and encoding the determined time-domain stereo parameter of the current frame, where the time-domain stereo parameter includes at least one of a channel combination ratio factor and an inter-channel time difference.

Correspondingly, a decoding apparatus may obtain the time-domain stereo parameter of the current frame from a bitstream, and further perform related decoding based on the time-domain stereo parameter that is of the current frame and that is obtained from the bitstream.

The following provides descriptions using examples with reference to one or more specific application scenarios.

Figure 9A:
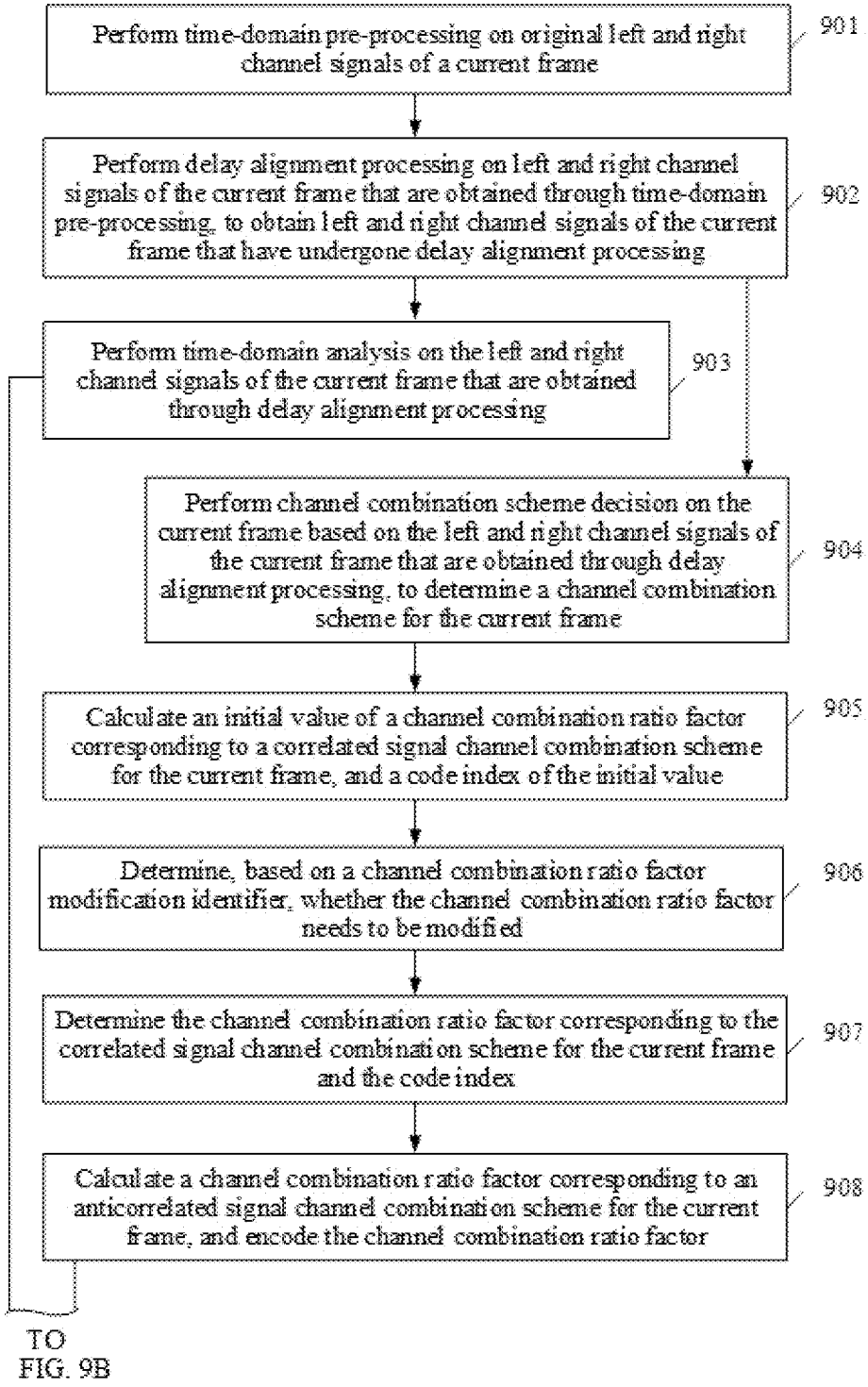
FIG. 9A and FIG. 9B are a schematic flowchart of another audio encoding method according to an embodiment of this application.
Figure 9B:
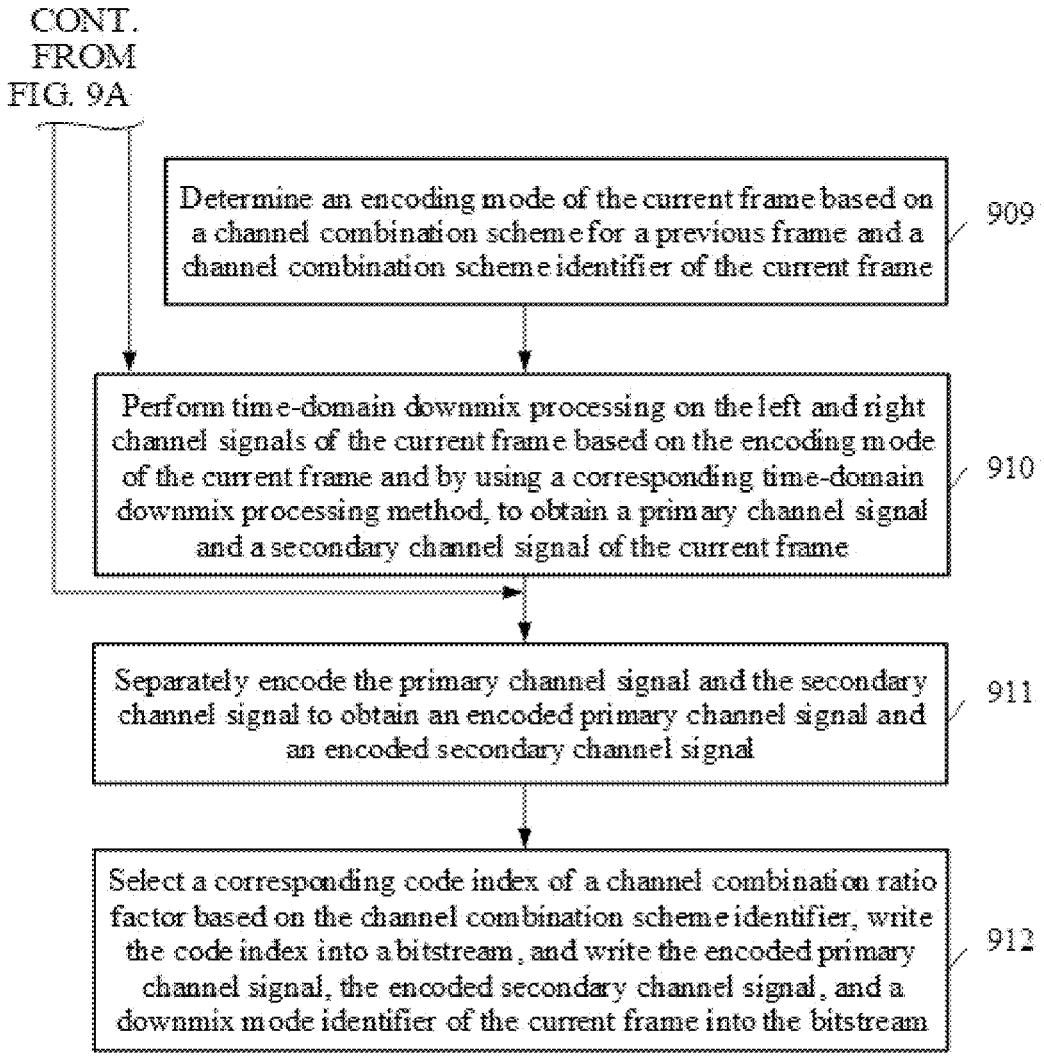

FIG. 9A and FIG. 9B are a schematic flowchart of an audio encoding method according to an embodiment of this application. The audio encoding method provided in this embodiment of this application may be implemented by an encoding apparatus. The method may include the following steps.

901. Perform time-domain pre-processing on original left and right channel signals of a current frame.

For example, if a sampling rate of a stereo audio signal is 16 kilohertz (kHz), a frame of signal is 20 milliseconds (ms), and a frame length is denoted as N, when N=320, it represents that the frame length is 320 sampling points. A stereo signal of the current frame includes a left channel signal of the current frame and a right channel signal of the current frame. The original left channel signal of the current frame is denoted as $x_L(n)$, and the original right channel signal of the current frame is denoted as $x_R(n)$. n is a sequence number of a sampling point, and n=0, 1, . . . , N−1.

For example, the performing time-domain pre-processing on original left and right channel signals of a current frame may include performing high-pass filtering processing on the original left and right channel signals of the current frame to obtain left and right channels signals of the current frame that have undergone time-domain pre-processing, where a left channel signal that is of the current frame and that is obtained through time-domain pre-processing is denoted as $x_{L_HP}(n)$, and a right channel signal that is of the current frame and that is obtained through time-domain pre-processing is denoted as $x_{R_HP}(n)$. n is a sequence number of a sampling point, and n=0, 1, . . . , N−1. A filter used for the high-pass filtering processing may be, for example, an infinite impulse response IIR) filter with a cut-off frequency of 20 hertz (Hz), or another type of filter may be used.

For example, the sampling rate is 16 kHz, and a transfer function for a corresponding high-pass filter with a cut-off frequency of 20 Hz may be as follows:

$$H_{20Hz}(z) = \frac{b_0 + b_1 z^{-1} + b_2 z^{-2}}{1 + a_1 z^{-1} + a_2 z^{-2}},$$

where $b_0$=0.994461788958195, $b_1$=−1.988923577916390, $b_2$=0.994461788958195, $a_1$=1.988892905899653, $a_2$=−0.988954249933127, and z is a transformation factor for transformation of Z.

A transfer function for a corresponding time-domain filter may be expressed as follows:

$$x_{L_HP}(n)=b_0*x_L(n)+b_1*x_L(n-1)+b_2*x_L(n-2)-a_1*x_{L_HP}(n-1)-a_2*x_{L_HP}(n-2), \text{ and}$$

$$x_{R_HP}(n)=b_0*x_R(n)+b_1*x_R(n-1)+b_2*x_R(n-2)-a_1*x_{R_HP}(n-1)-a_2*x_{R_HP}(n-2).$$

902. Perform delay alignment processing on the left and right channel signals of the current frame that are obtained through time-domain pre-processing, to obtain left and right channel signals of the current frame that have undergone delay alignment processing.

A signal that is obtained through delay alignment processing may be referred to as a "delay-aligned signal". For example, a left channel signal that is obtained through delay alignment processing may be referred to as a "delay-aligned left channel signal", a right channel signal that is obtained through delay alignment processing may be referred to as a "delay-aligned right channel signal", and so on.

Further, an inter-channel delay parameter may be extracted based on the pre-processed left and right channel signals of the current frame and encoded, and delay alignment processing is performed on the left and right channel signals based on an encoded inter-channel delay parameter to obtain the left and right channel signals of the current frame that have undergone delay alignment processing. The left channel signal that is of the current frame and that is obtained through delay alignment processing is denoted as $x_L'(n)$, and the right channel signal that is of the current frame and that is obtained through delay alignment processing is denoted as $x_R'(n)$. n is a sequence number of a sampling point, and n=0, 1, . . . , N−1.

Further, for example, the encoding apparatus may calculate a time-domain cross-correlation function between left and right channels based on the pre-processed left and right channel signals of the current frame. A maximum value (or another value) of the time-domain cross-correlation function between the left and right channels may be searched for, to determine a time difference between the left and right channel signals. Quantization encoding is performed on the determined time difference between the left and right channels. Using a signal of one channel selected from the left and right channels as a reference, delay adjustment is performed on a signal of the other channel based on a time difference between the left and right channels that is obtained through quantization encoding, to obtain the left and right channel signals of the current frame that have undergone delay alignment processing.

It should be noted that the delay alignment processing may be implemented using a plurality of methods, and a specific delay alignment processing method is not limited in this embodiment of this application.

903. Perform time-domain analysis on the left and right channel signals of the current frame that are obtained through delay alignment processing.

Further, the time-domain analysis may include transient detection and the like. The transient detection may be separately performing energy detection on the left and right channel signals of the current frame that are obtained through delay alignment processing (whether the current frame undergoes a sudden change of energy may be detected). For example, energy of the left channel signal that is of the current frame and that is obtained through delay alignment processing is represented as $E_{cur_L}$, and energy of a left channel signal that is of a previous frame and that is obtained through delay alignment is represented as $E_{pre_L}$, in this case, transient detection may be performed based on an absolute value of a difference between $E_{pre_L}$ and $E_{cur_L}$, to obtain a transient detection result of the left channel signal that is of the current frame and that is obtained through delay alignment processing. Likewise, transient detection may be performed, using the same method, on the right channel signal that is of the current frame and that is obtained through delay alignment processing. The time-domain analysis may also include time-domain analysis in another conventional manner other than the transient detection, for example, may include band extension pre-processing.

It can be understood that step 903 may be performed in any location after step 902 and before a primary channel signal and a secondary channel signal of the current frame are encoded.

904. Perform channel combination scheme decision on the current frame based on the left and right channel signals of the current frame that are obtained through delay alignment processing, to determine a channel combination scheme for the current frame.

In this embodiment, two possible channel combination schemes are used as examples, and are referred to as a correlated signal channel combination scheme and an anticorrelated signal channel combination scheme in the following descriptions. In this embodiment, the correlated signal channel combination scheme corresponds to a case in which the left and right channel signals (obtained through delay alignment) of the current frame constitute a near in phase signal, and the anticorrelated signal channel combination scheme corresponds to a case in which the left and right channel signals (obtained through delay alignment) of the current frame form a near out of phase signal. Certainly, in addition to using the "correlated signal channel combination scheme" and the "anticorrelated signal channel combination scheme" to represent the two possible channel combination schemes, other names may also be used to name the two different channel combination schemes in actual application.

In some solutions of this embodiment, the channel combination scheme decision may be classified into initial channel combination scheme decision and channel combination scheme modification decision. It can be understood that the channel combination scheme decision is performed on the current frame to determine the channel combination scheme for the current frame. For some example implementations of determining the channel combination scheme for the current frame, refer to related descriptions in the foregoing embodiments. Details are not described herein again.

905. Calculate, based on the left and right channel signals of the current frame that are obtained through delay alignment processing and a channel combination scheme identifier of the current frame, a channel combination ratio factor corresponding to the correlated signal channel combination scheme for the current frame, and encode the channel combination ratio factor, to obtain an initial value of the channel combination ratio factor corresponding to the correlated signal channel combination scheme for the current frame and a code index of the initial value.

Further, for example, first, frame energy of the left and right channel signals of the current frame is calculated based on the left and right channel signals of the current frame that are obtained through delay alignment processing.

Frame energy rms_L of the left channel signal of the current frame satisfies the following formula:

$$\text{rms_L} = \frac{1}{N}\sum_{n=0}^{N-1} x'_L(n) * x'_L(n),$$

and frame energy rms_R of the right channel signal of the current frame satisfies the following formula:

$$\text{rms_R} = \frac{1}{N}\sum_{n=0}^{N-1} x'_R(n) * x'_R(n),$$

where $x_L'(n)$ represents the left channel signal that is of the current frame and that is obtained through delay alignment processing, and $x_R(n)$ represents the right channel signal that is of the current frame and that is obtained through delay alignment processing.

Then the channel combination ratio factor corresponding to the correlated signal channel combination scheme for the current frame is calculated based on the frame energy of the left channel of the current frame and the frame energy of the right channel of the current frame. The calculated channel combination ratio factor ratio_init corresponding to the correlated signal channel combination scheme for the current frame satisfies the following formula:

$$\text{ratio_init} = \frac{\text{rms_R}}{\text{rms_L} + \text{rms_R}}.$$

Then quantization encoding is performed on the calculated channel combination ratio factor ratio_init corresponding to the correlated signal channel combination scheme for the current frame, to obtain a corresponding code index ratio_idx_init and a channel combination ratio factor ratio_$\text{init}_{qua}$ that corresponds to the correlated signal channel combination scheme for the current frame and that is obtained through quantization encoding:

$$\text{ratio_init}_{qua}=\text{ratio_tabl[ratio_idx_init]},$$

where ratio_tabl is a codebook for scalar quantization, any conventional scalar quantization method may be used for the quantization encoding, for example, uniform scalar quantization or non-uniform scalar quantization may be used, a quantity of coded bits is, for example, 5 bits, and a specific scalar quantization method is not described in detail herein.

The channel combination $\text{ratio_init}_{qua}$ that corresponds to the correlated signal channel combination scheme for the current frame and that is obtained through quantization encoding is the obtained initial value of the channel combination ratio factor corresponding to the correlated signal channel combination scheme for the current frame. The code index ratio_idx_int is the code index corresponding to the initial value of the channel combination ratio factor corresponding to the correlated signal channel combination scheme for the current frame.

In addition, the code index corresponding to the initial value of the channel combination ratio factor corresponding to the correlated signal channel combination scheme for the current frame may be further modified based on a value of the channel combination scheme identifier tdm_SM_flag of the current frame.

For example, the quantization encoding is 5-bit scalar quantization. In this case, when tdm_SM_flag=1, the code index ratio_idx_init corresponding to the initial value of the channel combination ratio factor corresponding to the correlated signal channel combination scheme for the current frame is modified into a preset value (for example, 15 or another value). In addition, the initial value of the channel combination ratio factor corresponding to the correlated signal channel combination scheme for the current frame may be modified as follows: $\text{ratio_init}_{qua}$=ratio_tabl[15].

It should be noted that in addition to the foregoing calculation methods, the channel combination ratio factor corresponding to the correlated signal channel combination scheme for the current frame may be alternatively calculated according to any method that is in a conventional time-domain stereo encoding technology and that is used for calculating a channel combination ratio factor corresponding to a channel combination scheme. Alternatively, the initial value of the channel combination ratio factor corresponding to the correlated signal channel combination scheme for the current frame may be directly set to a fixed value (for example, 0.5 or another value).

906. Determine, based on a channel combination ratio factor modification identifier, whether the channel combination ratio factor needs to be modified.

If the channel combination ratio factor needs to be modified, the channel combination ratio factor corresponding to the correlated signal channel combination scheme for the current frame and the code index of the channel combination ratio factor are modified, to obtain a modified value of the channel combination ratio factor corresponding to the correlated signal channel combination scheme for the current frame and a code index of the modified value.

The channel combination ratio factor modification identifier of the current frame is denoted as tdm_SM_modi_flag. For example, when a value of the channel combination ratio factor modification identifier is 0, the channel combination ratio factor does not need to be modified, or when a value of the channel combination ratio factor modification identifier is 1, the channel combination ratio factor needs to be modified. Certainly, another different value of the channel combination ratio factor modification identifier may be alternatively used to indicate whether the channel combination ratio factor needs to be modified.

For example, the determining, based on a channel combination ratio factor modification identifier, whether the channel combination ratio factor needs to be modified may include for example, if the channel combination ratio factor modification identifier is tdm_SM_modi_flag=1, determining that the channel combination ratio factor needs to be modified, or for another example, if the channel combination ratio factor modification identifier is tdm_SM_modi_flag=0, determining that the channel combination ratio factor does not need to be modified.

The modifying the channel combination ratio factor corresponding to the correlated signal channel combination scheme for the current frame and the code index of the channel combination ratio factor may include for example, the code index corresponding to the modified value of the channel combination ratio factor corresponding to the correlated signal channel combination scheme for the current frame satisfies ratio_idx_mod=0.5*(tdm_last_ratio_idx+16), where tdm_last_ratio_idx is a code index of a channel combination ratio factor corresponding to a correlated signal channel combination scheme for the previous frame, and in this case, the modified value $ratio_mod_{qua}$ of the channel combination ratio factor corresponding to the correlated signal channel combination scheme for the current frame satisfies $ratio_mod_{qua}$=ratio_tabl[ratio_idx_mod].

907. Determine the channel combination ratio factor ratio corresponding to the correlated signal channel combination scheme for the current frame and the code index ratio_idx, based on the initial value of the channel combination ratio factor corresponding to the correlated signal channel combination scheme for the current frame, the code index of the initial value, the modified value of the channel combination ratio factor corresponding to the correlated signal channel combination scheme for the current frame, the code index of the modified value, and the channel combination ratio factor modification identifier.

Further, for example, the determined channel combination ratio factor ratio corresponding to the correlated signal channel combination scheme satisfies the following formula:

$$ratio = \begin{cases} ratio_init_{qua}, & \text{if } tdm_SM_modi_flag = 0 \\ ratio_mod_{qua}, & \text{if } tdm_SM_modi_flag = 1 \end{cases},$$

where $ratio_init_{qua}$ represents the initial value of the channel combination ratio factor corresponding to the correlated signal channel combination scheme for the current frame, $ratio_mod_{qua}$ represents the modified value of the channel combination ratio factor corresponding to the correlated signal channel combination scheme for the current frame, and tdm_SM_modi_flag represents the channel combination ratio factor modification identifier of the current frame.

The determined code index ratio_idx corresponding to the channel combination ratio factor corresponding to the correlated signal channel combination scheme satisfies the following formula:

$$ratio_idx = \begin{cases} ratio_idx_init, & \text{if } tdm_SM_modi_flag = 0 \\ ratio_idx_mod, & \text{if } tdm_SM_modi_flag = 1 \end{cases},$$

where ratio_idx_init represents the code index corresponding to the initial value of the channel combination ratio factor corresponding to the correlated signal channel combination scheme for the current frame, and ratio_idx_mod represents the code index corresponding to the modified value of the channel combination ratio factor corresponding to the correlated signal channel combination scheme for the current frame.

908. Determine whether the channel combination scheme identifier of the current frame corresponds to the anticorrelated signal channel combination scheme, and if the channel combination scheme identifier of the current frame corresponds to the anticorrelated signal channel combination scheme, calculate a channel combination ratio factor corresponding to the anticorrelated signal channel combination scheme for the current frame, and encode the channel combination ratio factor, to obtain the channel combination ratio factor corresponding to the anticorrelated signal channel combination scheme and a code index of the channel combination ratio factor.

First, it may be determined whether a historical cache used for calculating the channel combination ratio factor corresponding to the anticorrelated signal channel combination scheme for the current frame needs to be reset.

For example, if the channel combination scheme identifier tdm_SM_flag of the current frame is equal to 1 (for example, that tdm_SM_flag is equal to 1 indicates that the channel combination scheme identifier of the current frame corresponds to the anticorrelated signal channel combination scheme) and a channel combination scheme identifier tdm_last_SM_flag of the previous frame is equal to 0 (for example, that tdm_last_SM_flag is equal to 0 indicates that the channel combination scheme identifier of the previous frame corresponds to the correlated signal channel combination scheme), the historical cache used for calculating the channel combination ratio factor corresponding to the anticorrelated signal channel combination scheme for the current frame needs to be reset.

It should be noted that determining whether a historical cache used for calculating the channel combination ratio factor corresponding to the anticorrelated signal channel combination scheme for the current frame needs to be reset may be alternatively implemented by determining a historical cache reset identifier tdm_SM_reset_flag during the initial channel combination scheme decision and the channel combination scheme modification decision and then determining a value of the historical cache reset identifier. For example, when tdm_SM_reset_flag is 1, the channel combination scheme identifier of the current frame corresponds to the anticorrelated signal channel combination scheme and the channel combination scheme identifier of the previous frame corresponds to the correlated signal channel combination scheme. For example, when the historical cache reset identifier tdm_SM_reset_flag is equal to 1, the historical cache used for calculating the channel combination ratio factor corresponding to the anticorrelated signal channel combination scheme for the current frame needs to be reset. There are a plurality of specific reset methods. All parameters in the historical cache used for calculating the channel combination ratio factor corresponding to the anticorrelated signal channel combination scheme for the current frame may be reset based on a preset initial value, or some parameters in the historical cache used for calculating the channel combination ratio factor corresponding to the anticorrelated signal channel combination scheme for the current frame may be reset based on a preset initial value, or some parameters in the historical cache used for calculating the channel combination ratio factor corresponding to the anticorrelated signal channel combination scheme for the current frame may be reset based on a preset initial value, and other parameters are reset based on a corresponding parameter value in a historical cache used for calculating the channel combination ratio factor corresponding to the correlated signal channel combination scheme.

Next, it is further determined whether the channel combination scheme identifier tdm_SM_flag of the current frame corresponds to the anticorrelated signal channel combination scheme. The anticorrelated signal channel combination scheme is a channel combination scheme that is more suitable for performing time-domain downmixing on a near out of phase stereo signal. In this embodiment, when the channel combination scheme identifier of the current frame is tdm_SM_flag=1, the channel combination scheme identifier of the current frame corresponds to the anticorrelated signal channel combination scheme, or when the channel combination scheme identifier of the current frame is tdm_SM_flag=0, the channel combination scheme identifier of the current frame corresponds to the correlated signal channel combination scheme.

Determining whether the channel combination scheme identifier of the current frame corresponds to the anticorrelated signal channel combination scheme may include determining whether the channel combination scheme identifier of the current frame is 1, where if the channel combination scheme identifier of the current frame is tdm_SM_flag=1, the channel combination scheme identifier of the current frame corresponds to the anticorrelated signal channel combination scheme, and in this case, the channel combination ratio factor corresponding to the anticorrelated signal channel combination scheme for the current frame may be calculated and encoded.

Figure 9C:
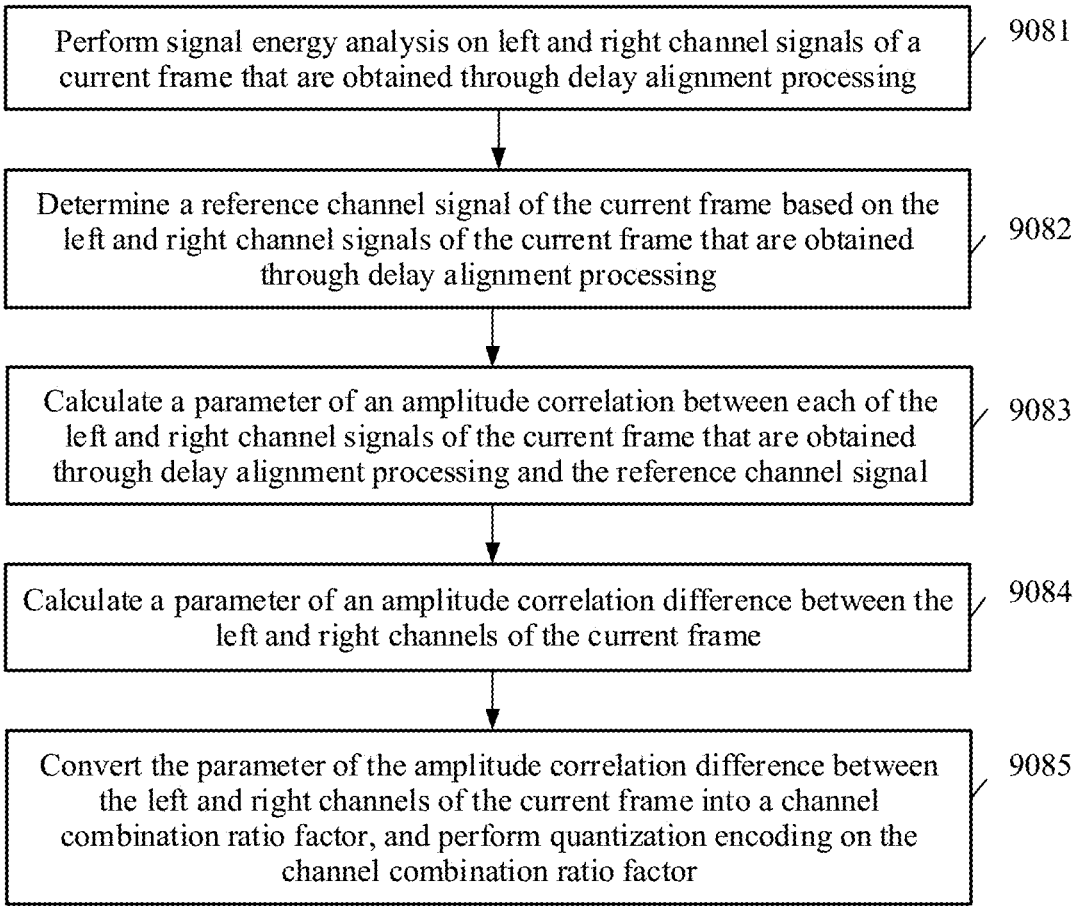
FIG. 9C is a schematic flowchart of a method for calculating a channel combination ratio factor corresponding to an anticorrelated signal channel combination scheme for a current frame and performing encoding according to an embodiment of this application.

Referring to FIG. 9C, the calculating and encoding the channel combination ratio factor corresponding to the anticorrelated signal channel combination scheme for the current frame, for example, may include the following steps 9081 to 9085.

9081. Perform signal energy analysis on the left and right channel signals of the current frame that are obtained through delay alignment processing.

The frame energy of the left channel signal of the current frame, the frame energy of the right channel signal of the current frame, long-time smooth frame energy of the left channel of the current frame, long-time smooth frame energy of the right channel of the current frame, an inter-frame energy difference of the left channel of the current frame, and an inter-frame energy difference of the right channel of the current frame are separately obtained.

For example, the frame energy rms_L of the left channel signal of the current frame satisfies the following formula:

$$\text{rms_L} = \frac{1}{N}\sum_{n=0}^{N-1} x'_L(n) * x'_L(n),$$

and the frame energy rms_R the right channel signal of the current frame satisfies the following formula:

$$\text{rms_R} = \frac{1}{N}\sum_{n=0}^{N-1} x'_R(n) * x'_R(n),$$

where $x_L'(n)$ represents the left channel signal that is of the current frame and that is obtained through delay alignment processing, and $x_R'(n)$ represents the right channel signal that is of the current frame and that is obtained through delay alignment processing.

For example, the long-time smooth frame energy tdm_lt_rms_L_$SM_{cur}$ of the left channel of the current frame satisfies the following formula:

$$\text{tdm_lt_rms_}L_SM_{cur}=(1-A)*\text{tdm_lt_rms_}L_SM_{pre}+A*\text{rms_}L,$$

where tdm_lt_rms_L_$SM_{pre}$ represents long-time smooth frame energy of a left channel of the previous frame, and A represents an update factor of the long-time smooth frame energy of the left channel, where A may be, for example, a real number between 0 and 1, for example, A may be equal to 0.4.

For example, the long-time smooth frame energy tdm_lt_rms_R_$SM_{cur}$ of the right channel of the current frame satisfies the following formula:

$$\text{tdm_lt_rms_}R_SM_{cur}=(1-B)*\text{tdm_lt_rms_}R_SM_{pre}+B*\text{rms_}R,$$

where tdm_lt_rms_R_$SM_{pre}$ represents long-time smooth frame energy of a right channel of the previous frame, and B represents an update factor of the long-time smooth frame energy of the right channel, where B may be, for example, a real number between 0 and 1, and a value of B may be, for example, equal to or different from a value of the update factor of the long-time smooth frame energy of the left channel, for example, B may also be equal to 0.4.

For example, the inter-frame energy difference ever_L_dt of the left channel of the current frame satisfies the following formula:

$$\text{ener_}L\text{_dt}=\text{tdm_lt_rms_}L_SM_{cur}-\text{tdm_lt_rms_}L_SM_{pre}.$$

For example, the inter-frame energy difference ever_R_dt of the right channel of the current frame satisfies the following formula:

$$\text{ener_}R\text{_dt}=\text{tdm_lt_rms_}R_SM_{cur}-\text{tdm_lt_rms_}R_SM_{pre}.$$

9082. Determine a reference channel signal of the current frame based on the left and right channel signals of the current frame that are obtained through delay alignment processing, where the reference channel signal may also be referred to as a mono signal, and if the reference channel signal is referred to as a mono signal, in all subsequent descriptions and parameter names that are related to a reference channel, a reference channel signal may be collectively replaced with a mono signal.

For example, the reference channel signal mono_i(n) satisfies the following formula:

$$\text{mono_i}\,(n) = \frac{x'_L(n) - x'_R(n)}{2},$$

where $x_L'(n)$ is the left channel signal that is of the current frame and that is obtained through delay alignment processing, and $x_n'(n)$ is the right channel signal that is of the current frame and that is obtained through delay alignment processing.

9083. Calculate a parameter of an amplitude correlation between each of the left and right channel signals of the current frame that are obtained through delay alignment processing and the reference channel signal.

For example, a parameter corr_LM of an amplitude correlation between the reference channel signal and the left channel signal that is of the current frame and that is obtained through delay alignment processing satisfies the following formula:

$$\text{corr_LM} = \frac{\sum_{n=0}^{N-1} |x'_L(n)| * |\text{mono_i}(n)|}{\sum_{n=0}^{N-1} |\text{mono_i}(n)| * |\text{mono_i}(n)|},$$

and for example, a parameter corr_RM of an amplitude correlation between the reference channel signal and the right channel signal that is of the current frame and that is obtained through delay alignment processing satisfies the following formula:

$$\text{corr_RM} = \frac{\sum_{n=0}^{N-1} |x'_R(n)| * |\text{mono_i}(n)|}{\sum_{n=0}^{N-1} |\text{mono_i}(n)| * |\text{mono_i}(n)|},$$

where $x_L'(n)$ represents the left channel signal that is of the current frame and that is obtained through delay alignment processing, $x_n'(n)$ represents the right channel signal that is of the current frame and that is obtained through delay alignment processing, mono_i(n) represents the reference channel signal of the current frame, and |•| represents taking an absolute value.

9084. Calculate a parameter diff_lt_corr of an amplitude correlation difference between the left and right channels of the current frame based on the parameter of the amplitude correlation between the reference channel signal and the left channel signal that is of the current frame and that is obtained through delay alignment processing, and the parameter of the amplitude correlation between the reference channel signal and the right channel signal that is of the current frame and that is obtained through delay alignment processing.

It can be understood that, step 9081 may be performed before steps 9082 and 9083, or may be performed after steps 9082 and 9083 and before step 9084.

Figure 9D:
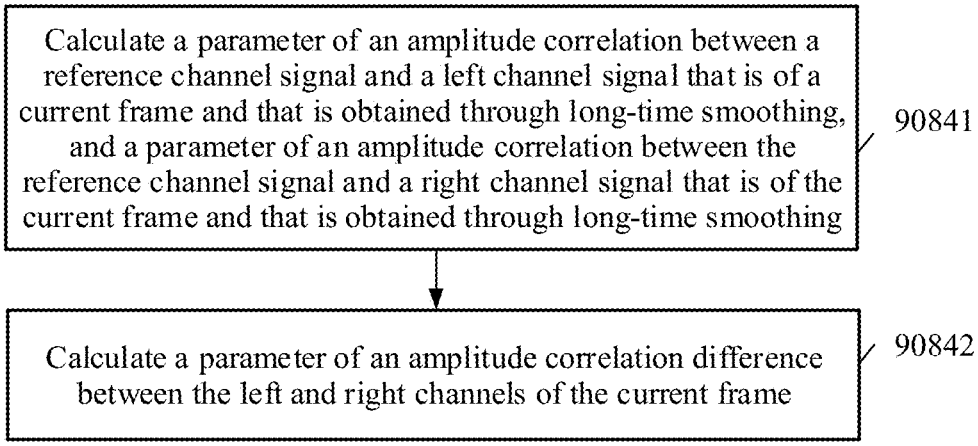
FIG. 9D is a schematic flowchart of a method for calculating a parameter of an amplitude correlation difference between left and right channels of a current frame according to an embodiment of this application.

Referring to FIG. 9D, for example, the calculating a parameter diff_lt_corr of an amplitude correlation difference between the left and right channels of the current frame may further include the following steps 90841 and 90842.

90841. Calculate, based on the parameter of the amplitude correlation between the reference channel signal and the left channel signal that is of the current frame and that is obtained through delay alignment processing, a parameter of an amplitude correlation between the reference channel signal and a left channel signal that is of the current frame and that is obtained through long-time smoothing, and calculate, based on the parameter of the amplitude correlation between the reference channel signal and the right channel signal that is of the current frame and that is obtained through delay alignment processing, a parameter of an amplitude correlation between the reference channel signal and a right channel signal that is of the current frame and that is obtained through long-time smoothing.

For example, the calculating a parameter of an amplitude correlation between the reference channel signal and a left channel signal that is of the current frame and that is obtained through long-time smoothing, and a parameter of an amplitude correlation between the reference channel signal and a right channel signal that is of the current frame and that is obtained through long-time smoothing may include the parameter tdm_lt_corr_LM_SM of the amplitude correlation between the reference channel signal and the left channel signal that is of the current frame and that is obtained through long-time smoothing satisfies the following formula:

$$\text{tdm_lt_corr_}LM_SM_{cur} = \alpha * \text{tdm_lt_corr_}LM_SM_{pre} + (1-\alpha)\text{corr_}LM,$$

where $\text{tdm_lt_corr_LM_SM}_{cur}$ represents the parameter of the amplitude correlation between the reference channel signal and the left channel signal that is of the current frame and that is obtained through long-time smoothing, $\text{tdm_lt_corr_LM_SM}_{pre}$ represents a parameter of an amplitude correlation between a reference channel signal and a left channel signal that is of the previous frame and that is obtained through long-time smoothing, a represents a left channel smoothing factor, and a may be a preset real number between 0 and 1, for example, 0.2, 0.5, or 0.8, or a value of a may be obtained through adaptive calculation, and for example, the parameter tdm_lt_corr_RM_SM of the amplitude correlation between the reference channel signal and the right channel signal that is of the current frame and that is obtained through long-time smoothing satisfies the following formula:

$$\text{tdm_lt_corr_}RM_SM_{cur} = \beta * \text{tdm_lt_corr_}RM_SM_{pre} + (1-\beta)\text{corr_}LM,$$

where $\text{tdm_lt_corr_RM_SM}_{cur}$ represents the parameter of the amplitude correlation between the reference channel signal and the right channel signal that is of the current frame and that is obtained through long-time smoothing, $\text{tdm_lt_corr_RM_SM}_{pre}$ represents a parameter of an amplitude correlation between the reference channel signal and a right channel signal that is of the previous frame and that is obtained through long-time smoothing, β represents a right channel smoothing factor, β may be a preset real number between 0 and 1, and β may be equal to or different from the value of the left channel smoothing factor α, for example, β may be equal to 0.2, 0.5, or 0.8, or a value of β may be obtained through adaptive calculation.

Another method for calculating a parameter of an amplitude correlation between the reference channel signal and a left channel signal that is of the current frame and that is obtained through long-time smoothing, and a parameter of an amplitude correlation between the reference channel signal and a right channel signal that is of the current frame and that is obtained through long-time smoothing may include the following steps.

First, modify the parameter corr_LM of the amplitude correlation between the reference channel signal and the left channel signal that is of the current frame and that is obtained through delay alignment processing, to obtain a modified parameter corr_LM_mod of the amplitude correlation between the left channel signal of the current frame and the reference channel signal, and modify the parameter corr_RM_mod of the amplitude correlation between the reference channel signal and the right channel signal that is of the current frame and that is obtained through delay alignment processing, to obtain a modified parameter corr_RM_mod of the amplitude correlation between the right channel signal of the current frame and the reference channel signal.

Then, determine a parameter diff_lt_corr_LM_tmp of an amplitude correlation between the reference channel signal and the left channel signal that is of the current frame and that is obtained through long-time smoothing, and a parameter diff_lt_corr_RM_tmp of an amplitude correlation between the reference channel signal and the right channel signal that is of the current frame and that is obtained through long-time smoothing, based on the modified parameter corr_LM_mod of the amplitude correlation between the left channel signal of the current frame and the reference channel signal, the modified parameter corr_RM_mod of the amplitude correlation between the right channel signal of the current frame and the reference channel signal, a parameter $\text{tdm_lt_corr_LM_SM}_{pre}$ of an amplitude correlation between a reference channel signal and a left channel signal that is of the previous frame and that is obtained through long-time smoothing, and a parameter $\text{tdm_lt_corr_RM_SM}_{pre}$ of an amplitude correlation between the reference channel signal and a right channel signal that is of the previous frame and that is obtained through long-time smoothing.

Next, obtain an initial value diff_lt_corr_SM of a parameter of an amplitude correlation difference between the left and right channels of the current frame based on the parameter diff_lt_corr_LM_tmp of the amplitude correlation between the reference channel signal and the left channel signal that is of the current frame and that is obtained through long-time smoothing, and the parameter diff_lt_corr_RM_tmp of the amplitude correlation between the reference channel signal and the right channel signal that is of the current frame and that is obtained through long-time smoothing, and determine an inter-frame change parameter d_lt_corr of the amplitude correlation difference between the left and right channels of the current frame based on the obtained initial value diff_lt_corr_SM of the parameter of the amplitude correlation difference between the left and right channels of the current frame, and a parameter tdm_last_diff_lt_corr_SM of an amplitude correlation difference between the left and right channels of the previous frame.

Finally, based on the inter-frame change parameter of the amplitude correlation difference between the left and right channels of the current frame, and the frame energy of the left channel signal of the current frame, the frame energy of the right channel signal of the current frame, the long-time smooth frame energy of the left channel of the current frame, the long-time smooth frame energy of the right channel of the current frame, the inter-frame energy difference of the left channel of the current frame, and the inter-frame energy difference of the right channel of the current frame, that are obtained through signal energy analysis, adaptively select different left channel smoothing factors and right channel smoothing factors, and calculate the parameter tdm_lt_corr_LM_SM of the amplitude correlation between the reference channel signal and the left channel signal that is of the current frame and that is obtained through long-time smoothing, and the parameter tdm_lt_corr_RM_SM of the amplitude correlation between the reference channel signal and the right channel signal that is of the current frame and that is obtained through long-time smoothing.

In addition to the foregoing two example methods, there may be many other methods for calculating a parameter of an amplitude correlation between the reference channel signal and a left channel signal that is of the current frame and that is obtained through long-time smoothing, and a parameter of an amplitude correlation between the reference channel signal and a right channel signal that is of the current frame and that is obtained through long-time smoothing. This is not limited in this application.

90842. Calculate the parameter diff_lt_corr of the amplitude correlation difference between the left and right channels of the current frame based on the parameter of the amplitude correlation between the reference channel signal and the left channel signal that is of the current frame and that is obtained through long-time smoothing, and the parameter of the amplitude correlation between the reference channel signal and the right channel signal that is of the current frame and that is obtained through long-time smoothing.

For example, the parameter diff_lt_corr of the amplitude correlation difference between the left and right channels of the current frame satisfies the following formula:

$$\text{diff_lt_corr}=\text{tdm_lt_corr}_LM_SM-\text{tdm_lt_corr}_RM_SM,$$

where tdm_lt_corr_LM_SM represents the parameter of the amplitude correlation between the reference channel signal and the left channel signal that is of the current frame and that is obtained through long-time smoothing, and tdm_lt_corr_RM_SM represents the parameter of the amplitude correlation between the reference channel signal and the right channel signal that is of the current frame and that is obtained through long-time smoothing.

9085. Convert the parameter diff_lt_corr of the amplitude correlation difference between the left and right channels of the current frame into a channel combination ratio factor, and perform quantization encoding on the channel combination ratio factor, to determine the channel combination ratio factor corresponding to the anticorrelated signal channel combination scheme for the current frame and a code index of the channel combination ratio factor.

Figure 9E:
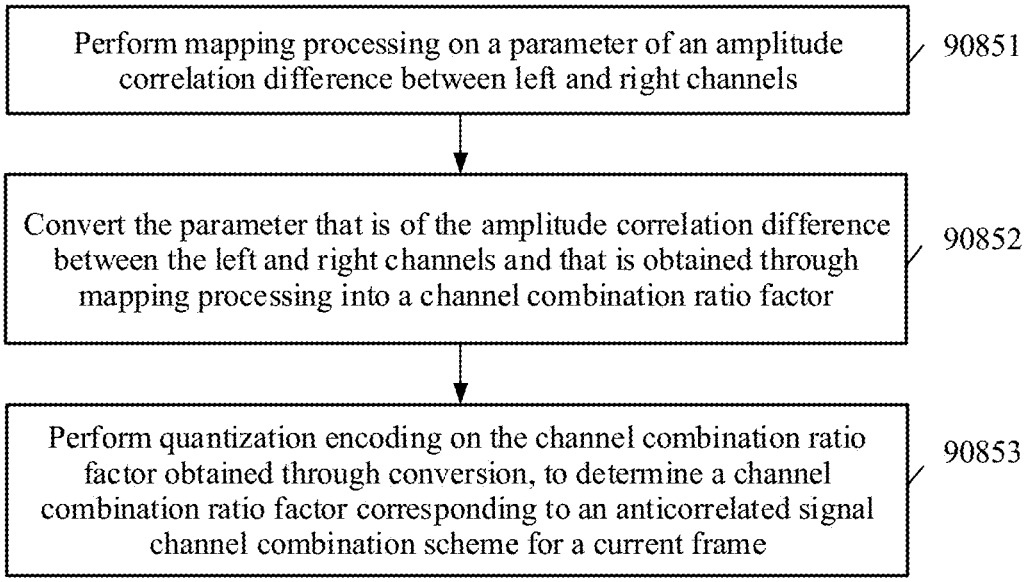
FIG. 9E is a schematic flowchart of a method for converting a parameter of an amplitude correlation difference between left and right channels of a current frame into a channel combination ratio factor according to an embodiment of this application.

Referring to FIG. 9E, a possible method for converting the parameter of the amplitude correlation difference between the left and right channels of the current frame into a channel combination ratio factor may further include steps 90851 to 90853.

90851. Perform mapping processing on the parameter of the amplitude correlation difference between the left and right channels such that a value range of a parameter that is of the amplitude correlation difference between the left and right channels and that is obtained through mapping processing is [MAP_MIN, MAP_MAX].

A method for performing mapping processing on the parameter of the amplitude correlation difference between the left and right channels may include the following steps.

First, perform amplitude limiting processing on the parameter of the amplitude correlation difference between the left and right channels of the current frame. For example, a parameter diff_lt_corr_limit that is of the amplitude correlation difference between the left and right channels and that is obtained through amplitude limiting processing satisfies the following formula:

$$\text{diff_lt_corr_limit}=\begin{cases}\text{RATIO_MAX}, & \text{if diff_lt_corr} > \text{RATIO_MAX}\\ \text{diff_lt_corr}, & \text{other}\\ \text{RATIO_MIN}, & \text{if diff_lt_corr} < \text{RATIO_MIN}\end{cases},$$

where RATIO_MAX represents a maximum value of the parameter that is of the amplitude correlation difference between the left and right channels and that is obtained through amplitude limiting, and RATIO_MIN represents a minimum value of the parameter that is of the amplitude correlation difference between the left and right channels and that is obtained through amplitude limiting, where RATIO_MAX is, for example, a preset empirical value, and RATIO_MAX is, for example, 1.5, 3.0, or another value, RATIO_MIN is, for example, a preset empirical value, and RATIO_MIN is, for example, −1.5, −3.0, or another value, and RATIO_MAX>RATIO_MIN.

Then, perform mapping processing on the parameter that is of the amplitude correlation difference between the left and right channels and that is obtained through amplitude limiting processing. The parameter diff_lt_corr_map that is of the amplitude correlation difference between the left and right channels and that is obtained through mapping processing satisfies the following formula:

$$\text{diff_lt_corr_map} = \begin{cases} A_1 * \text{diff_lt_corr_limi} + B_1, & \text{if diff_lt_corr_limit} > \text{RATIO_HIGH} \\ A_2 * \text{diff_lt_corr_limi} + B_2, & \text{if diff_lt_corr_limit} < \text{RATIO_LOW} \\ A_3 * \text{diff_lt_corr_limi} + B_3, & \text{if RATIO_LOW} \le \text{diff_lt_corr_limit} \le \text{RATIO_HIGH} \end{cases}$$

$$A_1 = \frac{\text{MAP_MAX-MA P_HIGH}}{\text{RATIO_MAX-RATIO_HIGH}},$$

$$B_1 = \text{MAP_MAX} - \text{RATIO_MAX} * A_1, \quad \text{or } B_1 = \text{MAP_HIGH} - \text{RATIO_HIGH} * A_1$$

$$A_2 = \frac{\text{MAP_LOW-MA P_MIN}}{\text{RATIO_LOW-RATIO_MIN}},$$

$$B_2 = \text{MAP_LOW} - \text{RATIO_LOW} * A_2 \text{ or } B_2 = \text{MAP_MIN} - \text{RATIO_MIN} * A_2$$

$$A_3 = \frac{\text{MAP_HIGH-M AP_LOW}}{\text{RATIO_HIGH-RATIO_LOW}},$$

$$B_3 = \text{MAP_HIGH} - \text{RATIO_HIGH} * A_3, \quad \text{or } B_3 = \text{MAP_LOW} - \text{RATIO_LOW} * A_3$$

where MAP_MAX represents a maximum value of the parameter that is of the amplitude correlation difference between the left and right channels and that is obtained through mapping processing, MAP_HIGH represents a high threshold of the parameter that is of the amplitude correlation difference between the left and right channels and that is obtained through mapping processing, MAP_LOW represents a low threshold of the parameter that is of the amplitude correlation difference between the left and right channels and that is obtained through mapping processing, and MAP_MIN represents a minimum value of the parameter that is of the amplitude correlation difference between the left and right channels and that is obtained through mapping processing:

$$\text{MAP_MAX} > \text{MAP_HIGH} > \text{MAP_LOW} > \text{MAP_MIN},$$

where for example, in some embodiments of this application, MAP_MAX may be 2.0, MAP_HIGH may be 1.2, MAP_LOW may be 0.8, and MAP_MIN may be 0.0, and certainly, actual application is not limited to these examples of values, RATIO_MAX represents the maximum value of the parameter that is of the amplitude correlation difference between the left and right channels and that is obtained through amplitude limiting, RATIO_HIGH represents a high threshold of the parameter that is of the amplitude correlation difference between the left and right channels and that is obtained through amplitude limiting, RATIO_LOW represents a low threshold of the parameter that is of the amplitude correlation difference between the left and right channels and that is obtained through amplitude limiting, and RATIO_MIN represents the minimum value of the parameter that is of the amplitude correlation difference between the left and right channels and that is obtained through amplitude limiting, and:

$$\text{RATIO_MAX} > \text{RATIO_HIGH} > \text{RATIO_LOW} > \text{RATIO_MIN},$$

where for example, in some embodiments of this application, RATIO_MAX is 1.5, RATIO_HIGH is 0.75, RATIO_LOW is 0.75, and RATIO_MIN is 1.5, and certainly, actual application is not limited to these examples of values.

In some embodiments of this application, another method is as follows the parameter diff_lt_corr_map that is of the amplitude correlation difference between the left and right channels and that is obtained through mapping processing satisfies the following formula:

$$\text{diff_lt_corr_map} = \begin{cases} 1.08 * \text{diff_lt_corr_limi} + 0.38, & \text{if diff_lt_corr_limit} > 0.5 * \text{RATIO_MAX} \\ 0.64 * \text{diff_lt_corr_limi} + 1.28, & \text{if diff_lt_corr_limit} < -0.5 * \text{RATIO_MAX} \\ 0.26 * \text{diff_lt_corr_limi} + 0.995, & \text{other} \end{cases},$$

where diff_lt_corr_limit represents a parameter that is of the amplitude correlation difference between the left and right channels and that is obtained through amplitude limiting processing, $$\text{diff_lt_corr_limit} = \begin{cases} \text{RATIO_MAX}, & \text{if diff_lt_corr} > \text{RATIO_Max} \\ \text{diff_lt_corr}, & \text{other} \\ -\text{RATIO_MAX}, & \text{if diff_lt_corr} < -\text{RATIO_MAX} \end{cases},$$

and

RATIO_MAX represents a maximum amplitude of the parameter of the amplitude correlation difference between the left and right channels, and −RATIO_MAX represents a minimum amplitude of the parameter of the amplitude correlation difference between the left and right channels, where RATIO_MAX may be a preset empirical value, for example, RATIO_MAX may be 1.5, 3.0, or another real number greater than 0.

90852. Convert the parameter that is of the amplitude correlation difference between the left and right channels and that is obtained through mapping processing into a channel combination ratio factor.

The channel combination ratio factor ratio_SM satisfies the following formula:

$$\text{ratio_SM} = \frac{1 - \cos\left(\frac{\pi}{2} * \text{diff_lt_corr_map}\right)}{2},$$

where cos(•) represents a cosine operation.

In addition to the foregoing method, the parameter of the amplitude correlation difference between the left and right channels may be alternatively converted into a channel combination ratio factor using another method, for example, including determining whether to update the channel combination ratio factor corresponding to the anticorrelated signal channel combination scheme, based on a cached encoding parameter (for example, an inter-frame correlation parameter of a primary channel signal or an inter-frame correlation parameter of a secondary channel signal) of the previous frame in a historical cache of an encoder, channel combination scheme identifiers of the current frame and the previous frame, and channel combination ratio factors corresponding to anticorrelated signal channel combination schemes for the current frame and the previous frame, and based on the long-time smooth frame energy of the left channel of the current frame, the long-time smooth frame energy of the right channel of the current frame, and the inter-frame energy difference of the left channel of the current frame that are obtained through signal energy analysis, and if the channel combination ratio factor corresponding to the anticorrelated signal channel combination scheme needs to be updated, converting the parameter of the amplitude correlation difference between the left and right channels into a channel combination ratio factor using the foregoing example method, otherwise, directly using the channel combination ratio factor corresponding to the anticorrelated signal channel combination scheme for the previous frame and a code index of channel combination ratio factor, as a channel combination ratio factor corresponding to the anticorrelated signal channel combination scheme for the current frame and a code index of the channel combination ratio factor.

90853. Perform quantization encoding on the channel combination ratio factor obtained through conversion, to determine the channel combination ratio factor corresponding to the anticorrelated signal channel combination scheme for the current frame.

Further, for example, quantization encoding is performed on the channel combination ratio factor obtained through conversion, to obtain an initial code index ratio_idx_init_SM corresponding to the anticorrelated signal channel combination scheme for the current frame, and an initial value ratio_init_$SM_{qua}$ of a channel combination ratio factor that corresponds to the anticorrelated signal channel combination scheme for the current frame and that is obtained through quantization encoding, where:

$$\text{ratio_init_}SM_{qua}=\text{ratio_tabl_}SM[\text{ratio_idx_init_}SM],$$

where ratio_tabl_SM represents a codebook for scalar quantization of the channel combination ratio factor corresponding to the anticorrelated signal channel combination scheme.

Any scalar quantization method in a conventional technology may be used for the quantization encoding, for example, uniform scalar quantization or non-uniform scalar quantization may be used. A quantity of coded bits may be 5 bits. A specific method is not described in detail herein. The codebook for scalar quantization of the channel combination ratio factor corresponding to the anticorrelated signal channel combination scheme may be the same as or different from the codebook for scalar quantization of the channel combination ratio factor corresponding to the correlated signal channel combination scheme. When the codebooks are the same, only one codebook used for scalar quantization of a channel combination ratio factor may need to be stored. In this case, the initial value ratio_init_$SM_{qua}$ of the channel combination ratio factor that corresponds to the anticorrelated signal channel combination scheme for the current frame and that is obtained through quantization encoding is as follows:

$$\text{ratio_init_}SM_{qua}=\text{ratio_tabl}[\text{ratio_idx_init_}SM].$$

For example, a method is directly using the initial value of the channel combination ratio factor that corresponds to the anticorrelated signal channel combination scheme for the current frame and that is obtained through quantization encoding, as a channel combination ratio factor corresponding to the anticorrelated signal channel combination scheme for the current frame, and directly using the initial code index of the channel combination ratio factor corresponding to the anticorrelated signal channel combination scheme for the current frame, as a code index of the channel combination ratio factor corresponding to the anticorrelated signal channel combination scheme for the current frame.

The code index ratio_idx_SM of the channel combination ratio factor corresponding to the anticorrelated signal channel combination scheme for the current frame satisfies ratio_idx_SM=ratio_idx_init_SM.

The channel combination ratio factor corresponding to the anticorrelated signal channel combination scheme for the current frame satisfies the following formula:

$$\text{ratio_}SM=\text{ratio_tabl}[\text{ratio_idx_}SM].$$

Another method may be modifying the initial value of the channel combination ratio factor that corresponds to the anticorrelated signal channel combination scheme for the current frame and that is obtained through quantization encoding, and the initial code index corresponding to the anticorrelated signal channel combination scheme for the current frame, based on the code index of the channel combination ratio factor corresponding to the anticorrelated signal channel combination scheme for the previous frame or the channel combination ratio factor corresponding to the anticorrelated signal channel combination scheme for the previous frame, and using a modified code index of a channel combination ratio factor corresponding to the anticorrelated signal channel combination scheme for the current frame as a code index of a channel combination ratio factor corresponding to the anticorrelated signal channel combination scheme for the current frame, and using a modified channel combination ratio factor corresponding to the anticorrelated signal channel combination scheme as a channel combination ratio factor corresponding to the anticorrelated signal channel combination scheme for the current frame.

The code index ratio_idx_SM of the channel combination ratio factor corresponding to the anticorrelated signal channel combination scheme for the current frame satisfies ratio_idx_SM=$\phi$*ratio_idx_init_SM+(1−$\phi$)*tdm_last_ratio_idx_SM, where ratio_idx_init_SM represents the initial code index corresponding to the anticorrelated signal channel combination scheme for the current frame, tdm_last_ratio_idx_SM is the code index of the channel combination ratio factor corresponding to the anticorrelated signal channel combination scheme for the previous frame, $\phi$ is a modification factor of the channel combination ratio factor corresponding to the anticorrelated signal channel combination scheme, and a value of $\phi$ may be an empirical value, for example, $\phi$ may be equal to 0.8.

In this case, the channel combination ratio factor corresponding to the anticorrelated signal channel combination scheme for the current frame satisfies the following formula:

$$\text{ratio_}SM=\text{ratio_tabl}[\text{ratio_idx_}SM]$$

Still another method is using an unquantized channel combination ratio factor corresponding to the anticorrelated signal channel combination scheme as a channel combination ratio factor corresponding to the anticorrelated signal channel combination scheme for the current frame, that is, the channel combination ratio factor ratio_SM corresponding to the anticorrelated signal channel combination scheme for the current frame satisfies the following formula:

$$\text{ratio_SM}=\frac{1-\cos\left(\frac{\pi}{2}*\text{diff_lt_corr_map}\right)}{2}.$$

In addition, a fourth method is modifying, based on the channel combination ratio factor corresponding to the anticorrelated signal channel combination scheme for the previous frame, an unquantized channel combination ratio factor corresponding to the anticorrelated signal channel combination scheme for the current frame, using a modified channel combination ratio factor corresponding to the anticorrelated signal channel combination scheme as a channel combination ratio factor corresponding to the anticorrelated signal channel combination scheme for the current frame, and performing quantization encoding on the channel combination ratio factor corresponding to the anticorrelated signal channel combination scheme for the current frame, to obtain a code index of the channel combination ratio factor.

In addition to the foregoing methods, there may be many other methods for converting the parameter of the amplitude correlation difference between the left and right channels into a channel combination ratio factor and performing quantization encoding on the channel combination ratio factor. Likewise, there are also many different methods for determining a channel combination ratio factor corresponding to the anticorrelated signal channel combination scheme for the current frame and a code index of the channel combination ratio factor. This is not limited in this application.

909. Determine an encoding mode of the current frame based on a downmix mode of the previous frame and the channel combination scheme for the current frame.

A channel combination scheme identifier of the current frame may be denoted as tdm_SM_flag.

A channel combination scheme identifier of the previous frame may be denoted as tdm_last_SM_flag.

A downmix mode identifier of the current frame may be denoted as tdm_DM_flag.

A downmix mode identifier of the previous frame may be denoted as tdm_last_DM_flag.

Similarly, stereo_tdm_coder_type may be used to indicate the encoding mode of the current frame.

Further, for example, stereo_tdm_coder_type=0 indicates that the encoding mode of the current frame is a downmix mode A-to-downmix mode A encoding mode, stereo_tdm_coder_type=1 indicates that the encoding mode of the current frame is a downmix mode A-to-downmix mode B encoding mode, and stereo_tdm_coder_type=2 indicates that the encoding mode of the current frame is a downmix mode A-to-downmix mode C encoding mode.

Further, for another example, stereo_tdm_coder_type=3 indicates that the encoding mode of the current frame is a downmix mode B-to-downmix mode B encoding mode, stereo_tdm_coder_type=4 indicates that the encoding mode of the current frame is a downmix mode B-to-downmix mode A encoding mode, and stereo_tdm_coder_type=5 indicates that the encoding mode of the current frame is a downmix mode B-to-downmix mode D encoding mode.

Further, for another example, stereo_tdm_coder_type=6 indicates that the encoding mode of the current frame is a downmix mode B-to-downmix mode C encoding mode, stereo_tdm_coder_type=7 indicates that the encoding mode of the current frame is a downmix mode C-to-downmix mode A encoding mode, and stereo_tdm_coder_type=8 indicates that the encoding mode of the current frame is a downmix mode C-to-downmix mode D encoding mode.

Further, for another example, stereo_tdm_coder_type=9 indicates that the encoding mode of the current frame is a downmix mode D-to-downmix mode D encoding mode, stereo_tdm_coder_type=10 indicates that the encoding mode of the current frame is a downmix mode D-to-downmix mode B encoding mode, and stereo_tdm_coder_type=11 indicates that the encoding mode of the current frame is a downmix mode D-to-downmix mode C encoding mode.

For a specific implementation of determining the encoding mode of the current frame based on the downmix mode of the previous frame and the channel combination scheme for the current frame, refer to related descriptions in other embodiments. Details are not described herein again.

910. After determining the encoding mode stereo_tdm_coder_type for the current frame, the encoding apparatus performs time-domain downmix processing on the left and right channel signals of the current frame based on the encoding mode of the current frame, to obtain primary and secondary channel signals of the current frame.

For implementations of performing time-domain downmix processing in different encoding modes, refer to related example descriptions in the foregoing embodiments. Details are not described herein again.

911. The encoding apparatus separately encodes the primary channel signal and the secondary channel signal to obtain an encoded primary channel signal and an encoded secondary channel signal.

Further, bits may be first allocated for encoding the primary channel signal and the secondary channel signal based on parameter information obtained from encoding of a primary channel signal and/or a secondary channel signal of the previous frame and a total quantity of bits for encoding the primary channel signal and the secondary channel signal. Then the primary channel signal and the secondary channel signal are separately encoded based on a bit allocation result, to obtain a code index for primary channel encoding and a code index for secondary channel encoding. Any mono audio encoding technology may be used for the primary channel encoding and the secondary channel encoding. Details are not described herein.

912. The encoding apparatus selects a corresponding code index of a channel combination ratio factor based on the channel combination scheme identifier, writes the code index into a bitstream, and writes the encoded primary channel signal, the encoded secondary channel signal, and the downmix mode identifier tdm_DM_flag of the current frame into the bitstream.

Further, for example, if the channel combination scheme identifier tdm_SM_flag of the current frame corresponds to the correlated signal channel combination scheme, the code index ratio_idx of the channel combination ratio factor corresponding to the correlated signal channel combination scheme for the current frame is written into the bitstream, or if the channel combination scheme identifier tdm_SM_flag of the current frame corresponds to the anticorrelated signal channel combination scheme, the code index ratio_idx_SM of the channel combination ratio factor corresponding to the anticorrelated signal channel combination scheme for the current frame is written into the bitstream.

For example, if tdm_SM_flag=0, the code index ratio_idx of the channel combination ratio factor corresponding to the correlated signal channel combination scheme for the current frame is written into the bitstream, or if tdm_SM_flag=1, the code index ratio_idx_SM of the channel combination ratio factor corresponding to the anticorrelated signal channel combination scheme for the current frame is written into the bitstream.

In addition, the encoded primary channel signal, the encoded secondary channel signal, the downmix mode identifier tdm_DM_flag of the current frame, and the like are written into the bitstream. It can be understood that there is no sequence for writing the foregoing information into the bitstream.

Correspondingly, the following describes a time-domain stereo decoding scenario using an example.

Figure 10:
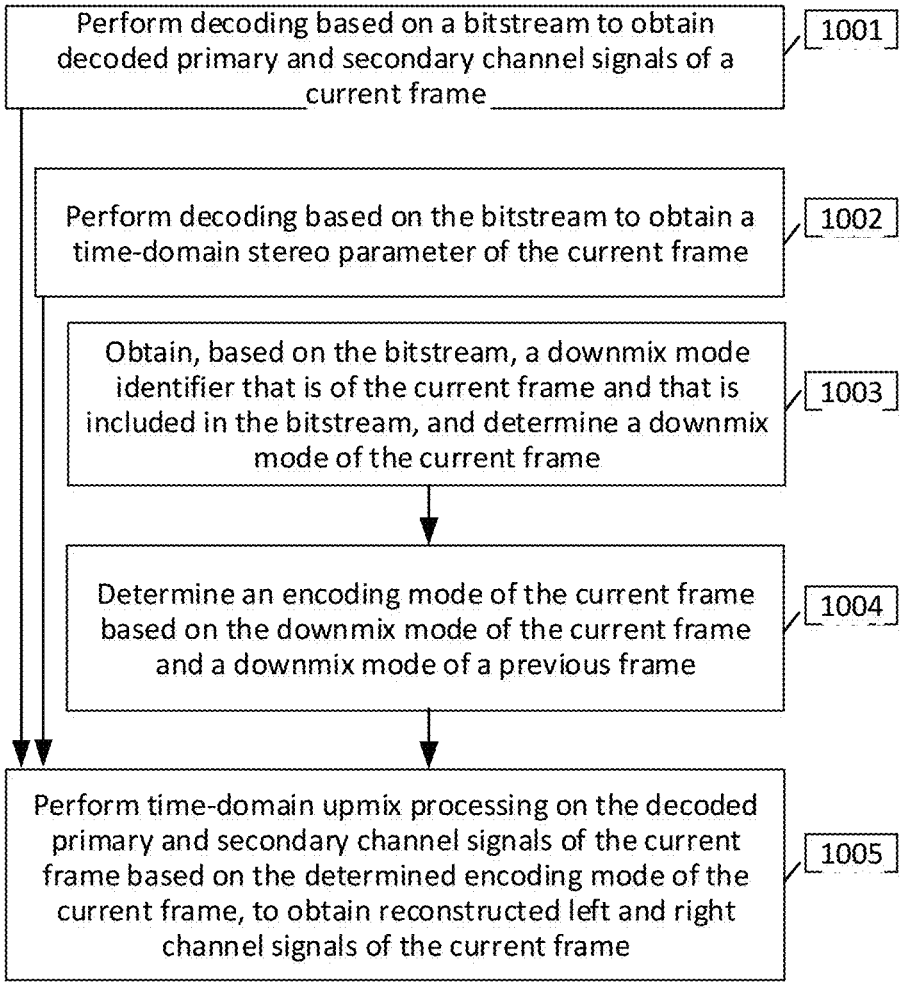
FIG. 10 is a schematic flowchart of a decoding method according to an embodiment of this application.

Referring to FIG. 10, the following further provides an audio decoding method. Related steps of the audio decoding method may be implemented by a decoding apparatus. The method may include the following steps.

1001. Perform decoding based on a bitstream to obtain decoded primary and secondary channel signals of a current frame.

1002. Perform decoding based on the bitstream to obtain a time-domain stereo parameter of the current frame.

The time-domain stereo parameter of the current frame includes a channel combination ratio factor of the current frame (the bitstream includes a code index of the channel combination ratio factor of the current frame, and the channel combination ratio factor of the current frame may be obtained through decoding based on the code index of the channel combination ratio factor of the current frame), and may further include an inter-channel time difference of the current frame (for example, the bitstream includes a code index of the inter-channel time difference of the current frame, and the inter-channel time difference of the current frame may be obtained through decoding based on the code index of the inter-channel time difference of the current frame, or the bitstream includes a code index of an absolute value of the inter-channel time difference of the current frame, and the absolute value of the inter-channel time difference of the current frame may be obtained through decoding based on the code index of the absolute value of the inter-channel time difference of the current frame), and the like.

1003. Obtain, based on the bitstream, a downmix mode identifier that is of the current frame and that is included in the bitstream, and determine a downmix mode of the current frame.

1004. Determine an encoding mode of the current frame based on the downmix mode of the current frame and a downmix mode of a previous frame.

For example, when the downmix mode identifier tdm_DM_flag of the current frame is (00), the downmix mode of the current frame is a downmix mode A, when the downmix mode identifier tdm_DM_flag of the current frame is (11), the downmix mode of the current frame is a downmix mode B, when the downmix mode identifier tdm_DM_flag of the current frame is (01), the downmix mode of the current frame is a downmix mode C, or when the downmix mode identifier tdm_DM_flag of the current frame is (10), the downmix mode of the current frame is a downmix mode D.

It can be understood that there is no necessary sequence for performing step 1001, step 1002, and steps 1003 and 1004.

1005. Perform time-domain upmix processing on the decoded primary and secondary channel signals of the current frame based on the determined encoding mode of the current frame, to obtain reconstructed left and right channel signals of the current frame.

For related implementations of performing time-domain upmix processing in different encoding modes, refer to related example descriptions in the foregoing embodiments. Details are not described herein again.

An upmix matrix used for the time-domain upmix processing is constructed based on the obtained channel combination ratio factor of the current frame.

The reconstructed left and right channel signals of the current frame may be used as decoded left and right channel signals of the current frame.

Alternatively, further, delay adjustment may be further performed on the reconstructed left and right channel signals of the current frame based on the inter-channel time difference of the current frame, to obtain reconstructed left and right channel signals of the current frame that have undergone delay adjustment. The reconstructed left and right channel signals of the current frame that are obtained through delay adjustment may be used as decoded left and right channel signals of the current frame. Alternatively, further, time-domain post-processing may be further performed on the reconstructed left and right channel signals of the current frame that are obtained through delay adjustment. Reconstructed left and right channel signals of the current frame that are obtained through time-domain post-processing may be used as decoded left and right channel signals of the current frame.

The foregoing describes the methods in the embodiments of this application in detail. The following provides apparatuses in the embodiments of this application.

Figure 11A:
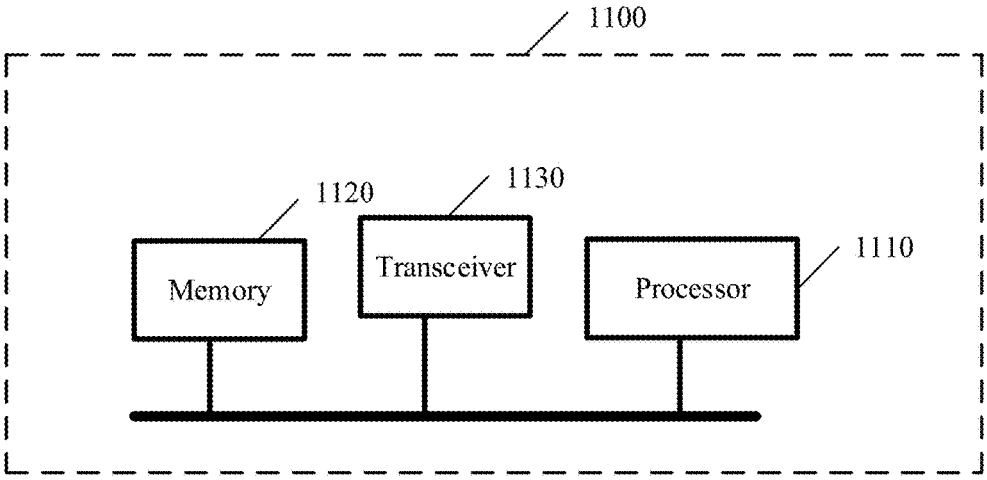
FIG. 11A is a schematic diagram of an apparatus according to an embodiment of this application.

Referring to FIG. 11A, an embodiment of this application provides an apparatus 1100, including a processor 1110 and a memory 1120 that are coupled to each other, where the memory 1110 stores a computer program, and the processor 1120 invokes the computer program stored in the memory, to perform some or all of the steps of any method provided in the embodiments of this application.

The memory 1120 includes but is not limited to a random access memory (RAM), a read-only memory (ROM), an erasable programmable ROM (EPROM), or a portable ROM (such as compact disc ROM (CD-ROM)). The memory 1120 is configured to store a related instruction and related data.

Certainly, the apparatus 1100 may further include a transceiver 1130 configured to send and receive data.

The processor 1110 may be one or more central processing units (CPU). When the processor 1110 is one CPU, the CPU may be a single-core CPU or a multi-core CPU. The processor 1110 may be a digital signal processor.

In an implementation process, steps in the foregoing methods can be implemented using a hardware integrated logical circuit in the processor 1110, or using instructions in a form of software. The processor 1110 may be a general-purpose processor, a digital signal processor, an application-specific integrated circuit (ASIC), a field programmable gate array (FPGA) or another programmable logic device, a discrete gate or a transistor logic device, or a discrete hardware component. The processor 1110 may implement or execute methods, steps and logical block diagrams in the method embodiments of the present disclosure. The general-purpose processor may be a microprocessor, or may be any conventional processor or the like. Steps of the methods disclosed with reference to the embodiments of the present disclosure may be directly performed and accomplished using a hardware decoding processor, or may be performed and accomplished using a combination of hardware and software modules in the decoding processor.

The software module may be located in a mature storage medium in the art, such as a RAM, a flash memory, a RPM, a programmable ROM (PROM), an electrically EPROM (EEPROM), a register, or the like. The storage medium is located in the memory 1120. For example, the processor 1110 may read information from the memory 1120, and complete the steps in the foregoing methods in combination with hardware of the processor 1110.

Further, the apparatus 1100 may further include the transceiver 1130. The transceiver 1130 may be configured to send and receive related data (for example, an instruction, a channel signal, or a bitstream).

For example, the apparatus 1100 may perform some or all steps of the corresponding method in the embodiment shown in any one of FIG. 2, FIG. 3, FIG. 6, FIG. 7, FIG. 8, FIG. 10, and FIG. 9A and FIG. 9B to FIG. 9E. Further, for example, when the apparatus 1100 performs the foregoing encoding-related steps, the apparatus 1100 may be referred to as an encoding apparatus (or an audio encoding apparatus). When the apparatus 1100 performs the foregoing decoding-related steps, the apparatus 1100 may be referred to as a decoding apparatus (or an audio decoding apparatus).

Figure 11B:
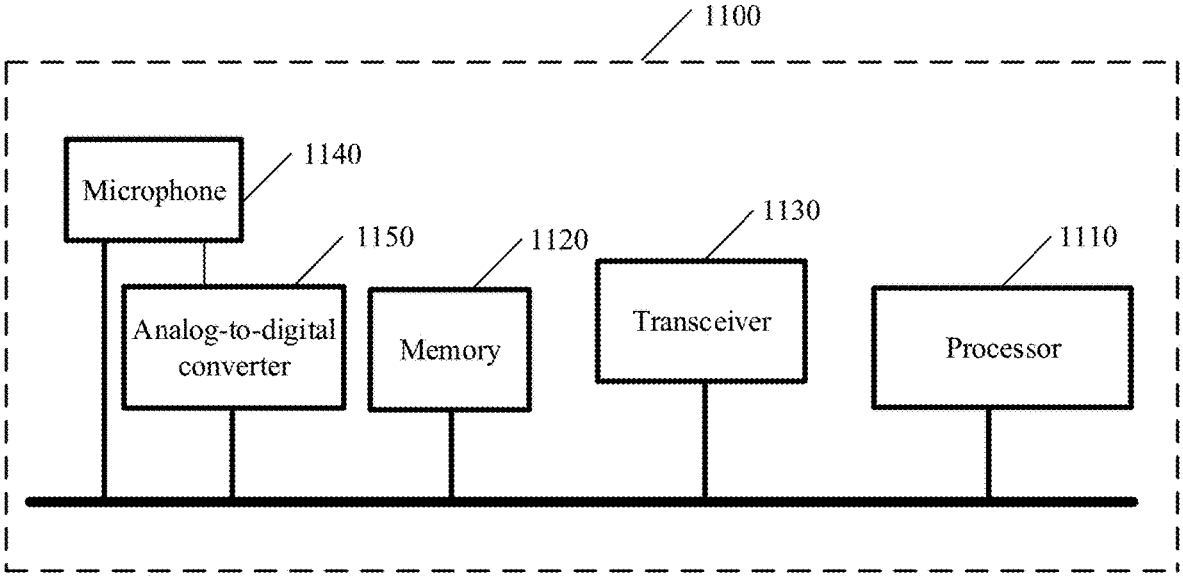
FIG. 11B is a schematic diagram of another apparatus according to an embodiment of this application.

Referring to FIG. 11B, when the apparatus 1100 is the encoding apparatus, the apparatus 1100 may further include, for example, a microphone 1140 and an analog-to-digital converter 1150.

The microphone 1140 may be, for example configured to perform sampling to obtain an analog audio signal.

The analog-to-digital converter 1150 may be, for example configured to convert the analog audio signal into a digital audio signal.

Figure 11C:
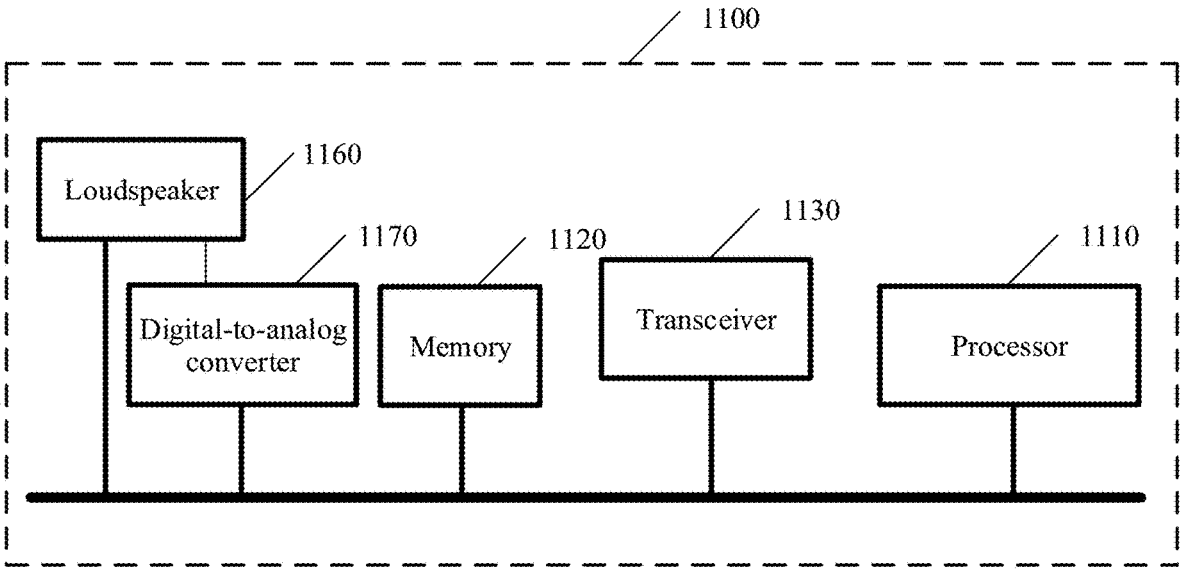
FIG. 11C is a schematic diagram of another apparatus according to an embodiment of this application.

Referring to FIG. 11C, when the apparatus 1100 is the decoding apparatus, the apparatus 1100 may further include, for example, a loudspeaker 1160 and a digital-to-analog converter 1170.

The digital-to-analog converter 1170 may be, for example configured to convert a digital audio signal into an analog audio signal.

The loudspeaker 1160 may be, for example configured to play the analog audio signal.

Figure 12A:
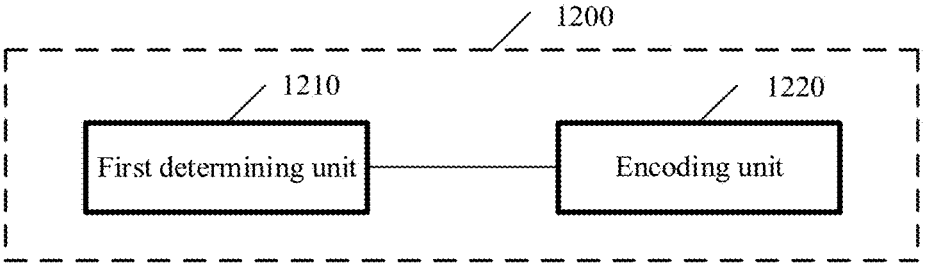
FIG. 12A is a schematic diagram of another apparatus according to an embodiment of this application.

In addition, referring to FIG. 12A, an embodiment of this application provides an apparatus 1200, including one or more functional units configured to implement any method provided in the embodiments of this application.

For example, when the apparatus 1200 performs the corresponding method in the embodiment shown in FIG. 2, the apparatus 1200 may include a first determining unit 1210 configured to determine a channel combination scheme for a current frame, and determine an encoding mode of the current frame based on a downmix mode of a previous frame and the channel combination scheme for the current frame, and an encoding unit 1220 configured to perform time-domain downmix processing on left and right channel signals of the current frame based on the encoding mode of the current frame, to obtain primary and secondary channel signals of the current frame, and encode the obtained primary and secondary channel signals of the current frame.

Figure 12B:
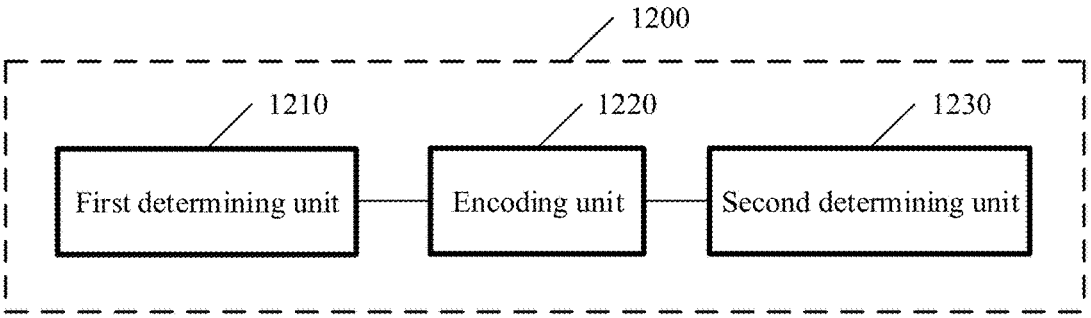
FIG. 12B is a schematic diagram of another apparatus according to an embodiment of this application.

In addition, referring to FIG. 12B, the apparatus 1200 may further include a second determining unit 1230 configured to determine a time-domain stereo parameter of the current frame. The encoding unit 1220 may be further configured to encode the time-domain stereo parameter of the current frame.

Figure 12C:
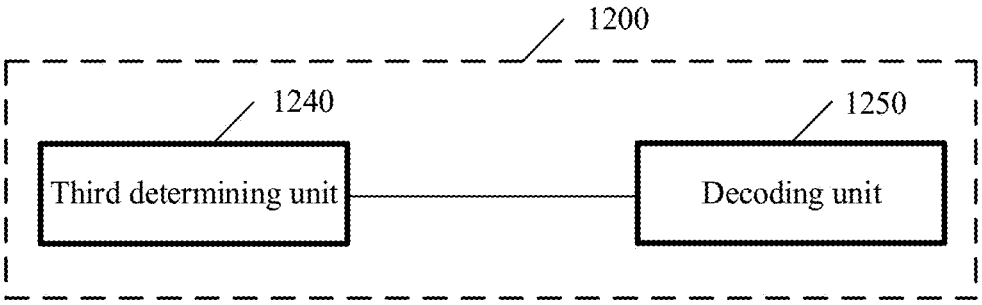
FIG. 12C is a schematic diagram of another apparatus according to an embodiment of this application.

For another example, referring to FIG. 12C, when the apparatus 1200 performs the corresponding method in the embodiment shown in FIG. 3, the apparatus 1200 may include a third determining unit 1240 configured to determine an encoding mode of a current frame based on a downmix mode of a previous frame and a downmix mode of the current frame, and a decoding unit 1250 configured to perform decoding based on a bitstream to obtain decoded primary and secondary channel signals of the current frame, perform decoding based on the bitstream to determine the downmix mode of the current frame, determine the encoding mode of the current frame based on the downmix mode of the previous frame and the downmix mode of the current frame, and perform time-domain upmix processing on the decoded primary and secondary channel signals of the current frame based on the encoding mode of the current frame, to obtain reconstructed left and right channel signals of the current frame.

A case in which the apparatus performs another method is similar.

An embodiment of this application provides a computer-readable storage medium. The computer-readable storage medium stores program code, and the program code includes an instruction for performing some or all steps of any method provided in the embodiments of this application.

An embodiment of this application further provides a computer program product. When the computer program product is run on a computer, the computer is enabled to perform some or all steps of any method provided in the embodiments of this application.

In the foregoing embodiments, the descriptions of the embodiments have respective focuses. For a part that is not described in detail in an embodiment, refer to related descriptions in the other embodiments.

In the one or more embodiments provided in this application, it should be understood that the disclosed apparatus may be implemented in another manner. For example, the described apparatus embodiment is merely an example. For example, the unit division is merely logical function division or may be other division in actual implementation. For example, a plurality of units or components may be combined or integrated into another system, or some features may be ignored or not performed. In addition, the displayed or discussed mutual indirect couplings or direct couplings or communication connections may be implemented through some interfaces. The indirect couplings or communication connections between the apparatuses or units may be implemented in electronic or other forms.

The units described as separate parts may or may not be physically separate, and parts displayed as units may or may not be physical units, may be located in one location, or may be distributed on a plurality of network units. Some or all of the units may be selected based on actual needs to achieve the objectives of the solutions of the embodiments.

In addition, functional units in the embodiments of the present disclosure may be integrated into one processing unit, or each of the units may exist alone physically, or two or more units are integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solutions of the present disclosure essentially, or the part contributing to other approaches, or all or some of the technical solutions may be implemented in a form of a software product. The computer software product is stored in a storage medium and includes one or more instructions for instructing a computer device (which may be a personal computer, a server, a network device, or the like) to perform all or some of the steps of the methods described in the embodiments of the present disclosure. The foregoing storage medium includes any medium that can store program code, such as a Universal Serial Bus (USB) flash drive, a ROM, a RAM, a removable hard disk, a magnetic disk, or an optical disc.

What is claimed is:

1. An audio encoding method comprising:

obtaining a channel combination scheme for a current frame;

obtaining an encoding mode of the current frame based at least on a downmix mode of a previous frame and the channel combination scheme, wherein the downmix mode is a downmix mode A, a downmix mode B, a downmix mode C, or a downmix mode D, wherein the downmix mode A and the downmix mode D are correlated signal downmix modes, wherein the downmix mode B and the downmix mode C are anticorrelated signal downmix modes, and wherein the downmix mode A, the downmix mode B, the downmix mode C, and the downmix mode D correspond to different downmix matrices;

performing, based on the encoding mode, time-domain downmix processing on a left channel signal of the current frame and a right channel signal of the current frame to obtain a primary channel signal of the current frame and a secondary channel signal of the current frame;

encoding the primary channel signal and the secondary channel signal; and obtaining the encoding mode based further on a downmix mode switching cost value of the current frame, wherein the downmix mode switching cost value is a calculation result of a switching cost based on a downmix mode switching cost function of the current frame, wherein the downmix mode switching cost function is based on at least one of a time-domain stereo parameter of the current frame, a time-domain stereo parameter of the previous frame, or the primary channel signal and the secondary channel signal, and wherein the downmix mode switching cost function is one of:

a cost function for downmix mode A-to-downmix mode B switching;

a cost function for downmix mode A-to-downmix mode C switching;

a cost function for downmix mode D-to-downmix mode B switching;

a cost function for downmix mode D-to-downmix mode C switching;

a cost function for downmix mode B-to-downmix mode A switching;

a cost function for downmix mode B-to-downmix mode D switching;

a cost function for downmix mode C-to-downmix mode A switching; or a cost function for downmix mode C-to-downmix mode D switching, wherein the cost function for downmix mode A-to-downmix mode B switching is as follows:

$$\text{Cost_AB} = \sum_{n=start_sample_A}^{end_sample_A} [(\alpha_{1_pre} - \alpha_1) * X_L(n) + (\alpha_{2_pre} + \alpha_2) * X_R(n)];$$

$$\alpha_{2_pre} = 1 - \alpha_{1_pre}; \text{ and}$$

$$\alpha_2 = 1 - \alpha_1,$$

wherein Cost_AB represents a value of the cost function for downmix mode A-to-downmix mode B switching, wherein start_sample_A represents a calculation start sampling point of the cost function for downmix mode A-to-downmix mode B switching, wherein start_sample_A is an integer greater than zero and less than N−1, wherein end_sample_A represents a calculation end sampling point of the cost function for downmix mode A-to-downmix mode B switching, wherein end_sample_A is an integer greater than zero and less than N−1, wherein start_sample_A is less than end_sample_A, wherein n represents a sequence number of a sampling point, wherein N represents a frame length, wherein $X_L(n)$ represents the left channel signal of the current frame, wherein $X_R(n)$ represents the right channel signal of the current frame, $\alpha_1$=ratio_SM, wherein ratio_SM represents a channel combination ratio factor corresponding to an anticorrelated signal channel combination scheme for the current frame, wherein $\alpha_{1_pre}$=tdm_last_ratio, and wherein tdm_last_ratio represents a channel combination ratio factor corresponding to a second correlated signal channel combination scheme for the previous frame, wherein the cost function for downmix mode A-to-downmix mode C switching is as follows:

$$\text{Cost_AC} = \sum_{n=start_sample_A2}^{end_sample_A2} [(\alpha_{1_pre} + \alpha_1) * X_L(n) + (\alpha_{2_pre} - \alpha_2) * X_R(n)],$$

wherein Cost_AC represents a value of the cost function for downmix mode A-to-downmix mode C switching, wherein start_sample_A2 represents a calculation start sampling point of the cost function for downmix mode A-to-downmix mode C switching, wherein start_sample_A2 is an integer greater than zero and less than N−1, wherein end_sample_A2 represents a calculation end sampling point of the cost function for downmix mode A-to-downmix mode C switching, wherein end_sample_A2 is an integer greater than zero and less than N−1, wherein start_sample_A2 is less than end_sample_A2, wherein the cost function for downmix mode B-to-downmix mode A switching is as follows:

$$\text{Cost_BA} = \sum_{n=start_sample_B}^{end_sample_B} [(\alpha_{3_pre} - \alpha_3) * X_L(n) + (\alpha_{4_pre} + \alpha_4) * X_R(n)];$$

$$\alpha_{4_pre} = 1 - \alpha_{3_pre}; \text{ and}$$

$$\alpha_4 = 1 - \alpha_3,$$

wherein Cost_BA represents a value of the cost function for downmix mode B-to-downmix mode A switching, wherein start_sample_B represents a calculation start sampling point of the cost function for downmix mode B-to-downmix mode A switching, wherein start_sample_B is an integer greater than zero and less than N−1, wherein end_sample_B represents a calculation end sampling point of the cost function for downmix mode B-to-downmix mode A switching, wherein end_sample_B is an integer greater than zero and less than N−1, wherein start_sample_B is less than end_sample_B, $\alpha_3$=ratio, wherein ratio represents a channel combination ratio factor corresponding to a correlated signal channel combination scheme for the current frame, wherein $\alpha_{3_pre}$=tdm_last_ratio_SM, and wherein tdm_last_ratio_SM represents a channel combination ratio factor corresponding to a second anticorrelated signal channel combination scheme for the previous frame, wherein the cost function for downmix mode B-to-downmix mode D switching is as follows:

$$\text{Cost_BD} = \sum_{n=start_sample_B2}^{end_sample_B2} [(\alpha_{3_pre} + \alpha_3) * X_L(n) + (\alpha_{4_pre} - \alpha_4) * X_R(n)],$$

wherein Cost_BD represents a value of the cost function for downmix mode B-to-downmix mode D switching, wherein start_sample_B2 represents a calculation start sampling point of the cost function for downmix mode B-to-downmix mode D switching, wherein start_sample_B2 is an integer greater than zero and less than N−1, wherein end_sample_B2 represents a calculation end sampling point of the cost function for downmix mode B-to-downmix mode D switching, wherein end_sample_B2 is an integer greater than zero and less than N−1, and wherein start_sample_B2 is less than end_sample_B2, wherein the cost function for downmix mode C-to-downmix mode D switching is as follows:

$$\text{Cost_CD} = \sum_{n=start_sample_C}^{end_sample_C} [-(\alpha_{3_pre} - \alpha_3) * X_L(n) + (\alpha_{4_pre} + \alpha_4) * X_R(n)],$$

wherein Cost_CD represents a value of the cost function for downmix mode C-to-downmix mode D switching, wherein start_sample_C represents a calculation start sampling point of the cost function for downmix mode C-to-downmix mode D switching, wherein start_sample_C is an integer greater than zero and less than N−1, wherein end_sample_C represents a calculation end sampling point of the cost function for downmix mode C-to-downmix mode D switching, wherein end_sample_C is an integer greater than zero and less than N−1, and wherein start_sample_C is less than end_sample_C, wherein the cost function for downmix mode C-to-downmix mode A switching is as follows:

$$\text{Cost_CA} = \sum_{n=start_sample_C2}^{end_sample_C2} [-(\alpha_{3_pre} + \alpha_3) * X_L(n) + (\alpha_{4_pre} - \alpha_4) * X_R(n)],$$

wherein Cost_CA represents a value of the cost function for downmix mode C-to-downmix mode A switching, wherein start_sample_C2 represents a calculation start sampling point of the cost function for downmix mode C-to-downmix mode A switching, wherein start_sample_C2 is an integer greater than zero and less than N−1, wherein end_sample_C2 represents a calculation end sampling point of the cost function for downmix mode C-to-downmix mode A switching, wherein end_sample_C2 is an integer greater than zero and less than N−1, and wherein start_sample_C2 is less than end_sample_C2, wherein the cost function for downmix mode D-to-downmix mode C switching is as follows:

$$\text{Cost_DC} = \sum_{n=start_sample_D}^{end_sample_D} [-(\alpha_{1_pre} - \alpha_1) * X_L(n) - (\alpha_{2_pre} + \alpha_2) * X_R(n)],$$

wherein Cost_DC represents a value of the cost function for downmix mode D-to-downmix mode C switching, wherein start_sample_D represents a calculation start sampling point of the cost function for downmix mode D-to-downmix mode C switching, wherein start_sample_D is an integer greater than zero and less than N−1, wherein end_sample_D represents a calculation end sampling point of the cost function for downmix mode D-to-downmix mode C switching, wherein end_sample_D is an integer greater than zero and less than N−1, and wherein start_sample_D is less than end_sample_D, and wherein the cost function for downmix mode D-to-downmix mode B switching is as follows:

$$\text{Cost_DB} = \sum_{n=start_sample_D2}^{end_sample_D2} [-(\alpha_{1_pre} + \alpha_1) * X_L(n) - (\alpha_{2_pre} + \alpha_2) * X_R(n)],$$

wherein Cost_DB represents a value of the cost function for downmix mode D-to-downmix mode B switching, wherein start_sample_D2 represents a calculation start sampling point of the cost function for downmix mode D-to-downmix mode B switching, wherein start_sample_D2 is an integer greater than zero and less than N−1, wherein end_sample_D2 represents a calculation end sampling point of the cost function for downmix mode D-to-downmix mode B switching, wherein end_sample_D2 is an integer greater than zero and less than N−1, and wherein start_sample_D2 is less than end_sample_D2.

2. The audio encoding method of claim 1, wherein the channel combination scheme is a third anticorrelated signal channel combination scheme or a third correlated signal channel combination scheme, wherein the third correlated signal channel combination scheme corresponds to a near in-phase signal, and wherein the third anticorrelated signal channel combination scheme corresponds to a near out-of-phase signal.

3. The audio encoding method according to claim 1, further comprising at least one of:

determining that a downmix mode of the current frame is the downmix mode A and that the encoding mode of the current frame is a downmix mode A-to-downmix mode A encoding mode when the downmix mode of the previous frame is the downmix mode A and the channel combination scheme for the current frame is the correlated signal channel combination scheme;

determining that the downmix mode of the current frame is the downmix mode B and that the encoding mode of the current frame is a downmix mode B-to-downmix mode B encoding mode when the downmix mode of the previous frame is the downmix mode B and the channel combination scheme for the current frame is the anticorrelated signal channel combination scheme;

determining that the downmix mode of the current frame is the downmix mode C and that the encoding mode of the current frame is a downmix mode C-to-downmix mode C encoding mode when the downmix mode of the previous frame is the downmix mode C and the channel combination scheme for the current frame is the anticorrelated signal channel combination scheme; or determining that the downmix mode of the current frame is the downmix mode D and that the encoding mode of the current frame is a downmix mode D-to-downmix mode D encoding mode when the downmix mode of the previous frame is the downmix mode D and the channel combination scheme for the current frame is the correlated signal channel combination scheme.

4. The audio encoding method of claim 1, further comprising at least one of:

determining that a downmix mode of the current frame is the downmix mode C when the downmix mode of the previous frame is the downmix mode A, the channel combination scheme for the current frame is the anticorrelated signal channel combination scheme, and the downmix mode switching cost value of the current frame satisfies a first downmix mode switching condition;

determining that the encoding mode of the current frame is a downmix mode A-to-downmix mode C encoding mode, wherein the downmix mode switching cost value is the value of the downmix mode switching cost function when the downmix mode of the previous frame is the downmix mode A, the channel combination scheme for the current frame is the anticorrelated signal channel combination scheme, and the downmix mode switching cost value of the current frame satisfies the first downmix mode switching condition, and wherein the first downmix mode switching condition is that a value of a cost function for downmix mode A-to-downmix mode B switching of the current frame is greater than or equal to a value of a cost function for downmix mode A-to-downmix mode C switching;

determining that the downmix mode of the current frame is the downmix mode B when the downmix mode of the previous frame is the downmix mode A, the channel combination scheme for the current frame is the anticorrelated signal channel combination scheme, and the downmix mode switching cost value of the current frame satisfies a second downmix mode switching condition;

determining that the encoding mode of the current frame is a downmix mode A-to-downmix mode B encoding mode, wherein the downmix mode switching cost value is the value of the downmix mode switching cost function when the downmix mode of the previous frame is the downmix mode A, the channel combination scheme for the current frame is the anticorrelated signal channel combination scheme, and the downmix mode switching cost value of the current frame satisfies the second downmix mode switching condition, and wherein the second downmix mode switching condition is that the value of the cost function for downmix mode A-to-downmix mode B switching of the current frame is less than or equal to the value of the cost function for downmix mode A-to-downmix mode C switching;

determining that the downmix mode of the current frame is the downmix mode A when the downmix mode of the previous frame is the downmix mode B, the channel combination scheme for the current frame is the correlated signal channel combination scheme, and the downmix mode switching cost value of the current frame satisfies a third downmix mode switching condition;

determining that the encoding mode of the current frame is a downmix mode B-to-downmix mode A encoding mode, wherein the downmix mode switching cost value is the value of the downmix mode switching cost function when the downmix mode of the previous frame is the downmix mode B, the channel combination scheme for the current frame is the correlated signal channel combination scheme, and the downmix mode switching cost value of the current frame satisfies the third downmix mode switching condition, and wherein the third downmix mode switching condition is that a value of the cost function for downmix mode B-to-downmix mode A switching of the current frame is less than or equal to a value of a cost function for downmix mode B-to-downmix mode D switching;

determining that the downmix mode of the current frame is the downmix mode D when the downmix mode of the previous frame is the downmix mode B, the channel combination scheme for the current frame is the correlated signal channel combination scheme, and the downmix mode switching cost value of the current frame satisfies a fourth downmix mode switching condition;

determining that the encoding mode of the current frame is a downmix mode B-to-downmix mode D encoding mode when the downmix mode of the previous frame is the downmix mode B, the channel combination scheme for the current frame is the correlated signal channel combination scheme, and the downmix mode switching cost value of the current frame satisfies the fourth downmix mode switching condition, wherein the downmix mode switching cost value is the value of the downmix mode switching cost function, and wherein the fourth downmix mode switching condition is that the value of the cost function for downmix mode B-to-downmix mode A switching of the current frame is greater than or equal to the value of the cost function for downmix mode B-to-downmix mode D switching;

determining that the downmix mode of the current frame is the downmix mode D when the downmix mode of the previous frame is the downmix mode C, the channel combination scheme for the current frame is the correlated signal channel combination scheme, and the downmix mode switching cost value of the current frame satisfies a fifth downmix mode switching condition;

determining that the encoding mode of the current frame is a downmix mode C-to-downmix mode D encoding mode when the downmix mode of the previous frame is the downmix mode C, the channel combination scheme for the current frame is the correlated signal channel combination scheme, and the downmix mode switching cost value of the current frame satisfies the fifth downmix mode switching condition, wherein the downmix mode switching cost value is the value of the downmix mode switching cost function, and wherein the fifth downmix mode switching condition is that a value of the cost function for downmix mode C-to-downmix mode A switching of the current frame is greater than or equal to a value of a cost function for downmix mode C-to-downmix mode D switching;

determining that the downmix mode of the current frame is the downmix mode A when the downmix mode of the previous frame is the downmix mode C, the channel combination scheme for the current frame is the correlated signal channel combination scheme, and the downmix mode switching cost value of the current frame satisfies a sixth downmix mode switching condition;

determining that the encoding mode of the current frame is a downmix mode C-to-downmix mode A encoding mode when the downmix mode of the previous frame is the downmix mode C, the channel combination scheme for the current frame is the correlated signal channel combination scheme, and the downmix mode switching cost value of the current frame satisfies the sixth downmix mode switching condition, wherein the downmix mode switching cost value is the value of the downmix mode switching cost function, and wherein the sixth downmix mode switching condition is that the value of the cost function for downmix mode C-to-downmix mode A switching of the current frame is less than or equal to the value of the cost function for downmix mode C-to-downmix mode D switching;

determining that the downmix mode of the current frame is the downmix mode B when the downmix mode of the previous frame is the downmix mode D, the channel combination scheme for the current frame is the anti-correlated signal channel combination scheme, and the downmix mode switching cost value of the current frame satisfies a seventh downmix mode switching condition;

determining that the encoding mode of the current frame is a downmix mode D-to-downmix mode B encoding mode when the downmix mode of the previous frame is the downmix mode D, the channel combination scheme for the current frame is the anticorrelated signal channel combination scheme, and the downmix mode switching cost value of the current frame satisfies the seventh downmix mode switching condition, wherein the downmix mode switching cost value is the value of the downmix mode switching cost function, and wherein the seventh downmix mode switching condition is that a value of the cost function for downmix mode D-to-downmix mode B switching of the current frame is less than or equal to a value of a cost function for downmix mode D-to-downmix mode C switching;

determining that the downmix mode of the current frame is the downmix mode C when the downmix mode of the previous frame is the downmix mode D, the channel combination scheme for the current frame is the anti-correlated signal channel combination scheme, and the downmix mode switching cost value of the current frame satisfies an eighth downmix mode switching condition; or determining that the encoding mode of the current frame is a downmix mode D-to-downmix mode C encoding mode when the downmix mode of the previous frame is the downmix mode D, the channel combination scheme for the current frame is the anticorrelated signal channel combination scheme, and the downmix mode switching cost value of the current frame satisfies the eighth downmix mode switching condition, wherein the downmix mode switching cost value is the value of the downmix mode switching cost function, and wherein the eighth downmix mode switching condition is that the value of the cost function for downmix mode D-to-downmix mode B switching of the current frame is greater than or equal to the value of the cost function for downmix mode D-to-downmix mode C switching.

5. The audio encoding method of claim 1, further comprising at least one of:

determining that a downmix mode of the current frame is the downmix mode C when the downmix mode of the previous frame is the downmix mode A, the channel combination scheme for the current frame is the anti-correlated signal channel combination scheme, and the downmix mode switching cost value of the current frame satisfies a ninth downmix mode switching condition;

determining that the encoding mode of the current frame is a downmix mode A-to-downmix mode C encoding mode when the downmix mode of the previous frame is the downmix mode A, the channel combination scheme for the current frame is the anticorrelated signal channel combination scheme, and the downmix mode switching cost value of the current frame satisfies the ninth downmix mode switching condition, wherein the downmix mode switching cost value of the current frame is a channel combination ratio factor of the current frame, and wherein the ninth downmix mode switching condition is that the channel combination ratio factor of the current frame is less than or equal to a channel combination ratio factor threshold (S1);

determining that the downmix mode of the current frame is the downmix mode B when the downmix mode of the previous frame is the downmix mode A, the channel combination scheme for the current frame is the anti-correlated signal channel combination scheme, and the downmix mode switching cost value of the current frame satisfies a tenth downmix mode switching condition;

determining that the encoding mode of the current frame is a downmix mode A-to-downmix mode B encoding mode when the downmix mode of the previous frame is the downmix mode A, the channel combination scheme for the current frame is the anticorrelated signal channel combination scheme, and the downmix mode switching cost value of the current frame satisfies the tenth downmix mode switching condition, wherein the downmix mode switching cost value of the current frame is the channel combination ratio factor of the current frame, and wherein the tenth downmix mode switching condition is that the channel combination ratio factor of the current frame is greater than or equal to the S1;

determining that the downmix mode of the current frame is the downmix mode A when the downmix mode of the previous frame is the downmix mode B, the channel combination scheme for the current frame is the correlated signal channel combination scheme, and the downmix mode switching cost value of the current frame satisfies an eleventh downmix mode switching condition;

determining that the encoding mode of the current frame is a downmix mode B-to-downmix mode A encoding mode when the downmix mode of the previous frame is the downmix mode B, the channel combination scheme for the current frame is the correlated signal channel combination scheme, and the downmix mode switching cost value of the current frame satisfies the eleventh downmix mode switching condition, wherein the downmix mode switching cost value of the current frame is the channel combination ratio factor of the current frame, and the eleventh downmix mode switching condition is that the channel combination ratio factor of the current frame is greater than or equal to a second channel combination ratio factor threshold (S2);

determining that the downmix mode of the current frame is the downmix mode D when the downmix mode of the previous frame is the downmix mode B, the channel combination scheme for the current frame is the correlated signal channel combination scheme, and the downmix mode switching cost value of the current frame satisfies a twelfth downmix mode switching condition;

determining that the encoding mode of the current frame is a downmix mode B-to-downmix mode D encoding mode when the downmix mode of the previous frame is the downmix mode B, the channel combination scheme for the current frame is the correlated signal channel combination scheme, and the downmix mode switching cost value of the current frame satisfies the twelfth downmix mode switching condition, wherein the downmix mode switching cost value of the current frame is the channel combination ratio factor of the current frame, and wherein the twelfth downmix mode switching condition is that the channel combination ratio factor of the current frame is less than or equal to the S2;

determining that the downmix mode of the current frame is the downmix mode D when the downmix mode of the previous frame is the downmix mode C, the channel combination scheme for the current frame is the correlated signal channel combination scheme, and the downmix mode switching cost value of the current frame satisfies a thirteenth downmix mode switching condition;

determining that the encoding mode of the current frame is a downmix mode C-to-downmix mode D encoding mode when the downmix mode of the previous frame is the downmix mode C, the channel combination scheme for the current frame is the correlated signal channel combination scheme, and the downmix mode switching cost value of the current frame satisfies the thirteenth downmix mode switching condition, wherein the downmix mode switching cost value of the current frame is the channel combination ratio factor of the current frame, and wherein the thirteenth downmix mode switching condition is that the channel combination ratio factor of the current frame is greater than or equal to a third channel combination ratio factor threshold (S3);

determining that the downmix mode of the current frame is the downmix mode A when the downmix mode of the previous frame is the downmix mode C, the channel combination scheme for the current frame is the correlated signal channel combination scheme, and the downmix mode switching cost value of the current frame satisfies a fourteenth downmix mode switching condition;

determining that the encoding mode of the current frame is a downmix mode C-to-downmix mode A encoding mode when the downmix mode of the previous frame is the downmix mode C, the channel combination scheme for the current frame is the correlated signal channel combination scheme, and the downmix mode switching cost value of the current frame satisfies the fourteenth downmix mode switching condition, wherein the downmix mode switching cost value of the current frame is the channel combination ratio factor of the current frame, and the fourteenth downmix mode switching condition is that the channel combination ratio factor of the current frame is less than or equal to the S3;

determining that the downmix mode of the current frame is the downmix mode B when the downmix mode of the previous frame is the downmix mode D, the channel combination scheme for the current frame is the anticorrelated signal channel combination scheme, and the downmix mode switching cost value of the current frame satisfies a fifteenth downmix mode switching condition;

determining that the encoding mode of the current frame is a downmix mode D-to-downmix mode B encoding mode when the downmix mode of the previous frame is the downmix mode D, the channel combination scheme for the current frame is the anticorrelated signal channel combination scheme, and the downmix mode switching cost value of the current frame satisfies the fifteenth downmix mode switching condition, wherein the downmix mode switching cost value of the current frame is the channel combination ratio factor of the current frame, and when the fifteenth downmix mode switching condition is that the channel combination ratio factor of the current frame is less than or equal to a fourth channel combination ratio factor threshold (S4);

determining that the downmix mode of the current frame is the downmix mode C when the downmix mode of the previous frame is the downmix mode D, the channel combination scheme for the current frame is the anticorrelated signal channel combination scheme, and the downmix mode switching cost value of the current frame satisfies a sixteenth downmix mode switching condition; or determining that the encoding mode of the current frame is a downmix mode D-to-downmix mode C encoding mode when the downmix mode of the previous frame is the downmix mode D, the channel combination scheme for the current frame is the anticorrelated signal channel combination scheme, and the downmix mode switching cost value of the current frame satisfies the sixteenth downmix mode switching condition, wherein the downmix mode switching cost value of the current frame is the channel combination ratio factor of the current frame, and wherein the sixteenth downmix mode switching condition is that the channel combination ratio factor of the current frame is greater than or equal to the S4.

6. The method according to claim 1, wherein the different downmix matrices comprise $M_{2A}$, $M_{2B}$, $M_{2C}$, and $M_{2D}$, and wherein:

$$M_{2A} = \begin{bmatrix} 0.5 & 0.5 \\ 0.5 & -0.5 \end{bmatrix}; \text{ or}$$

$$M_{2A} = \begin{bmatrix} \text{ratio} & 1-\text{ratio} \\ 1-\text{ratio} & -\text{ratio} \end{bmatrix},$$

wherein the $M_{2A}$ represents a downmix matrix corresponding to the downmix mode A of the current frame, wherein the ratio represents the channel combination ratio factor corresponding to the correlated signal channel combination scheme for the current frame, wherein:

$$M_{2B} = \begin{bmatrix} \alpha_1 & -\alpha_2 \\ -\alpha_2 & -\alpha_1 \end{bmatrix}; \text{ or}$$

-continued $$M_{2B} = \begin{bmatrix} 0.5 & -0.5 \\ -0.5 & -0.5 \end{bmatrix},$$

wherein the $M_{2B}$ represents a downmix matrix corresponding to the downmix mode B of the current frame, wherein $\alpha_1$=ratio_SM, wherein $\alpha_2$=1−ratio_SM, wherein the ratio_SM represents the channel combination ratio factor corresponding to the anticorrelated signal channel combination scheme for the current frame, wherein:

$$M_{2C} = \begin{bmatrix} -\alpha_1 & \alpha_2 \\ \alpha_2 & \alpha_1 \end{bmatrix}; \text{or}$$

$$M_{2C} = \begin{bmatrix} -0.5 & 0.5 \\ 0.5 & 0.5 \end{bmatrix},$$

wherein the $M_{2C}$ represents a downmix matrix corresponding to the downmix mode C of the current frame, and wherein:

$$M_{2D} = \begin{bmatrix} -\alpha_1 & -\alpha_2 \\ -\alpha_2 & \alpha_1 \end{bmatrix}; \text{or}$$

$$M_{2D} = \begin{bmatrix} -0.5 & -0.5 \\ -0.5 & 0.5 \end{bmatrix},$$

wherein the $M_{2D}$ represents a downmix matrix corresponding to the downmix mode D of the current frame.

7. An audio encoding apparatus comprising:

a memory configured to store a computer program; and a processor coupled to the memory, wherein the computer program causes the processor to be configured to:

obtain a channel combination scheme for a current frame;

obtain an encoding mode of the current frame based at least on a downmix mode of a previous frame and the channel combination scheme for the current frame, wherein the downmix mode of the previous frame is a downmix mode A, a downmix mode B, a downmix mode C, or a downmix mode D, wherein the downmix mode A and the downmix mode D are correlated signal downmix modes, wherein the downmix mode B and the downmix mode C are anticorrelated signal downmix modes, and wherein the downmix mode A, the downmix mode B, the downmix mode C, and the downmix mode D correspond to different downmix matrices;

perform time-domain downmix processing on a left channel signal of the current frame and a right channel signal of the current frame based on the encoding mode of the current frame to obtain a primary channel signal of the current frame a secondary channel signal of the current frame;

encode the primary channel signal and the secondary channel signal; and obtain the encoding mode of the current frame based further on a downmix mode switching cost value of the current frame, wherein the downmix mode switching cost value of the current frame is a calculation result of a switching cost based on a downmix mode switching cost function of the current frame, wherein the downmix mode switching cost function is based on at least one of a time-domain stereo parameter of the current frame, a time-domain stereo parameter of the previous frame, or the primary channel signal and the secondary channel signal, and wherein the downmix mode switching cost function is one of:

a cost function for downmix mode A-to-downmix mode B switching;

a cost function for downmix mode A-to-downmix mode C switching;

a cost function for downmix mode D-to-downmix mode B switching;

a cost function for downmix mode D-to-downmix mode C switching;

a cost function for downmix mode B-to-downmix mode A switching;

a cost function for downmix mode B-to-downmix mode D switching;

a cost function for downmix mode C-to-downmix mode A switching; or a cost function for downmix mode C-to-downmix mode D switching, wherein the cost function for downmix mode A-to-downmix mode B switching is as follows:

$$\text{Cost_AB} = \sum_{n=start_sample_A}^{end_sample_A} [(\alpha_{1_pre} - \alpha_1) * X_L(n) + (\alpha_{2_pre} + \alpha_2) * X_R(n)]$$

$$\alpha_{2_pre} = 1 - \alpha_{1_pre};$$

$$\alpha_2 = 1 - \alpha_1,$$

wherein Cost_AB represents a value of the cost function for downmix mode A-to-downmix mode B switching, wherein start_sample_A represents a calculation start sampling point of the cost function for downmix mode A-to-downmix mode B switching, wherein start_sample_A is an integer greater than zero and less than N−1, wherein end_sample_A represents a calculation end sampling point of the cost function for downmix mode A-to-downmix mode B switching, wherein end_sample_A is an integer greater than zero and less than N−1, wherein start_sample_A is less than end_sample_A, wherein n represents a sequence number of a sampling point, wherein N represents a frame length, wherein $X_L(n)$ represents the left channel signal of the current frame, wherein $X_R(n)$ represents the right channel signal of the current frame, wherein $\alpha_1$=ratio_SM, wherein ratio_SM represents a channel combination ratio factor corresponding to an anticorrelated signal channel combination scheme for the current frame, wherein $\alpha_{1_pre}$=tdm_last_ratio, and wherein tdm_last_ratio represents a channel combination ratio factor corresponding to a second correlated signal channel combination scheme for the previous frame, wherein the cost function for downmix mode A-to-downmix mode C switching is as follows:

$$\text{Cost_AC} = \sum_{n=start_sample_A2}^{end_sample_A2} [(\alpha_{1_pre} + \alpha_1) * X_L(n) + (\alpha_{2_pre} - \alpha_2) * X_R(n)],$$

wherein Cost_AC represents a value of the cost function for downmix mode A-to-downmix mode C switching, wherein start_sample_A2 represents a calculation start sampling point of the cost function for downmix mode A-to-downmix mode C switching, wherein start_sample_A2 is an integer greater than zero and less than N−1, wherein end_sample_A2 represents a calculation end sampling point of the cost function for downmix mode A-to-downmix mode C switching, wherein end_sample_A2 is an integer greater than zero and less than N−1, and wherein start_sample_A2 is less than end_sample_A2, wherein the cost function for downmix mode B-to-downmix mode A switching is as follows:

$$\text{Cost_BA} = \sum_{n=start_sample_B}^{end_sample_B} [(\alpha_{3_pre} - \alpha_3) * X_L(n) - (\alpha_{4_pre} + \alpha_4) * X_R(n)];$$

$$\alpha_{4_pre} = 1 - \alpha_{3_pre};\ \alpha_4 = 1 - \alpha_3,$$

wherein Cost_BA represents a value of the cost function for downmix mode B-to-downmix mode A switching, wherein start_sample_B represents a calculation start sampling point of the cost function for downmix mode B-to-downmix mode A switching, wherein start_sample_B is an integer greater than zero and less than N−1, wherein end_sample_B represents a calculation end sampling point of the cost function for downmix mode B-to-downmix mode A switching, wherein end_sample_B is an integer greater than zero and less than N−1, wherein start_sample_B is less than end_sample_B, wherein $\alpha_3$=ratio, wherein ratio represents a channel combination ratio factor corresponding to a correlated signal channel combination scheme for the current frame, wherein $\alpha_{3_pre}$=tdm_last_ratio_SM, and wherein tdm_last_ratio_SM represents a channel combination ratio factor corresponding to a second anticorrelated signal channel combination scheme for the previous frame, wherein the cost function for downmix mode B-to-downmix mode D switching is as follows:

$$\text{Cost_BD} = \sum_{n=start_sample_B2}^{end_sample_B2} [(\alpha_{3_pre} + \alpha_3) * X_L(n) - (\alpha_{4_pre} - \alpha_4) * X_R(n)],$$

wherein Cost_BD represents a value of the cost function for downmix mode B-to-downmix mode D switching, wherein start_sample_B2 represents a calculation start sampling point of the cost function for downmix mode B-to-downmix mode D switching, wherein start_sample_B2 is an integer greater than zero and less than N−1, wherein end_sample_B2 represents a calculation end sampling point of the cost function for downmix mode B-to-downmix mode D switching, wherein end_sample_B2 is an integer greater than zero and less than N−1, and wherein start_sample_B2 is less than end_sample_B2, wherein the cost function for downmix mode C-to-downmix mode D switching is as follows:

$$\text{Cost_CD} = \sum_{n=start_sample_C}^{end_sample_C} [-(\alpha_{3_pre} - \alpha_3) * X_L(n) + (\alpha_{4_pre} + \alpha_4) * X_R(n)],$$

wherein Cost_CD represents a value of the cost function for downmix mode C-to-downmix mode D switching, wherein start_sample_C represents a calculation start sampling point of the cost function for downmix mode C-to-downmix mode D switching, wherein start_sample_C is an integer greater than zero and less than N−1, wherein end_sample_C represents a calculation end sampling point of the cost function for downmix mode C-to-downmix mode D switching, wherein end_sample_C is an integer greater than zero and less than N−1, and wherein start_sample_C is less than end_sample_C, wherein the cost function for downmix mode C-to-downmix mode A switching is as follows:

$$\text{Cost_CA} = \sum_{n=start_sample_C2}^{end_sample_C2} [-(\alpha_{3_pre} + \alpha_3) * X_L(n) + (\alpha_{4_pre} - \alpha_4) * X_R(n)],$$

wherein Cost_CA represents a value of the cost function for downmix mode C-to-downmix mode A switching, wherein start_sample_C2 represents a calculation start sampling point of the cost function for downmix mode C-to-downmix mode A switching, wherein start_sample_C is an integer greater than zero and less than N−1, wherein end_sample_C2 represents a calculation end sampling point of the cost function for downmix mode C-to-downmix mode A switching, wherein end_sample_C2 is an integer greater than zero and less than N−1, and wherein start_sample_C2 is less than end_sample_C2, wherein the cost function for downmix mode D-to-downmix mode C switching is as follows:

$$\text{Cost_DC} = \sum_{n=start_sample_D}^{end_sample_D} [-(\alpha_{1_pre} - \alpha_1) * X_L(n) - (\alpha_{2_pre} + \alpha_2) * X_R(n)],$$

wherein Cost_DC represents a value of the cost function for downmix mode D-to-downmix mode C switching, wherein start_sample_D represents a calculation start sampling point of the cost function for downmix mode D-to-downmix mode C switching, wherein start_sample_D is an integer greater than zero and less than N−1, wherein end_sample_D represents a calculation end sampling point of the cost function for downmix mode D-to-downmix mode C switching, wherein end_sample_D is an integer greater than zero and less than N−1, and wherein start_sample_D is less than end_sample_D, wherein the cost function for downmix mode D-to-downmix mode B switching is as follows:

$$\text{Cost_DB} = \sum_{n=start_sample_D2}^{end_sample_D2} [-(\alpha_{1_pre} + \alpha_1) * X_L(n) - (\alpha_{2_pre} + \alpha_2) * X_R(n)],$$

wherein Cost_DB represents a value of the cost function for downmix mode D-to-downmix mode B switching, wherein start_sample_D2 represents a calculation start sampling point of the cost function for downmix mode D-to-downmix mode B switching, wherein start_sample_D2 is an integer greater than zero and less than N−1, wherein end_sample_D2 represents a calculation end sampling point of the cost function for downmix mode D-to-downmix mode B switching, wherein end_sample_D2 is an integer greater than zero and less than N−1, and wherein start_sample_D2 is less than end_sample_D2.

8. The audio encoding apparatus of claim 7, wherein the channel combination scheme for the current frame is third anticorrelated signal channel combination scheme or a third correlated signal channel combination scheme, wherein the third correlated signal channel combination scheme corresponds to a near in phase signal, and wherein the third anticorrelated signal channel combination scheme corresponds to a near out of phase signal.

9. The audio encoding apparatus of claim 7, wherein the computer program further causes the processor to be configured to at least one of:

determine that a downmix mode of the current frame is the downmix mode A and that the encoding mode of the current frame is a downmix mode A-to-downmix mode A encoding mode when the downmix mode of the previous frame is the downmix mode A and the channel combination scheme for the current frame is the correlated signal channel combination scheme;

determine that the downmix mode of the current frame is the downmix mode B and that the encoding mode of the current frame is a downmix mode B-to-downmix mode B encoding mode when the downmix mode of the previous frame is the downmix mode B and the channel combination scheme for the current frame is the anticorrelated signal channel combination scheme;

determine that the downmix mode of the current frame is the downmix mode C and that the encoding mode of the current frame is a downmix mode C-to-downmix mode C encoding mode when the downmix mode of the previous frame is the downmix mode C and the channel combination scheme for the current frame is the anticorrelated signal channel combination scheme; or determine that the downmix mode of the current frame is the downmix mode D and that the encoding mode of the current frame is a downmix mode D-to-downmix mode D encoding mode when the downmix mode of the previous frame is the downmix mode D and the channel combination scheme for the current frame is the correlated signal channel combination scheme.

10. The audio encoding apparatus of claim 7, wherein the computer program further causes the processor to be configured to at least one of:

determine that a downmix mode of the current frame is the downmix mode C when the downmix mode of the previous frame is the downmix mode A, the channel combination scheme for the current frame is the anticorrelated signal channel combination scheme, and the downmix mode switching cost value of the current frame satisfies a first downmix mode switching condition;

determine the encoding mode of the current frame is a downmix mode A-to-downmix mode C encoding mode when the downmix mode of the previous frame is the downmix mode A, the channel combination scheme for the current frame is the anticorrelated signal channel combination scheme, and the downmix mode switching cost value of the current frame satisfies the first downmix mode switching condition, wherein the downmix mode switching cost value is the value of the downmix mode switching cost function, and wherein the first downmix mode switching condition is that a value of a cost function for downmix mode A-to-downmix mode B switching of the current frame is greater than or equal to a value of a cost function for downmix mode A-to-downmix mode C switching;

determine that the downmix mode of the current frame is the downmix mode B when the downmix mode of the previous frame is the downmix mode A, the channel combination scheme for the current frame is the anticorrelated signal channel combination scheme, and the downmix mode switching cost value of the current frame satisfies a second downmix mode switching condition;

determine that the encoding mode of the current frame is a downmix mode A-to-downmix mode B encoding mode when the downmix mode of the previous frame is the downmix mode A, the channel combination scheme for the current frame is the anticorrelated signal channel combination scheme, and the downmix mode switching cost value of the current frame satisfies the second downmix mode switching condition, wherein the downmix mode switching cost value is the value of the downmix mode switching cost function, and wherein the second downmix mode switching condition is that the value of the cost function for downmix mode A-to-downmix mode B switching of the current frame is less than or equal to the value of the cost function for downmix mode A-to-downmix mode C switching;

determine that the downmix mode of the current frame is the downmix mode A when the downmix mode of the previous frame is the downmix mode B, the channel combination scheme for the current frame is the correlated signal channel combination scheme, and the downmix mode switching cost value of the current frame satisfies a third downmix mode switching condition;

determine the encoding mode of the current frame is a downmix mode B-to-downmix mode A encoding mode when the downmix mode of the previous frame is the downmix mode B, the channel combination scheme for the current frame is the correlated signal channel combination scheme, and the downmix mode switching cost value of the current frame satisfies the third downmix mode switching condition, wherein the downmix mode switching cost value is the value of the downmix mode switching cost function, and wherein the third downmix mode switching condition is that a value of the cost function for downmix mode B-to-downmix mode A switching of the current frame is less than or equal to a value of a cost function for downmix mode B-to-downmix mode D switching;

determine that the downmix mode of the current frame is the downmix mode D when the downmix mode of the previous frame is the downmix mode B, the channel combination scheme for the current frame is the correlated signal channel combination scheme, and the downmix mode switching cost value of the current frame satisfies a fourth downmix mode switching condition;

determine that the encoding mode of the current frame is a downmix mode B-to-downmix mode D encoding mode when the downmix mode of the previous frame is the downmix mode B, the channel combination scheme for the current frame is the correlated signal channel combination scheme, and the downmix mode switching cost value of the current frame satisfies the fourth downmix mode switching condition, wherein the downmix mode switching cost value is the value of the downmix mode switching cost function, and wherein the fourth downmix mode switching condition is that the value of the cost function for downmix mode B-to-downmix mode A switching of the current frame is greater than or equal to the value of the cost function for downmix mode B-to-downmix mode D switching;

determine that the downmix mode of the current frame is the downmix mode D when the downmix mode of the previous frame is the downmix mode C, the channel combination scheme for the current frame is the correlated signal channel combination scheme, and the downmix mode switching cost value of the current frame satisfies a fifth downmix mode switching condition;

determine that the encoding mode of the current frame is a downmix mode C-to-downmix mode D encoding mode when the downmix mode of the previous frame is the downmix mode C, the channel combination scheme for the current frame is the correlated signal channel combination scheme, and the downmix mode switching cost value of the current frame satisfies the fifth downmix mode switching condition, wherein the downmix mode switching cost value is the value of the downmix mode switching cost function, and wherein the fifth downmix mode switching condition is that a value of the cost function for downmix mode C-to-downmix mode A switching of the current frame is greater than or equal to a value of a cost function for downmix mode C-to-downmix mode D switching;

determine that the downmix mode of the current frame is the downmix mode A when the downmix mode of the previous frame is the downmix mode C, the channel combination scheme for the current frame is the correlated signal channel combination scheme, and the downmix mode switching cost value of the current frame satisfies a sixth downmix mode switching condition;

determine that the encoding mode of the current frame is a downmix mode C-to-downmix mode A encoding mode when the downmix mode of the previous frame is the downmix mode C, the channel combination scheme for the current frame is the correlated signal channel combination scheme, and the downmix mode switching cost value of the current frame satisfies the sixth downmix mode switching condition, wherein the downmix mode switching cost value is the value of the downmix mode switching cost function, and wherein the sixth downmix mode switching condition is that the value of the cost function for downmix mode C-to-downmix mode A switching of the current frame is less than or equal to the value of the cost function for downmix mode C-to-downmix mode D switching;

determine that the downmix mode of the current frame is the downmix mode B when the downmix mode of the previous frame is the downmix mode D, the channel combination scheme for the current frame is the anticorrelated signal channel combination scheme, and the downmix mode switching cost value of the current frame satisfies a seventh downmix mode switching condition;

determine that the encoding mode of the current frame is a downmix mode D-to-downmix mode B encoding mode when the downmix mode of the previous frame is the downmix mode D, the channel combination scheme for the current frame is the anticorrelated signal channel combination scheme, and the downmix mode switching cost value of the current frame satisfies the seventh downmix mode switching condition, wherein the downmix mode switching cost value is the value of the downmix mode switching cost function, and wherein the seventh downmix mode switching condition is that a value of the cost function for downmix mode D-to-downmix mode B switching of the current frame is less than or equal to a value of a cost function for downmix mode D-to-downmix mode C switching;

determine that the downmix mode of the current frame is the downmix mode C when the downmix mode of the previous frame is the downmix mode D, the channel combination scheme for the current frame is the anticorrelated signal channel combination scheme, and the downmix mode switching cost value of the current frame satisfies an eighth downmix mode switching condition; or determine that the encoding mode of the current frame is a downmix mode D-to-downmix mode C encoding mode when the downmix mode of the previous frame is the downmix mode D, the channel combination scheme for the current frame is the anticorrelated signal channel combination scheme, and the downmix mode switching cost value of the current frame satisfies the eighth downmix mode switching condition, wherein the downmix mode switching cost value is the value of the downmix mode switching cost function, and wherein the eighth downmix mode switching condition is that the value of the cost function for downmix mode D-to-downmix mode B switching of the current frame is greater than or equal to the value of the cost function for downmix mode D-to-downmix mode C switching.

11. The audio encoding apparatus of claim 7, wherein the computer program further causes the processor to be configured to at least one of:

determine that a downmix mode of the current frame is the downmix mode C and that the encoding mode of the current frame is a downmix mode A-to-downmix mode C encoding mode when the downmix mode of the previous frame is the downmix mode A, the channel combination scheme for the current frame is the anticorrelated signal channel combination scheme, and the downmix mode switching cost value of the current frame satisfies a ninth downmix mode switching condition, wherein the downmix mode switching cost value of the current frame is a channel combination ratio factor of the current frame, and wherein the ninth downmix mode switching condition is that the channel combination ratio factor of the current frame is less than or equal to a channel combination ratio factor threshold (S1);

determine that the downmix mode of the current frame is the downmix mode B and that the encoding mode of the current frame is a downmix mode A-to-downmix mode B encoding mode when the downmix mode of the previous frame is the downmix mode A, the channel combination scheme for the current frame is the anticorrelated signal channel combination scheme, and the downmix mode switching cost value of the current frame satisfies a tenth downmix mode switching condition, wherein the downmix mode switching cost value of the current frame is the channel combination ratio factor of the current frame, and wherein the tenth downmix mode switching condition is that the channel combination ratio factor of the current frame is greater than or equal to the S1;

determine that a downmix mode of the current frame is the downmix mode A and that the encoding mode of the current frame is a downmix mode B-to-downmix mode A encoding mode when the downmix mode of the previous frame is the downmix mode B, the channel combination scheme for the current frame is the correlated signal channel combination scheme, and the downmix mode switching cost value of the current frame satisfies an eleventh downmix mode switching condition, wherein the downmix mode switching cost value of the current frame is the channel combination ratio factor of the current frame, and wherein the eleventh downmix mode switching condition is that the channel combination ratio factor of the current frame is greater than or equal to a second channel combination ratio factor threshold (S2);

determine that a downmix mode of the current frame is the downmix mode D and that the encoding mode of the current frame is a downmix mode B-to-downmix mode D encoding mode when the downmix mode of the previous frame is the downmix mode B, the channel combination scheme for the current frame is the correlated signal channel combination scheme, and the downmix mode switching cost value of the current frame satisfies a twelfth downmix mode switching condition, wherein the downmix mode switching cost value of the current frame is the channel combination ratio factor of the current frame, and wherein the twelfth downmix mode switching condition is that the channel combination ratio factor of the current frame is less than or equal to the S2;

determine that a downmix mode of the current frame is the downmix mode D and that the encoding mode of the current frame is a downmix mode C-to-downmix mode D encoding mode when the downmix mode of the previous frame is the downmix mode C, the channel combination scheme for the current frame is the correlated signal channel combination scheme, and the downmix mode switching cost value of the current frame satisfies a thirteenth downmix mode switching condition, wherein the downmix mode switching cost value of the current frame is the channel combination ratio factor of the current frame, and wherein the thirteenth downmix mode switching condition is that the channel combination ratio factor of the current frame is greater than or equal to a third channel combination ratio factor threshold (S3);

determine that a downmix mode of the current frame is the downmix mode A and that the encoding mode of the current frame is a downmix mode C-to-downmix mode A encoding mode when the downmix mode of the previous frame is the downmix mode C, the channel combination scheme for the current frame is the correlated signal channel combination scheme, and the downmix mode switching cost value of the current frame satisfies a fourteenth downmix mode switching condition, wherein the downmix mode switching cost value of the current frame is the channel combination ratio factor of the current frame, and wherein the fourteenth downmix mode switching condition is that the channel combination ratio factor of the current frame is less than or equal to the S3;

determine that a downmix mode of the current frame is the downmix mode B and that the encoding mode of the current frame is a downmix mode D-to-downmix mode B encoding mode when the downmix mode of the previous frame is the downmix mode D, the channel combination scheme for the current frame is the anticorrelated signal channel combination scheme, and the downmix mode switching cost value of the current frame satisfies a fifteenth downmix mode switching condition, wherein the downmix mode switching cost value of the current frame is the channel combination ratio factor of the current frame, and wherein the fifteenth downmix mode switching condition is that the channel combination ratio factor of the current frame is less than or equal to a fourth channel combination ratio factor threshold (S4); or determine that a downmix mode of the current frame is the downmix mode C and that the encoding mode of the current frame is a downmix mode D-to-downmix mode C encoding mode when the downmix mode of the previous frame is the downmix mode D, the channel combination scheme for the current frame is the anticorrelated signal channel combination scheme, and the downmix mode switching cost value of the current frame satisfies a sixteenth downmix mode switching condition, wherein the downmix mode switching cost value of the current frame is the channel combination ratio factor of the current frame, and the sixteenth downmix mode switching condition is that the channel combination ratio factor of the current frame is greater than or equal to the S4.

12. The audio encoding apparatus according to claim 7, wherein the different downmix matrices comprise $M_{2A}$, $M_{2B}$, $M_{2C}$, and $M_{2D}$, and wherein:

$$M_{2A} = \begin{bmatrix} 0.5 & 0.5 \\ 0.5 & -0.5 \end{bmatrix}; \text{ or}$$

$$M_{2A} = \begin{bmatrix} \text{ratio} & 1-\text{ratio} \\ 1-\text{ratio} & -\text{ratio} \end{bmatrix},$$

wherein the $M_{2A}$ represents a downmix matrix corresponding to the downmix mode A of the current frame, and wherein the ratio represents the channel combination ratio factor corresponding to the correlated signal channel combination scheme for the current frame, wherein:

$$M_{2B} = \begin{bmatrix} \alpha_1 & -\alpha_2 \\ -\alpha_2 & -\alpha_1 \end{bmatrix}; \text{ or}$$

$$M_{2B} = \begin{bmatrix} 0.5 & -0.5 \\ -0.5 & -0.5 \end{bmatrix},$$

wherein the $M_{2B}$ represents a downmix matrix corresponding to the downmix mode B of the current frame, wherein $\alpha_1$=ratio_SM, wherein $\alpha_2$=1−ratio_SM, and wherein the ratio_SM represents the channel combination ratio factor corresponding to the anticorrelated signal channel combination scheme for the current frame, wherein:

$$M_{2C} = \begin{bmatrix} -\alpha_1 & \alpha_2 \\ \alpha_2 & \alpha_1 \end{bmatrix}; \text{ or}$$

$$M_{2C} = \begin{bmatrix} -0.5 & 0.5 \\ 0.5 & 0.5 \end{bmatrix},$$

wherein the $M_{2C}$ represents a downmix matrix corresponding to the downmix mode C of the current frame, wherein:

$$M_{2D} = \begin{bmatrix} -\alpha_1 & -\alpha_2 \\ -\alpha_2 & \alpha_1 \end{bmatrix}; \text{ or}$$

$$M_{2D} = \begin{bmatrix} -0.5 & -0.5 \\ -0.5 & 0.5 \end{bmatrix},$$

wherein the $M_{2D}$ represents a downmix matrix corresponding to the downmix mode D of the current frame.

13. A non-transitory computer-readable storage medium storing computer instructions, that when executed by one or more processors, cause the one or more processors to perform:

obtain a channel combination scheme for a current frame;

obtain an encoding mode of the current frame based at least on a downmix mode of a previous frame and the channel combination scheme for the current frame, wherein the downmix mode of the previous frame is a downmix mode A, a downmix mode B, a downmix mode C, or a downmix mode D, wherein the downmix mode A and the downmix mode D are correlated signal downmix modes, wherein the downmix mode B and the downmix mode C are anticorrelated signal downmix modes, and wherein the downmix mode A, the downmix mode B, the downmix mode C, and the downmix mode D correspond to different downmix matrices;

perform time-domain downmix processing on a left channel signal of the current frame based on the encoding mode of the current frame to obtain a primary channel signal of the current frame;

perform the time-domain downmix processing on a right channel signal of the current frame based on the encoding mode of the current frame to obtain a secondary channel signal of the current frame;

encode the primary channel signal and the secondary channel signal; and obtain the encoding mode of the current frame based further on a downmix mode switching cost value of the current frame, wherein the downmix mode switching cost value of the current frame is a calculation result of a switching cost based on a downmix mode switching cost function of the current frame, wherein the downmix mode switching cost function is based on at least one of a time-domain stereo parameter of the current frame, a time-domain stereo parameter of the previous frame, or the primary channel signal and the secondary channel signal, and wherein the downmix mode switching cost function is one of:

a cost function for downmix mode A-to-downmix mode B switching;

a cost function for downmix mode A-to-downmix mode C switching;

a cost function for downmix mode D-to-downmix mode B switching;

a cost function for downmix mode D-to-downmix mode C switching;

a cost function for downmix mode B-to-downmix mode A switching;

a cost function for downmix mode B-to-downmix mode D switching;

a cost function for downmix mode C-to-downmix mode A switching; or a cost function for downmix mode C-to-downmix mode D switching, wherein the cost function for downmix mode A-to-downmix mode B switching is as follows:

$$\text{Cost_AB} = \sum_{n=start_sample_A}^{end_sample_A} [(\alpha_{1_pre} - \alpha_1) * X_L(n) - (\alpha_{2_pre} + \alpha_2) * X_R(n)];$$

$$\alpha_{2_pre} = 1 - \alpha_{1_pre}; \text{ and } \alpha_2 = 1 - \alpha_1,$$

wherein Cost_AB represents a value of the cost function for downmix mode A-to-downmix mode B switching, wherein start_sample_A represents a calculation start sampling point of the cost function for downmix mode A-to-downmix mode B switching, wherein start_sample_A is an integer greater than zero and less than N−1, wherein end_sample_A represents a calculation end sampling point of the cost function for downmix mode A-to-downmix mode B switching, wherein end_sample_A is an integer greater than zero and less than N−1, wherein start_sample_A is less than end_sample_A, wherein n represents a sequence number of a sampling point, wherein N represents a frame length, wherein $X_L(n)$ represents the left channel signal of the current frame, wherein $X_R(n)$ represents the right channel signal of the current frame, $\alpha_1$=ratio_SM, wherein ratio_SM represents a channel combination ratio factor corresponding to an anticorrelated signal channel combination scheme for the current frame, wherein $\alpha_{1_pre}$=tdm_last_ratio, and wherein tdm_last_ratio represents a channel combination ratio factor corresponding to a second correlated signal channel combination scheme for the previous frame, wherein the cost function for downmix mode A-to-downmix mode C switching is as follows:

$$\text{Cost_AC} = \sum_{n=start_sample_A2}^{end_sample_A2} [(\alpha_{1_pre} + \alpha_1) * X_L(n) - (\alpha_{2_pre} - \alpha_2) * X_R(n)],$$

wherein Cost_AC represents a value of the cost function for downmix mode A-to-downmix mode C switching, wherein start_sample_A2 represents a calculation start sampling point of the cost function for downmix mode A-to-downmix mode C switching, wherein start_sample_A2 is an integer greater than zero and less than N−1, wherein end_sample_A2 represents a calculation end sampling point of the cost function for downmix mode A-to-downmix mode C switching, wherein end_sample_A2 is an integer greater than zero and less than N−1, wherein start_sample_A2 is less than end_sample_A2, wherein the cost function for downmix mode B-to-downmix mode A switching is as follows:

$$\text{Cost_BA} = \sum_{n=start_sample_B}^{end_sample_B} [(\alpha_{3_pre} - \alpha_3) * X_L(n) - (\alpha_{4_pre} + \alpha_4) * X_R(n)];$$

$$\alpha_{4_pre} = 1 - \alpha_{3_pre}; \text{ and } \alpha_4 = 1 - \alpha_3,$$

wherein Cost_BA represents a value of the cost function for downmix mode B-to-downmix mode A switching, wherein start_sample_B represents a calculation start sampling point of the cost function for downmix mode B-to-downmix mode A switching, wherein start_sample_B is an integer greater than zero and less than N−1, wherein end_sample_B represents a calculation end sampling point of the cost function for downmix mode B-to-downmix mode A switching, wherein end_sample_B is an integer greater than zero and less than N−1, wherein start_sample_B is less than end_sample_B, $\alpha_3$=ratio, wherein ratio represents a channel combination ratio factor corresponding to a correlated signal channel combination scheme for the current frame, wherein $\alpha_{3_pre}$=tdm_last_ratio_SM, and wherein tdm_last_ratio_SM represents a channel combination ratio factor corresponding to a second anticorrelated signal channel combination scheme for the previous frame, wherein the cost function for downmix mode B-to-downmix mode D switching is as follows:

$$\text{Cost_BD} = \sum_{n=start_sample_B2}^{end_sample_B2} [(\alpha_{3_pre} + \alpha_3) * X_L(n) - (\alpha_{4_pre} - \alpha_4) * X_R(n)],$$

wherein Cost_BD represents a value of the cost function for downmix mode B-to-downmix mode D switching, wherein start_sample_B2 represents a calculation start sampling point of the cost function for downmix mode B-to-downmix mode D switching, wherein start_sample_B2 is an integer greater than zero and less than N−1, wherein end_sample_B2 represents a calculation end sampling point of the cost function for downmix mode B-to-downmix mode D switching, wherein end_sample_B2 is an integer greater than zero and less than N−1, and wherein start_sample_B2 is less than end_sample_B2, wherein the cost function for downmix mode C-to-downmix mode D switching is as follows:

$$\text{Cost_CD} = \sum_{n=start_sample_C}^{end_sample_C} [-(\alpha_{3_pre} - \alpha_3) * X_L(n) + (\alpha_{4_pre} + \alpha_4) * X_R(n)],$$

wherein Cost_CD represents a value of the cost function for downmix mode C-to-downmix mode D switching, wherein start_sample_C represents a calculation start sampling point of the cost function for downmix mode C-to-downmix mode D switching, wherein start_sample_C is an integer greater than zero and less than N−1, wherein end_sample_C represents a calculation end sampling point of the cost function for downmix mode C-to-downmix mode D switching, wherein end_sample_C is an integer greater than zero and less than N−1, and wherein start_sample_C is less than end_sample_C, wherein the cost function for downmix mode C-to-downmix mode A switching is as follows:

$$\text{Cost_CA} = \sum_{n=start_sample_C2}^{end_sample_C2} [-(\alpha_{3_pre} + \alpha_3) * X_L(n) + (\alpha_{4_pre} - \alpha_4) * X_R(n)],$$

wherein Cost_CA represents a value of the cost function for downmix mode C-to-downmix mode A switching, wherein start_sample_C2 represents a calculation start sampling point of the cost function for downmix mode C-to-downmix mode A switching, wherein start_sample_C2 is an integer greater than zero and less than N−1, wherein end_sample_C2 represents a calculation end sampling point of the cost function for downmix mode C-to-downmix mode A switching, wherein end_sample_C2 is an integer greater than zero and less than N−1, and wherein start_sample_C2 is less than end_sample_C2, wherein the cost function for downmix mode D-to-downmix mode C switching is as follows:

$$\text{Cost_DC} = \sum_{n=start_sample_D}^{end_sample_D} [-(\alpha_{1_pre} - \alpha_1) * X_L(n) - (\alpha_{2_pre} + \alpha_2) * X_R(n)],$$

wherein Cost_DC represents a value of the cost function for downmix mode D-to-downmix mode C switching, wherein start_sample_D represents a calculation start sampling point of the cost function for downmix mode D-to-downmix mode C switching, wherein start_sample_D is an integer greater than zero and less than N−1, wherein end_sample_D represents a calculation end sampling point of the cost function for downmix mode D-to-downmix mode C switching, wherein end_sample_D is an integer greater than zero and less than N−1, and wherein start_sample_D is less than end_sample_D, and wherein the cost function for downmix mode D-to-downmix mode B switching is as follows:

$$\text{Cost_DB} = \sum_{n=start_sample_D2}^{end_sample_D2} [-(\alpha_{1_pre} + \alpha_1) * X_L(n) - (\alpha_{2_pre} + \alpha_2) * X_R(n)],$$

wherein Cost_DB represents a value of the cost function for downmix mode D-to-downmix mode B switching, wherein start_sample_D2 represents a calculation start sampling point of the cost function for downmix mode D-to-downmix mode B switching, wherein start_sample_D2 is an integer greater than zero and less than N−1, wherein end_sample_D2 represents a calculation end sampling point of the cost function for downmix mode D-to-downmix mode B switching, wherein end_sample_D2 is an integer greater than zero and less than N−1, and wherein start_sample_D2 is less than end_sample_D2.

* * * * *